US007015817B2

(12) United States Patent
Copley et al.

(10) Patent No.: US 7,015,817 B2
(45) Date of Patent: Mar. 21, 2006

(54) PERSONAL TRACKING DEVICE

(76) Inventors: Shuan Michael Copley, 4146 Trees Dr., Lafayette, IN (US) 47909; Jay D. Miller, 445 Homestead La., Greenwood, IN (US) 46142; Mark Bellehumeur, 1800 Hollow Falls Ct., Frisco, TX (US) 75034

( * ) Notice: Subject to any disclaimer, the term of this patent is extended or adjusted under 35 U.S.C. 154(b) by 0 days.

(21) Appl. No.: 10/967,005

(22) Filed: Oct. 15, 2004

(65) Prior Publication Data

US 2005/0068169 A1 Mar. 31, 2005

Related U.S. Application Data

(63) Continuation-in-part of application No. 10/649,486, filed on Aug. 27, 2003, which is a continuation of application No. 10/145,310, filed on May 14, 2002, now Pat. No. 6,639,516.

(60) Provisional application No. 60/511,951, filed on Oct. 15, 2003.

(51) Int. Cl.
*G08B 23/00* (2006.01)

(52) U.S. Cl. ..... 340/573.4; 340/539.13; 340/539.15; 340/539.22; 455/404.1; 455/404.2; 455/456.5

(58) Field of Classification Search ..... 340/573.4, 340/539.13, 539.15, 539.22; 455/404.1, 455/404.2, 456.5

See application file for complete search history.

(56) References Cited

U.S. PATENT DOCUMENTS 4,728,959 A 3/1988 Maloney et al.
5,103,474 A 4/1992 Stoodley et al.
5,255,306 A 10/1993 Melton et al.
5,396,227 A 3/1995 Carroll et al.
5,461,390 A 10/1995 Hoshen
5,526,357 A 6/1996 Jandrell
5,731,757 A 3/1998 Layson, Jr.
5,745,037 A 4/1998 Guthrie et al.
5,867,103 A 2/1999 Taylor, Jr.
5,959,533 A 9/1999 Layson, Jr. et al.
5,982,281 A 11/1999 Layson, Jr.
6,006,097 A 12/1999 Hornfeldt et al.
6,014,080 A 1/2000 Layson, Jr.
6,072,396 A 6/2000 Gaukel (Continued)

OTHER PUBLICATIONS

"Location Technologies for GSM, GPRS and WCDMA Networks," White Paper (33 pp.) Snap Track™ Incorpation, a wholly owned subsidiary of QUALCOMM, Inc., ©Copyright 1997-2001.

(Continued)

*Primary Examiner*—Thomas J. Mullen, Jr.
*Assistant Examiner*—Tai T. Nguyen
(74) *Attorney, Agent, or Firm*—Woodard, Emhardt, Moriarty, McNett & Henry LLP

(57) ABSTRACT

A system for monitoring the location of individuals, such as parolees, includes a wearable device worn by the individual and a portable device operatively coupled to the wearable device. The portable device is operatively coupled to a monitoring system through a wireless telephone network. The portable device transmits periodically encrypted location information as well as status information across the wireless network to the monitoring system. The monitoring system tracks the location of the individual and alerts the appropriate authorities when the individual violates a rule, such as a condition for parole. The portable device increases the time between transmissions when the individual is within a specified home location and reduces the time between transmissions when outside the specified location.

12 Claims, 37 Drawing Sheets

U.S. PATENT DOCUMENTS

| | | | | |
|---|---|---|---|---|
| 6,100,806 | A | 8/2000 | Gaukel | |
| 6,218,945 | B1 | 4/2001 | Taylor, Jr. | |
| 6,330,452 | B1 | 12/2001 | Fattouche et al. | |
| 6,337,665 | B1 | 1/2002 | Gaukel | |
| 6,351,221 | B1 | 2/2002 | Phillips et al. | |
| 6,405,213 | B1 | 6/2002 | Layson et al. | |
| 6,522,265 | B1 * | 2/2003 | Hillman et al. | 340/988 |
| 6,819,247 | B1 * | 11/2004 | Birnbach et al. | 340/573.1 |
| 6,907,238 | B1 * | 6/2005 | Leung | 455/404.1 |
| 2001/0026240 | A1 | 10/2001 | Neher | |
| 2002/0024443 | A1 | 2/2002 | Hawkins et al. | |
| 2002/0196147 | A1 | 12/2002 | Lau | |
| 2003/0020623 | A1 | 1/2003 | Cao et al. | |

OTHER PUBLICATIONS

"An Introduction to Snap Track™ Server-Aided GPS Technology".

FCC Wireless 911 Requirements, "Fact Sheet." WTB/Policy, Jan. 2001.

"How Location Tracking Will Work" ©Copyright 1998-2002 Howstuffworks, Inc.

"Nextel Comunications, Inc. Phase II E911 Quarterly Report," Feb.1, 2002. (Before the Federal Communications Commission, Washington, DC 20554. In the *Matter of Revision of the Commission's Rules to Ensure Compatibility With Enhanced 911 Emergency Calling Systems, Wireless E911 II Implementation Plan of Nextel Communications, Inc.*, Order, CC, FCC 01-295, released Oct. 12, 2001 ("Nextel Waiver Order".).

Snap Track's Personal Location Technology™, "System Description". ©2002 Snap Track, Inc., a QUALCOMM® Company.

Phipps, Jeanine, Purdue Research Parks News, "Research Park startup launches improved electronic monitoring system", Oct. 16, 2003, 4 pages, http://www.purdue.edu/UNS/html4ever/031016.Celltrack.launch.html.

GCS Guidance Control Systems, OM247 Offender Monitoring Electronics, ®2004 Guidance Control Systems Ltd., 4 pages, http://www.gcsltd.com.uk/index.html.

AVID Wireless, Success Story—Nextel GPS Parolee Tracking System, Dec. 15, 2003, ©Copyright AVIDWireless 2002, 2 pages, http://www.avidwireless.com/SuccessParolee.htm.

Kansal, Aman, "Bluetooth Primer", ©2002 Red-M, 30 pages.

* cited by examiner

PERSONAL TRACKING DEVICE

REFERENCE TO RELATED APPLICATIONS

The present application is a continuation-in-part of U.S. patent application Ser. No. 10/649,486, filed Aug. 27, 2003, which is a continuation of U.S. patent application Ser. No. 10/145,310, filed May 14, 2002, now U.S. Pat. No. 6,639,516, the disclosures of which are hereby incorporated by reference in their entirety, and the present application claims the benefit of U.S. Provisional Application No. 60/511,951, filed Oct. 15, 2003, the disclosure of which is hereby incorporated by reference in its entirety.

BACKGROUND OF THE INVENTION

The present invention generally relates to tracking systems, and more specifically, but not exclusively, concerns a tracking system that is able to track home parolees and other similar individuals inside or outside of buildings.

With increased prison population, governments have been trying alternate ways of incarcerating criminals. One popular program is a "house" arrest program for parolees and non-violent offenders. In one such a system, the monitored person wears an ankle bracelet or some other device that ensures the monitored person is able to freely move within a confined geographic area, such as a house. One problem faced with such systems is to be able to accurately determine the location of the monitored individual so as to reduce the number of "false alarms" in which the location of the monitored individual is temporarily lost even though the monitored person remains in the confined location. Due to structures, such as walls of buildings, signals from the locating device may become blocked such that the monitored person has "disappeared" with respect to the locating system.

Another area in the criminal justice system where location of individuals is a concern is in the area of restraining orders. Since the location of the person against whom a restraining order has been issued is usually unknown, the person who obtained the restraining order faces the constant fear that the order could be violated at any time. Due to limited police resources, a large number of restraining order violations can occur without the police even detecting the violation. Even when police are aware of a violation, it takes time for the police to respond to the violation, while the potential victim or at risk person might not be even aware of the violation.

U.S. patent application Publication US 2002/0024443 A1 to Hawkins et al., published Feb. 28, 2002 (U.S. patent application Ser. No. 09/940,905, filed Aug. 27, 2001), which is hereby incorporated by reference in its entirety, discloses an automated tracking that uses "fuzzy logic" in determining whether to record location information about a tracked person. Since locations in such a system are recorded a periodically and due to the complexity involve with a fuzzy logic system, there remains a significant risk that a tracked person can circumvent such a system and remain undetected during a violation. Moreover, the Hawkins system fails to address potential privacy concerns when transmitting information over a publicly accessible network, such as wireless telephone network and/or a computer network. The lives of tracked individuals may be placed in danger when their location can be easily determined.

Another concern for personal tracking systems is to have the ability to directly communicate with the monitored person. For example, the monitored person may have a low battery in their device or some other malfunction and therefore, need to directly communicate with the specific personnel to let them know of the problem. Moreover, a parole officer at times may want to speak with a parolee so as to check their status as to specific meetings and/or parole violations. In prior tracking systems, although information could be received from the monitored individual, such as status information, there was no ability to directly communicate with a monitored individual and/or broadcast messages to selected groups of monitored individuals.

Thus, there remains a need for an improved technique and system for tracking individuals.

SUMMARY OF THE INVENTION

One form of the present invention concerns a unique tracking system and a unique method for tracking individuals.

In one form of the present invention, periodic status signals are received with a portable device from a wearable device worn by a person. The status signals indicate the operational status of the wearable device, and the operational status includes an indication of whether the person has tampered with the wearable device. The portable device determines periodically location of the portable device. Messages are transmitted periodically from the portable device to a monitoring system via a wireless telephone network. The messages include the location of the portable device and the operational status of the wearable device. Transmission rate of the messages from the portable device to the monitoring system is adjusted by reducing the transmission rate when the portable device is within a specified region and increasing the transmission rate when the portable device is outside the specified region.

In further aspect of the present invention, messages are received periodically at a monitoring system from a portable device in possession of a monitored person via a wireless telephone network. The messages include location of the portable device. The allowable time between the messages from the portable device is adjusted by increasing the allowable time between the messages when the portable device is within a specified region and by decreasing the allowable time between the messages when the portable device is outside the specified region. A violation occurs when the allowable time between the messages is exceeded. A law enforcement official is alerted of the violation.

In another form, a processor is operable to receive messages containing location of a portable device in possession of a monitored person via a wireless telephone network. Memory is operatively coupled to the processor, and the memory is operable to store rules pertaining to the monitored person. The rules include an allowable time between the messages and a designated area in which the allowable time between the messages is increased. The processor is operable to increase the allowable time between the messages when the portable device is located in the designated area, and the processor is operable to alert an individual when the portable device violates at least on of the rules in the memory.

In still yet another form, a monitoring system monitors a tracking device over a network. The tracking device includes a wearable device worn by a monitored individual. The monitoring system determines that the tracking device has a problem, and in response, the tracking device is reset by sending a reset command over the network from the monitoring system to the tracking device.

In a further form, the location of a monitored individual is tracked with a tracking device. When the tracking device senses that the monitored individual is generally motionless, processing of the location of the monitored individual is ceased.

Other forms, embodiments, objects, features, advantages, benefits and aspects of the present invention shall become apparent from the detailed drawings and description contained herein.

DESCRIPTION OF SELECTED EMBODIMENTS

Figure 1:
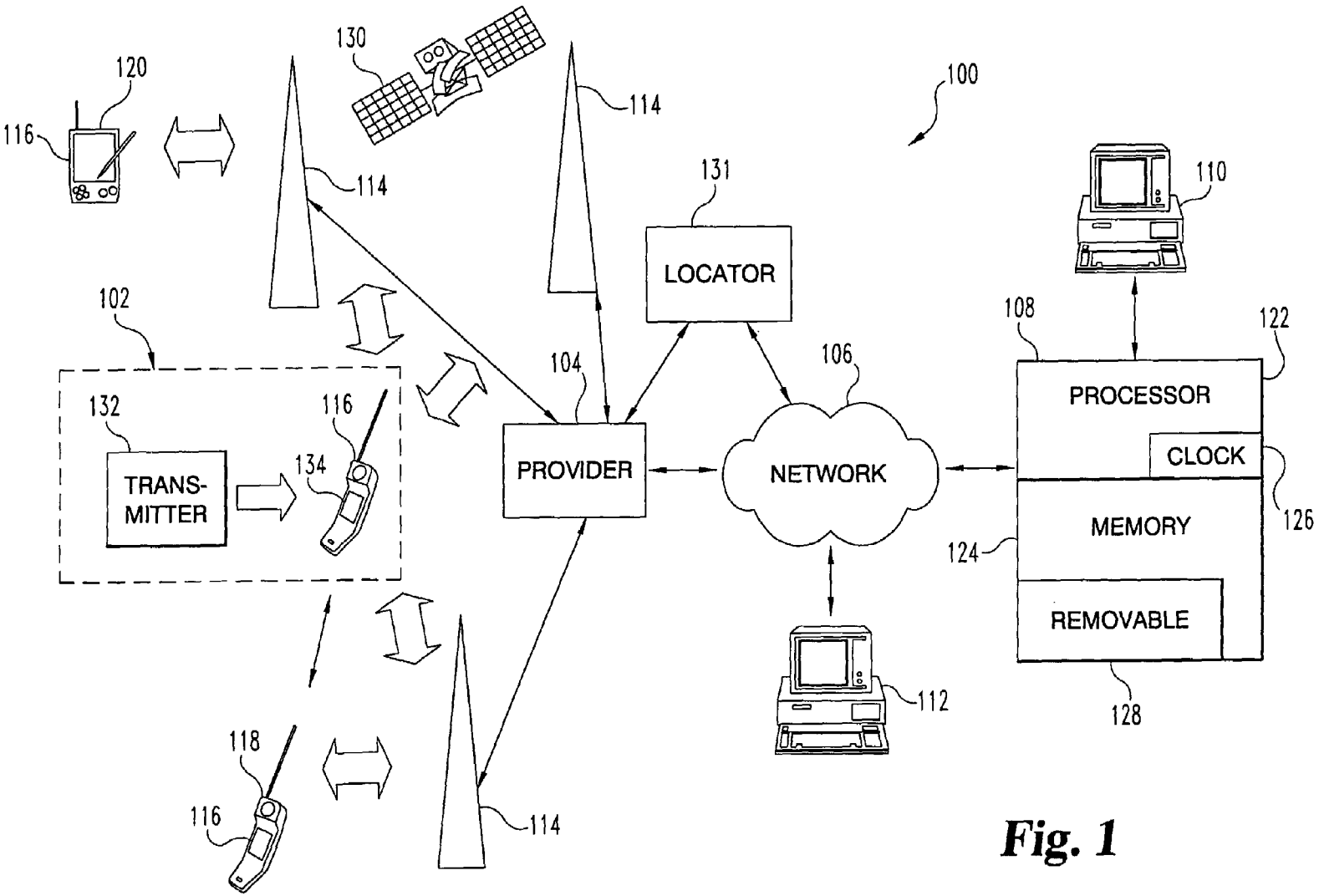
FIG. 1 is a diagrammatic view of a personal tracking system according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates. One embodiment of the invention is shown in great detail, although it will be apparent to those skilled in the art that some of the features which are not relevant to the invention may not be shown for the sake of clarity.

A system 100 for tracking monitored individuals according to one embodiment of the present invention is illustrated in FIG. 1. System 100 includes a personal tracking device or unit (PTU) 102 for tracking a monitored individual, a wireless telephone provider system 104, a computer network 106 operatively coupled to the wireless provider system or network 104, and monitoring system 108 operatively coupled to the computer network 106. As depicted in FIG. 1, an administrative computer 110 is operatively coupled to the monitoring system 108, and a law enforcement computer 112 is operatively coupled to the monitoring system 108 through the computer network 106. As should be appreciated, the administrative computer 110 can be operatively coupled to the monitoring system 108 through the computer network 106, and the law enforcement computer 112 can be directly coupled to the monitoring system 108. In system 100, the tracking device 102 communicates with the monitoring system 108 and determines its location through wireless telephone antennas or cell phone towers 114, which are operatively coupled to the wireless provider system 104. As shown in FIG. 1, portable devices 116 communicate with the monitoring system 108 through the cell towers 114. The portable devices 116 can include, but are not limited to, both analog and digital cell phones, pagers, personal digital assistants (PDAs), a laptop computers and the like. In one embodiment, the portable devices 116 are cell phones. The portable devices 116 include a portable law enforcement device 118 that is used by monitoring system 108 to alert law enforcement officials of violations and a victim or at risk individual device 120 that is used alert at risk individuals, such as a person with a restraining order, that a monitored person is in close proximity. Moreover, as illustrated in FIG. 1, tracking device 102 incorporates portable device 116.

The monitoring system 108 is used to track the location of monitored individuals and report to the law enforcement officials and/or potential victims any parole and/or restraining order violations. The monitored individuals can include, but are not limited to, parolees, house arrest detainees, persons whom have a restraining order placed against them, and other persons to whom the criminal legal system wishes to track. For example, when a parolee violates the location restrictions of their parole, monitoring system 108 determines that a violation has occurred and alerts law enforcement officials of the violation through law enforcement computer 112 and/or portable law enforcement device 118. In another example, the monitoring system 108 can alert an at risk individual through at risk individual device 120 that a monitored person has violated their restraining order and can give the location of the monitored person so that the at risk individual can take preventative measures to avoid the monitored person. Administrative computer is used to administer the monitoring system 108 and generate reports. As depicted in FIG. 1, the monitoring system 108 includes a processor 122 and memory 124. The monitoring system 108 along with computers 110 and 112 can include personal computers, portable devices 116, computer terminals, PDAs, and/or other types of devices generally known to those skilled in the art. In one embodiment, the monitoring system 108 is a personal computer or server encoded with software that performs the monitoring techniques as described below.

The processor 122 is used to control the operation of the monitoring system 108. The processor 122 may be comprised of one or more components. For a multi-component form of processor 122, one or more components may be located remotely relative to the others, or configured as a single unit. Furthermore, processor 122 can be embodied in a form having more than one processing unit, such as a multi-processor configuration, and should be understood to collectively refer to such configurations as well as a single-processor-based arrangement. One or more components of the processor 122 may be of electronic variety defining digital circuitry, analog circuitry, or both. Processor 122 can be of a programmable variety responsive to software instructions, a hardwired state machine, or a combination of these. Among its many functions, the memory 124 in conjunction with the processor 122 is used to store and determine the location of monitored individuals. As shown, monitoring system 108 can include a clock 126 for timing and tracking events. It should be understood that clock 126 can be hardware based and/or software based.

Memory 124 can include one or more types of solid state memory, magnetic memory, or optical memory, just to name a few. By way of nonlimiting example, memory 124 can include solid state electronic random access memory (RAM), sequential access memory (SAM) (such as first-in, first-out (FIFO) variety or last-in, first-out (LIFO) variety), programmable read-only memory (PROM), electronically programmable read only memory (EPROM), or electronically erasable programmable read only memory (EEPROM); an optical disk memory (such as a DVD or CD-ROM); a magnetically encoded hard disk, floppy disk, tape, or cartridge medium; or a combination of these memory types. In addition, the memory 124 may be volatile, non-volatile, or a hybrid combination of volatile and non-volatile varieties, and memory 124 can be in the form of removable memory. As illustrated, memory 124 can include removable memory 128 that can be in the form of a non-volatile electronic memory unit, optical memory disk (such as a DVD or CD ROM); a magnetically encoded hard disk, floppy disk, tape, or cartridge medium; or a combination of these or other removable memory types. Network 106 can include the Internet, one or more other wide area networks (WAN), a local area network (LAN), a proprietary network such as provided by America Online, Inc., a combination of these, and/or other types of networks generally known to those skilled in the art. In one form of the present invention, the network 106 includes the Internet.

The wireless telephone provider system 104 includes both analog or digital cell phone systems, such as wireless telephone systems that use Code-Division Multiple Access (CDMA), Personal Communication Services (PCS) and other types of wireless telephone networks/services as generally know to those skilled in the art. The wireless system 104 is operable to locate the portable devices 116 and transmit the location to the portable devices 116. The location of portable devices 116 can be determined through angle of arrival to towers 114, time of arrival to towers 114, through assisted GPS via satellite 130, a combination of these, and in other manners as generally know to those skilled in the art. In one embodiment, the location of portable devices 116 is tracked by using a SNAPTRACK brand assisted-GPS system.

As noted above, since the position of a monitored person is constantly tracked and reported, the communication costs involved in tracking the monitored person can be significant. Therefore, there has been a need to reduce communication costs associated with tracking systems. One significant communication cost source is associated with the transmission of location information from the tracking device 102. In one embodiment, a location tracking system 131 is used to monitor the location of the tracking device and relay the location information to the monitoring system 108. The location tracking system 131 can be operated by a third party, such as by the wireless telephone provider. By having a third party determine the location of the tracking device 102, a significant amount of overhead associated with determining the monitored person's location can be reduced. The size of the data packets with location information communicated from the location tracking system 103 can be reduced and/or the intervals between transmission of location information can be adjusted based on a number of factors, including the current location of the monitored individual. As should be appreciated, reducing the amount of data communicated in such manners, reduces the communication costs associated with system 100.

In the embodiment illustrated in FIG. 1, the location tracking system 131 is operatively coupled to and communicates through the wireless telephone provider system 104 and the network 106. However, it is contemplated that in other embodiments the location tracking system 131 can be only operatively coupled to the wireless telephone provider system 104 or the network 106. For example, in one particular form, the location tracking system 114 is integrated into the wireless telephone provider system 104. Wireless telephone providers, such as Nextel, offer location tracking services in which a company or some other organization can request the location of a cellular telephone, if so authorized. By bundling the location tracking service with the wireless communication service plan, a more favorable overall rate can be negotiated between the wireless telephone provider and the owners of the monitoring system 108. Moreover, the location information can be stored on the location tracking system 131, and only a summary of the location information, such as an average location, or a sample of the location information can be transmitted to the monitoring system 108, thereby reducing the overall data bandwidth used. In one embodiment, the monitoring system 108 places a request with the location tracking system 131 in order to receive the location of the tracking device 102, and in another embodiment, the location tracking system 131 periodically sends or pushes the location information to the monitoring system 108. For instance, the location tracking system 131 can periodically send location information at a low rate, and the monitoring system 108 can request location information at a higher rate, when the monitored person is violating a rule. It is contemplated that in other embodiments a combination of requesting and pushing techniques can be used. In another embodiment, the tracking device 102 determines its location and changes the reporting rate for the location information based on where the tracking device 102 is located.

As illustrated in the FIG. 1, the tracking device 102 includes two components, a wearable transmitter or personal identification device (PID) 132 and monitored portable device 134 (116). The PID 132 is wearable by the monitored person and periodically transmits a status signal to device 134. In one embodiment, PID 132 is an ankle bracelet attached to the ankle of the monitored person and device 134 is a cellular telephone. As should be appreciated, PID 132 and device 134 can be separate components or integrated into a single unit. In one form, PID 132 and device 134 are operatively coupled to one another through a wireless connection. Wearable PID 132 is operable to only transmit for a limited range. It should be appreciated that PID 132 and device 134 can be operatively coupled to one another using a radio frequency transmission protocol, such as using Bluetooth technology or IEEE 802.11.

Figure 2:
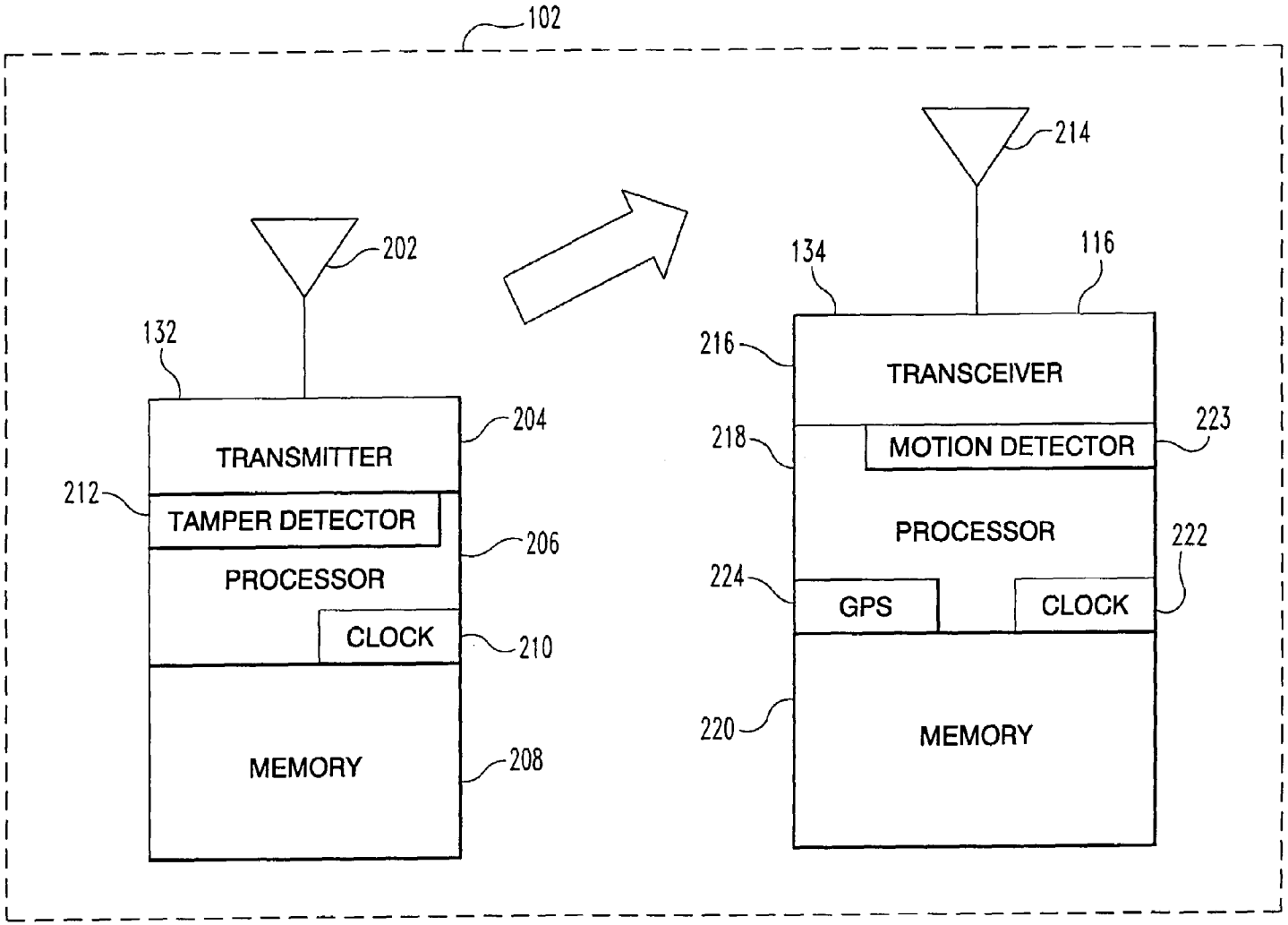
FIG. 2 is a diagrammatic view of a tracking device used in the FIG. 1 system.

As depicted in greater detail in FIG. 2, wearable PID 132 includes an antenna 202, a transmitter (or transceiver) portion 204, a processor 206, memory 208 and a clock 210. The processor 206, memory 208 and clock 210 are similar to the ones described above. Transmitter portion 204 and antenna 202 are used to transmit the status signal to device 134. As should be appreciated, both PID 132 and device 134 can be powered through a battery, fuel cell and/or in other generally known manners. As shown, PID 132 includes a tamper evidence detector 212 for detecting the monitored person tampering with PID 132 in an attempt to remove the wearable PID 132. The tamper evidence detector 212 can include, but is not limited to, a thermal sensor for sensing body temperature and a wire though a strap that secures the wearable PID 132 to the monitored person. Portable device 134 includes an antenna 214, a transceiver 216, a processor 218, memory 220, a clock 222, and a motion detector or sensor 223. Antenna 214 and transceiver 216 are used for communicating with the wearable PID 132 and the cell towers 114. Processor 218, memory 220 and clock 222 are similar to the ones described above. The motion sensor 223 is used determine if the monitored individual is moving so that the portable device 134 can utilize a number energy conserving techniques when the individual is not in motion. In the illustrated embodiment, the motion sensor 223 is incorporated into the portable device 132, but it should be recognized that the motion sensor 223 can be located elsewhere. For example, the motion sensor 223 in a further embodiment is incorporated into the PID 132, and in yet another embodiment, the motion sensor 223 is a separate unit worn by the individual. In one embodiment, the motion sensor 223 includes an off the shelf ball and cage type motion sensor. However, it should be recognized that the motion sensor 223 can include other types of motion sensors, such as accelerometers, gyroscopes and mercury switches, to name a few. As an optional feature, when assisted GPS or regular GPS is used, monitored portable device 134 can include a GPS receiver or chip set 224.

Figure 3:
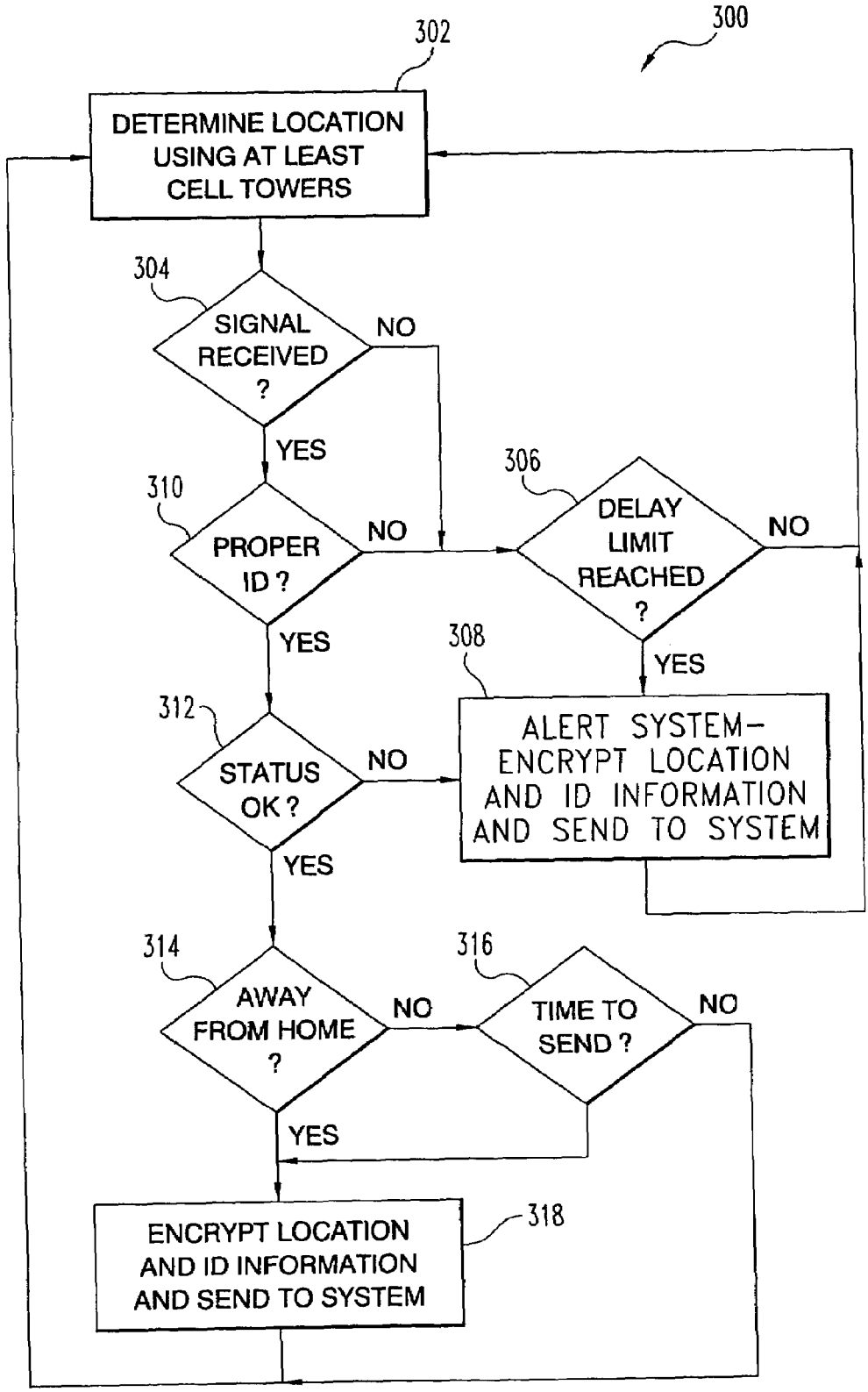
FIG. 3 is a flow diagram illustrating a technique for location tracking of monitored individuals according to one embodiment of the present invention.

A technique according to one embodiment for transmitting the status of the monitored device 102 is illustrated with flow diagram 300 in FIG. 3. In stage 302, portable device 134 determines its location through cell towers 114 and the wireless provider system 104 (i.e., enhanced 911 service). By using cell towers 114 to locate as to solely locating using other types of systems, such as GPS, the monitored device 102 is able to be tracked even when indoors. This improves the overall location determination efficiency. However, in another embodiment, the monitored device 102 is tracked using GPS and/or assisted GPS. Processor 218 of device 134 stores its location in memory 220. The wearable PID 132 periodically transmits status information to device 134. In one embodiment, the wearable transmitter transits identification and status information to portable device 134 every five (5) seconds. In stage 304, device 134 determines whether a signal has been received from PID 132. If the status signal has not been received, the processor 218 determines whether a delay limit between signals has been reached. The wearable PID 132 is given a specified period of time to communicate with the portable device 134. This delay limit reduces the number of false alarms caused by conditions, such as radio interference or the monitored person being temporarily away from the portable device 134. In one embodiment, the delay time limit is fifteen (15) seconds. As should be appreciated, other time limits can be used, depending on operational conditions. If in stage 306 the delay time limit has yet been reached, the processor 218 in the portable device 134 continues to determine its current location in stage 302. Otherwise, when the delay time limit has been reached in stage 306, processor 218 transmits an encrypted alert message to monitoring system 108 in stage 308. The alert message is sent via the cell towers 114 of the wireless telephone network 104 and network 106 to the monitoring system 108. In stage 308, the portable device 134 encrypts the location data from stage 302 along with a portable device/monitored person identifier. By encrypting this information, the privacy of the persons tracked by system 108 is preserved even when transmitted across a publicly accessible networks 104 and 106. Privacy is especially important for a person with a restraining order. By encrypting communications, the restrained monitored person is unable to locate easily the person with a restraining order. The portable device identifier is used to identify the monitored person. In one form, this identifier is a unique serial number. It should be understood that other types of identifiers can be used to identify the monitored system. In one embodiment, processor 218 encrypts the location and identifier information using a two key or asymmetric encryption algorithm. Following stage 308, the processor 218 of the portable device 116 continues to monitor its location in stage 302 and for a signal in stage 304.

As mentioned above, the wearable PID 132 periodically transmits a signal containing status information along with an identifier that identifies the wearable transmitter 134. The unique identifier can be a serial number or some other type of identifier as known by those skilled in the art. In one form, the identifier transmitted by the wearable PID 132 is the same as the portable device identifier. In another form, the wearable transmitter pseudo-randomly changes the identifier at specified timer intervals in order to prevent tampering. In one embodiment, the status and identifier information is encrypted using an asymmetric encryption algorithm. It should be appreciated that other types of encryption algorithms can also be used. When the portable device 134 receives a signal in stage 304, processor 218 determines whether the signal contained the proper identifier. If not, processor 218 determines whether the delay time limit was reached in stage 306, and when required, alerts the monitoring system 108 in stage 308. If the portable device 134 determines that the proper identifier was received in stage 310, processor 218 determines in stage 312 whether the status portion of the received signal indicates that the status of the wearable PID 132 is normal. The status signal from wearable PID 132 will not be normal or "OK" when the wearable PID 132 is not operating properly. For example, if the tamper evidence device 212 detects tampering with the wearable PID 132, the wearable PID 132 sends a "tamper" status signal to the portable device 134. In another example, the wearable PID 132 sends a "low battery" signal when the charge of batteries in the wearable device 134 is low. When the status of the wearable PID 132 is not normal in stage 312, the portable device 134 sends an alert to the monitoring system 108 in stage 308. As should be understood, the portable device 134 can further send the status information from the wearable PID 132 to the monitoring system 108 in stage 308.

In stage 312, when the status of the wearable PID 132 is normal, the portable PID 132 in stage 314 determines whether the monitored person is away from a designated "home" location or zone. To reduce traffic on system 100, the portable PID 132 and monitoring system 108 incorporates a variable transmission rate feature according to the present invention. Not only does this feature reduce communication traffic, this feature also reduces resource demands on the monitoring system 108 so that a larger number of persons can be monitored at the same time. With this feature, the portable device 134 reduces the number of location/status transmissions to the monitoring system 108 when the monitored person is at a "home" location, such as their home or place of work. This reduces the amount of redundant location information received and processed by the monitoring system 108. When a monitored person is on the move, such as travelling away from their home, location information is sent to the monitoring system 108 at a higher rate.

With this technique, both portable device 134 and system 108 are aware of when the transmission rate of location information is adjusted. This makes it more difficult for a monitored person to circumvent safety protocols in system 108. In one embodiment, one or more "home" locations are preprogrammed in the portable device 134 and stored in memory 124 of the monitoring system 108 when the monitored person is initially registered with the system 108. In another embodiment, the portable device 134 downloads one or more "home" locations periodically (such as every night) from the monitoring system 108. In still yet another embodiment, the portable device 134 dynamically creates a "home" location. When a person has not moved from a location for a specified period of time, the portable device sends a "home" location signal to the monitoring system 108 to alert the monitoring system 108 that the portable device 134 is going to increase the period between transmissions. In one form, when the location determined in stage 302 has not changed for ten minutes, the portable device 134 sends a signal to the monitoring system 108 designating the current location as a "home" location and changes to a "home" location transmission mode.

When in stage 314 the processor 218 of the portable device 134 determines that the monitored person is at a "home" location, processor 218 in stage 318 determines whether it is time to send the location information under "home" transmission mode. In one embodiment, the portable PID 132 sends its location every five minutes in the "home" transmission mode and every thirty seconds when not in the "home" transmission mode. It should be appreciated that other time intervals can be used. When the time has elapsed in stage 316 or the monitored person is away from a "home" location in stage 314, the portable device 134 encrypts and sends to the monitoring system the portable device identifier along with the location information. In stage 316, if the time interval between transmissions in the "home" transmission mode has not elapsed, the portable device 134 does not send location information to the monitoring system 108 and determines its current location in stage 302.

Figure 4:
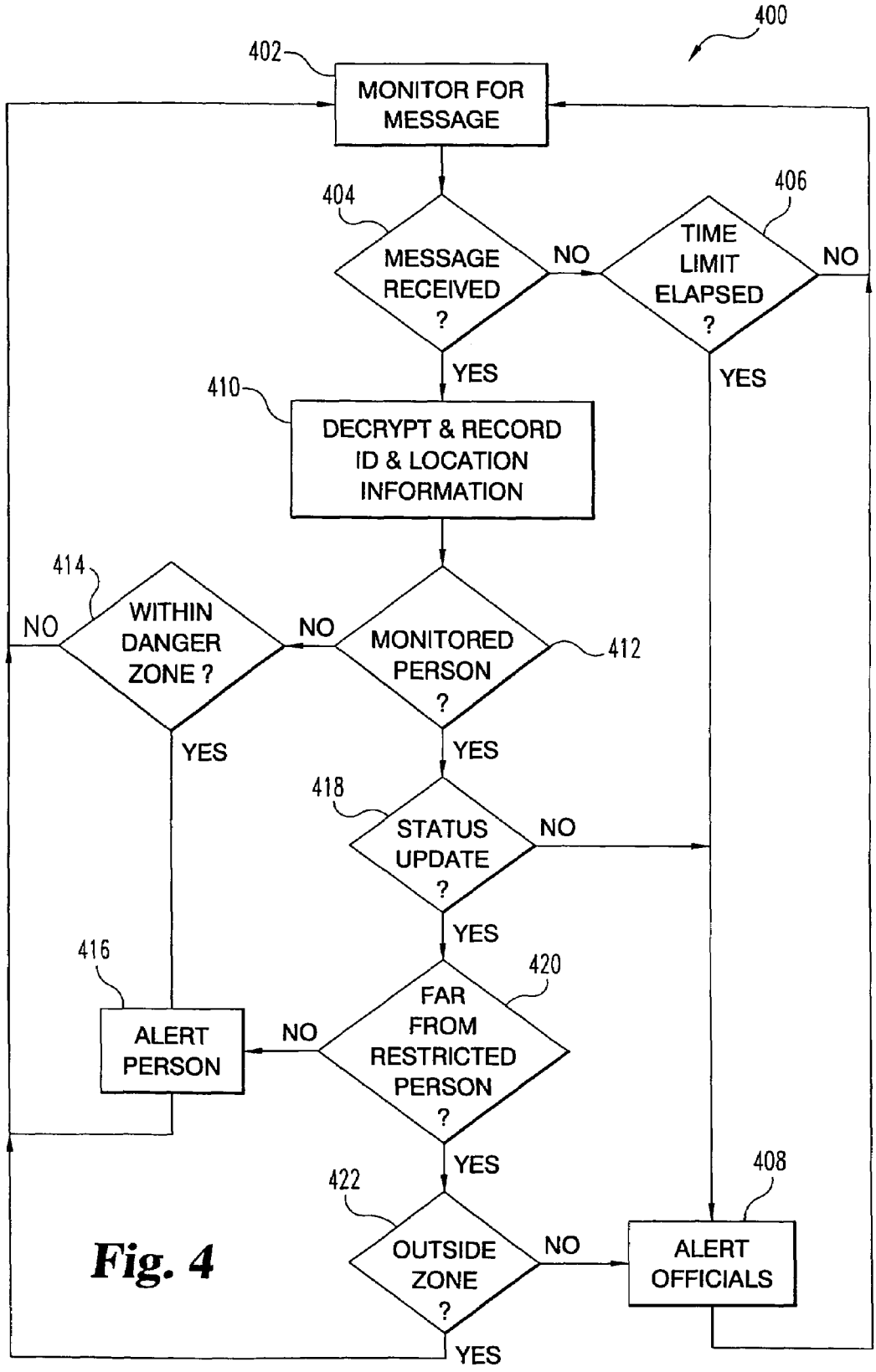
FIG. 4 is a flow diagram illustrating a technique for processing violations by the monitored individuals with the FIG. 1 system.

A technique for processing messages from monitored persons is illustrated with flow diagram 400 in FIG. 4. In stage 400, the monitoring system 108 monitors for messages from the network 106, and the processor 122 of the monitoring system 108 determines in stage 404 whether a message has been received in stage 404. If a message has not been received, processor 122 determines whether an allowable time between messages limit has been reached for any of the monitored persons. As discussed above, the time limit between message can be variable, depending on whether the monitored person is at a "home" location or not. The monitoring system 108 maintains time limit and other information about the monitored persons in memory 124. By way of non-limiting example, the information stored in memory 124 can include the name of the monitored person, description, criminal record, home address, telephone number, place of work, work schedule, permitted locations of travel, restraining order information, time limits between messages information, last known location, identifier for the portable device 134, historical travel information and the like. In one embodiment, the information stored in memory 124 is stored in a database. As should be appreciated, other types of data structures can be used to store information in memory 124. In stage 406, if the time limit between messages has not elapsed for a monitored, processor 122 of the monitoring system 108 continues to monitor for messages in stage 402.

When the time limit for a particular monitored person has elapsed in stage 406, the monitoring system 108 alerts officials of the violation. The alert can contain the name of the monitored person, description and their last known location. It should be appreciated that the alert can contain additional information. In one embodiment, the monitoring system 108 sends the alert across the network 106 to the law enforcement computer 112, and in one form, the monitoring system 108 sends an email containing the alert to the law enforcement computer 112. In another form, an alert web page is displayed on the law enforcement computer 112. Once the alert is received, law enforcement officials can be dispatched in order to find the monitored person. Alternatively or additionally, the monitoring system 108 can contact the closets available law enforcement official through portable law enforcement device 118. The location of the law enforcement portable device 118 is monitored in the same fashion as described above for the monitored person. Device 118 periodically sends location and identification information to the monitoring system 108 via towers 114. Processor 122 stores in memory 124 the location of various law enforcement officers, and based on their location, monitoring system 108 contacts the closets law enforcement official via portable device 118. For example, the monitoring system 108 can send to device 118 a voice message and/or text message (page) alerting the officer that a particular monitored person needs to be contacted or apprehended. Once alerted, law enforcement official can take appropriate action. In the embodiment illustrated in FIG. 1, both the law enforcement portable device 118 and portable device 134 are operable to communicate directly with one another without the use of towers 114. In one form, devices 118 and 134 use a walkie-talkie type of communication, such as the NEXTEL DIRECT CONNECT® feature, to communicate with one another. This allows the law enforcement official to quickly contact the monitored person and quickly remedy any problems. For instance, the official can directly contact the monitored person in order to provide them instructions on how to handle any equipment problems. In another example, the law enforcement official can receive a text message that contains the direct connect and/or telephone number for the monitored person so as to eliminate the need for the official to look up the number for the monitored person.

After the alert is sent in stage 408, processor 122 of the monitoring system 108 continues to monitor for messages in stage 402. Once a message is received in stage 404, the monitoring system 108 decrypts the message and records in memory 124 the identifier and location information contained in the message in stage 410. As discussed above, not only does system 108 track the location of monitored individuals, such as parolees, system 108 further tracks the location of law officials via device 118 and at risk individuals, such as persons with restraining orders, via device 120. Further, in stage 410, monitoring system 108 can update any changes to the designated "home" location and/or allowed time limits between messages. Based on the identifier in the message, processor 122 determines in stage 412 whether the message was from a monitored person. If not, processor 122 assumes that the message is from either a law enforcement official or an at risk person. At risk individuals, such as persons with retraining orders or domestic abuse safe houses, can register with the monitoring system 108 in order to prevent specific monitored persons from coming within a specified distance of the at risk individuals. For instance, a person with a restraining can register with system 108 to prevent a stalker from coming within 500 meters of them.

In stage 414, the monitoring system 108 determines if the monitored person is too close to the at risk person or within a "danger zone" with respect to the at risk person. If the at risk individual is not close to a specified or targeted monitored person, system 108 continues to monitored for messages in stage 402. Otherwise, the monitoring system 108 in stage 416 alerts the at risk individual that the monitored person is close via device 120. The monitoring system 108 can send a text, voice and/or other type of message, which provides the name of the monitored individual, their location and direction of travel. As should be understood, the monitoring system 108 can supply other information. By alerting the at risk person of the close proximity of the monitored person, the at risk person can take appropriate actions to avoid the monitored individual. To further improve the location accuracy of the monitored individual, the monitoring system in stage 416 sends a command over provider network 104 to the monitored portable device 134 of the targeted monitored individual so as to remove the "home" operational mode and/or increase the message update rate from device 134. This improves location determination accuracy when the need for accurate location information is the most critical. In addition, the monitoring system 108 in stage 416 can alert officials in a manner similar to the one described above for stage 408. After stage 416, the monitoring system 108 continues to monitor for messages in stage 402.

In stage 412, when processor 122 determines the received message was from a monitored person, processor 122 in stage 418 determines whether the message contained a normal status update. As discussed above, device 134 sends an alert status message when for example the wearable PID 132 has been tampered with or portable device 134 did not receive a transmission from the wearable PID 132 within a specified period of time. If the message does not contain a normal status update in stage 418, the monitoring system 108 alerts the law enforcement officials in stage 408. The alert can contain a message on the particular problem experienced with the portable device 134. When system 102 is operating normally, the monitoring system 108 receives a normal status message, and in stage 420, processor 122 determines whether the monitored person is far enough away from the at risk or restricted person. When the monitored person is too close to a particular at risk person, the monitoring system 108 alerts the at risk person in stage 416. As mentioned above, the monitoring system 108 in stage 416 can further alert officials of the violation. As should be appreciated, not all monitored persons may be prohibited from coming into close proximity of an at risk persons. For instance, a home detainee may not have a restraining order against them.

The monitoring system 108 stores in memory 124 the locations or zone in which the monitored person is allowed to travel. When in stage 420 the monitored person is not restricted from particular at risk individuals or is far from any restricted individuals, the monitoring system 108 determines in stage 422 whether the monitored person is outside the zone in which they are allowed to travel. If the monitored person is outside the zone, the monitoring system 108 alerts the appropriate officials in stage 408. Otherwise, the monitoring system 108 continues to monitor for messages in stage 402.

Figure 5:
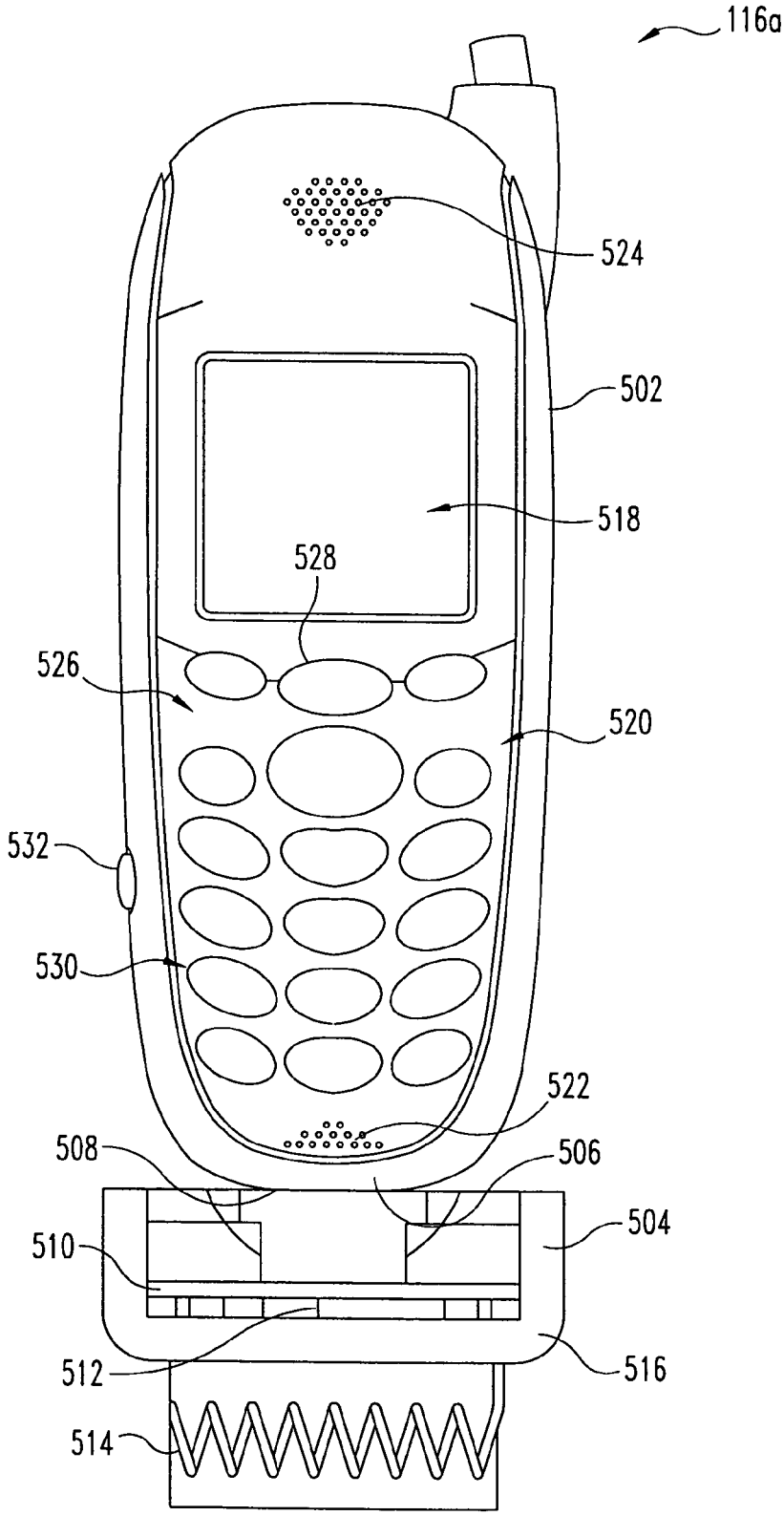
FIG. 5 is a front view of a portable device according to one embodiment.
Figure 6:
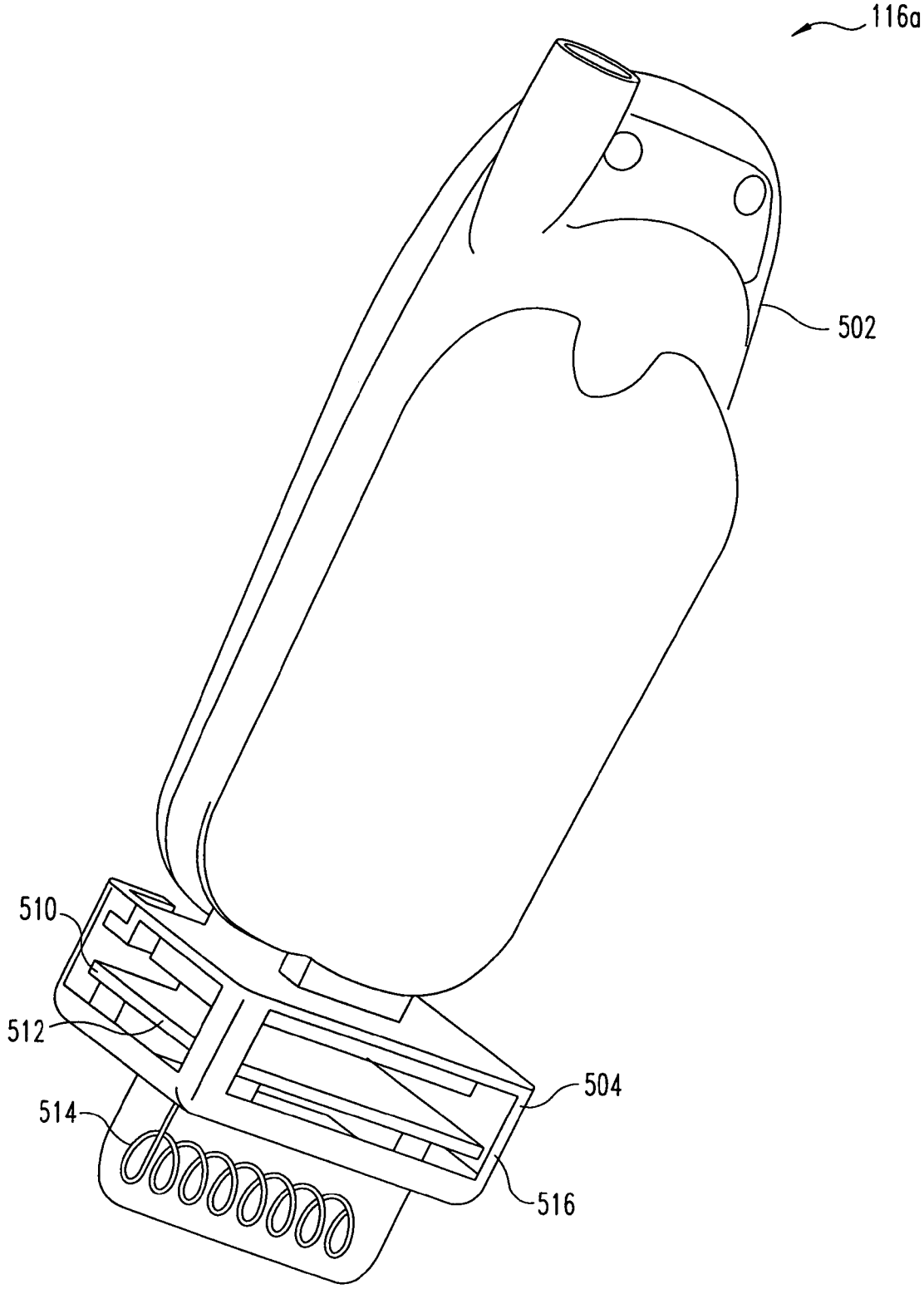
FIG. 6 is a rear, perspective view of the FIG. 5 portable device.
Figure 7:
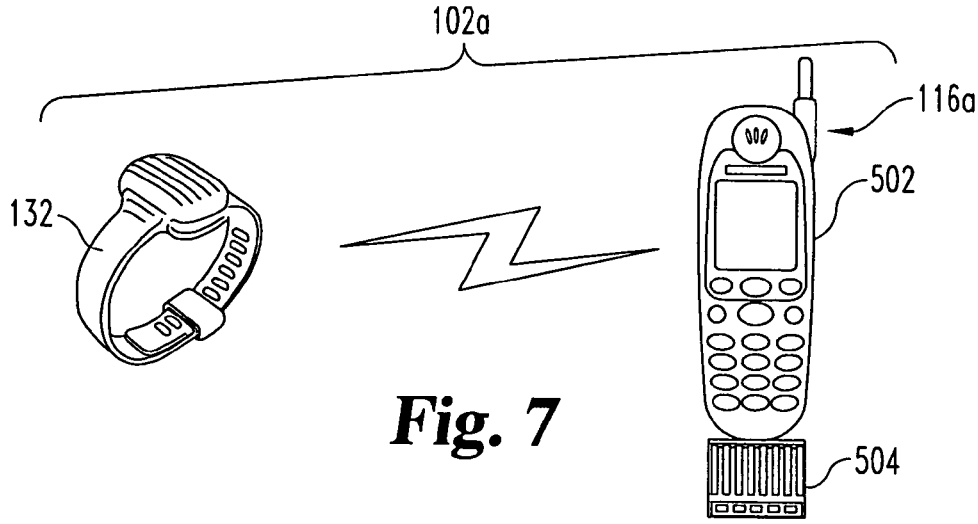
FIG. 7 is a diagrammatic view of a tracking device that incorporates the FIG. 5 portable device.

As discussed above, the portable device 116 of the personal tracking device 102 can include many types of devices, such as cellular telephones and/or PDA's. Referring to FIGS. 5 and 6, portable device 116*a* according to one embodiment includes a cellular or mobile telephone 502. The mobile telephone 502 is operatively coupled to a Radio Frequency Receiver Module (RFRM) 504 that is operable to process communications with the PID 132 to form a personal tracking device 102*a*, as is shown in FIG. 7. In one form, the mobile telephone 502 includes Java 2 Platform Micro Edition (J2ME/MIDP) technology running on a Nextel i58 or i88 brand GPS enabled mobile telephone. Nevertheless, it should be appreciated that mobile telephone 502 can include other types of mobile telephones and can be programmed in other manners. Moreover, other types of devices portable devices can be utilized.

As shown in FIG. 5, the receiver module 504 has a connector 506 that plugs into an accessory/data cable connector 508 in the mobile telephone 502. In one form, the receiver module 504 is only able to receive communications from the PID 132, but it is contemplated that in other embodiments the receiver module 132 can send and receive two-way communications with the PID 132. The connector 506 is operatively coupled to a circuit board 510 with a processor 512. In one form, the motion sensor 223 of FIG. 2 is mounted to the circuit board 510 and operatively coupled to the processor 512 so that the receiver module 504 is able to detect motion of the monitored individual. The processor 512 is operatively coupled to an antenna 514, and the antenna 514 is configured to receive and transmit messages with the PID 132. After processing the message, the processor 512 sends the message to the mobile telephone 502, which has a program that further processes the message. In the illustrated embodiment, the antenna 514 is in the form of a coil 514 so as to minimize the size of the receiver module 504. As depicted, the components of the receiver module 504 are contained in a housing 516. The receiver module 504 in the illustrated embodiment is powered by the mobile telephone 502. Nonetheless, it should be understood that in other embodiments the receiver module 504 can be self-powered, such as with a battery and/or a fuel cell. The processor 512 is configured to process messages, such as status messages received from the PID 132 via the antenna 514. To conserve energy, the mobile telephone 502 in one embodiment is configured to turn on the receiver module 504 only on an as needed basis. For instance, the mobile telephone 502 can energize the receiver module 504 just before a message is suppose to be received from the PID 132 and can place the receiver module 504 in a sleep mode after the message is received. In one embodiment, the receiver module 504 is configured to power down and/or reset the mobile telephone 502 upon receipt of a reset command from the monitoring system 108. With this capability to remotely reset the mobile telephone 502, the monitoring system 108 is able to remotely address software problems on the mobile telephone 502 by reinitializing its software.

One of the many benefits of the personal tracking system 100 according to the present invention is that the system 100 allows monitored individuals to directly communicate with the appropriate officials, such as corrections officers, as well as others. In addition, the system 100 allows monitored individuals to receive messages automatically generated by the monitoring system 108 in a number of formats and acknowledge the message without requiring additional human input. As depicted in FIG. 5, the mobile telephone 502 includes a number of input/output devices, such as a display 518, a keypad 520, a microphone 522 and a speaker. Text messages, pictures, movies and other visual media can be displayed on the display 518. For example, the monitored individual can receive text instructions via the display 518. The monitored individual can respond to messages via the keypad 520. As shown, the keypad 520 includes one or more buttons, such as menu navigation buttons 526, a menu button 528, alphanumeric buttons 530, a walkie-talkie button 532 and the like. Also, the monitored individual can verbally communicate with the corrections officer through the microphone 522 and speaker 524. It is contemplated that the mobile telephone 502 can incorporate other devices, for example a camera. Also, it should be appreciated that the mobile telephone 502, the receiver module 504, and/or the PID 132 can be integrated together to form a single unit.

Figure 8:
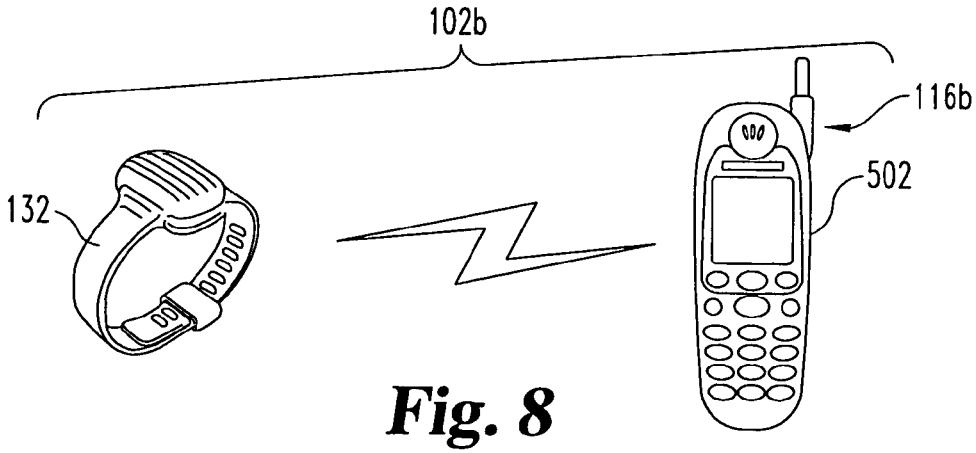
FIG. 8 is a diagrammatic view of a tracking device according to another embodiment.

FIG. 8 illustrates a portable device 116*b* according to another embodiment of the present invention. Portable device 116*b* includes mobile telephone 502 that is configured to communicate directly with the PID 132 to from a personal tracking device 102*b*. In one form, the mobile telephone 802 communicates with PID 132 via the Bluetooth communication protocol. It should be appreciated, however, that the mobile telephone 502 can communicate in other manners, such as via a radio frequency (RF) for commercial PID protocol, RFID, 802.11, Aura magnetic communications, and/or ZigBee protocol, to name a few.

Figure 9:
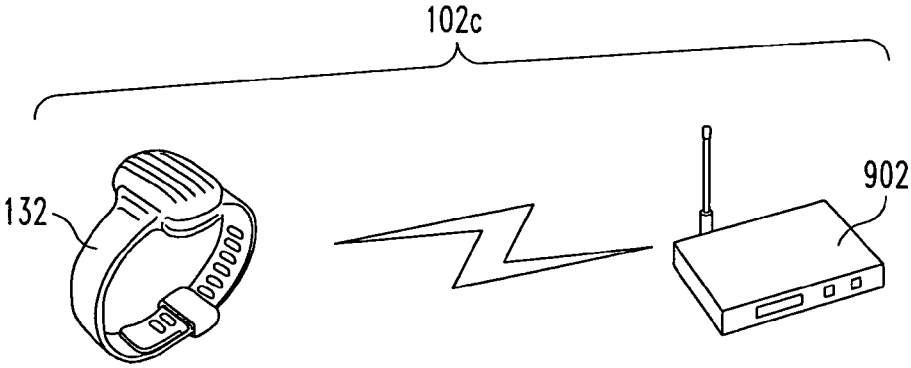
FIG. 9 is a diagrammatic view of a tracking device according to a further embodiment.

FIG. 9 illustrates a personal tracking system 102*c* that includes a base unit or station 902 that wirelessly communicates with PID 132. As will be described in greater detail below, in one embodiment, the PID 132 is operable to automatically switch communications from the mobile telephone 502 to the base unit 902 and back. Communications can be diverted to the base unit 902 in environments where cellular communication is not allowed or unavailable. The PID 132 can be configured to dynamically communicate with the base unit 902 in the event the mobile telephone 502 cannot be located. For example, when the mobile telephone 502 is out of range of cell phone towers 114, the PID 132 is operable to send communications to the monitoring system 108 through the base unit 902, which can have a wired connection to the network 102. As should be appreciated, the base unit 902 can communicate with the network 106 in a number of manners. By way of non-limiting examples, the base unit 902 can communicate using a dialup connection, Bluetooth, ZigBee, Aura magnetic communications (Aura Communications) and/or broadband connectivity, to name a few. It also should be noted that the use of the PID 132 is optional in some situations such that the mobile telephone 502 is used solely to track and communicate with a person. For example, police officers with law enforcement devices 118 and at risk individuals with device 120 do not need PID's 132. Nonetheless, it may be desirable that these individuals maintain constant contact with the monitoring system 108 in case an event that requires their attention arises. For example, a person with a restraining order may live or work in a location where cellular telephone communication is poor or even non-existent. To remedy this problem, one or more base units 902 can be installed so as to maintain communications between the at risk individual device 120 and the monitoring system 108. In another example, one or more base units 902 can be installed in a halfway house type environment so as to allow the batteries on the mobile telephones 502 of parolees to recharge as well as reduce the communication load on the cellular telephone network. It should recognized that multiple PID's 132 and/or mobile telephones 502 can communicate with a single base unit 502 at the same time.

Figure 10:
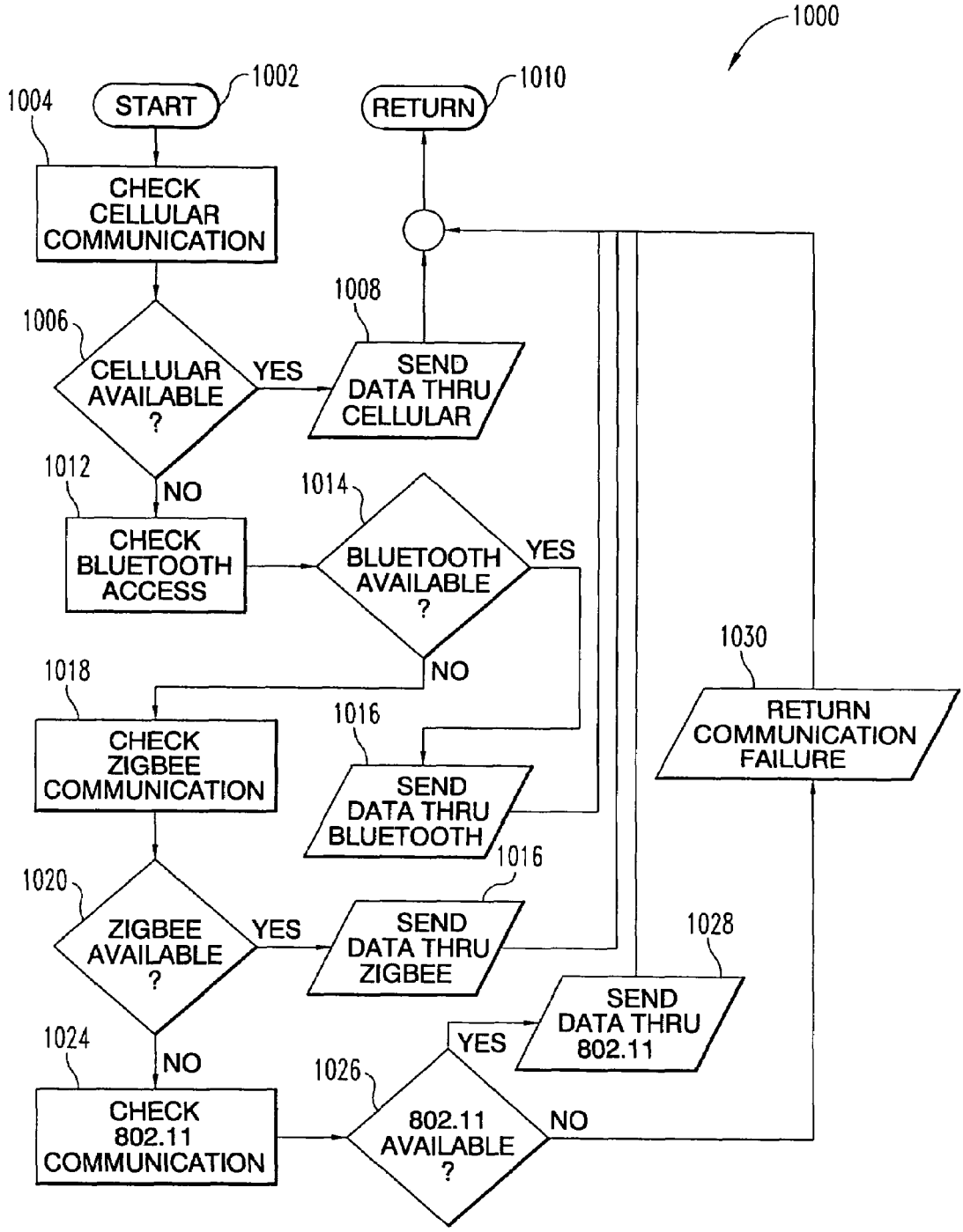
FIG. 10 is a flow diagram illustrating a technique for changing communication channels according to one embodiment.

In certain situations, the mobile telephone 502 may be out of range and/or located near a base unit 902 such that communications can be switched between the cell towers 114 to the base unit 902 and/or some other means for communicating with the network 106, such as a wireless router. In other circumstances, it may be desirable to have the PID 132 switch communications from the mobile telephone 502 to the base unit 902 so as to permit the recharging or servicing of the mobile telephone 502. A technique for automatically switching communication channels according to one embodiment of the present invention will now be described with reference to flowchart 1000 in FIG. 10. As will be appreciated from the description below, this technique illustrated in FIG. 10 can be used by the PID 132 and/or the mobile telephone 502 in order to switch communication channels. For example, with this technique, the PID 132 can switch communications from the mobile telephone 502 to the base unit 902 when the mobile telephone 502 is being recharged or repaired. In another example, the mobile telephone 502 can switch communication channels from the cell towers 114 to the base station 902 when the monitored person is for example at home or at a location that is out of range from the cell towers 114.

For the sake of clarity, the technique illustrated in flowchart 1000 will be primarily described with reference to the PID 132, but it is contemplated that the mobile telephone 502 can also use this technique. After initiating the routine in stage 1002, the PID 132 checks to see if cellular communication is available in stage 1004. In one form, the PID 132 in stage 1004 checks to see if the PID 132 receives an acknowledgement or status message from the mobile telephone 502 is received. The status message can be sent periodically from the mobile telephone 502 and/or in reply to a previous message from the PID 132. So for instance, if the PID 132 does not receive a status message from the mobile telephone 502, the PID 132 considers cellular communication unavailable. The mobile telephone 502 in the status message further supplies the signal strength for cellular communications, and below a specific signal strength threshold, the PID 132 considers cellular communication unavailable. When checking to see if cellular communication is available in stage 1004, the PID 132 in one embodiment also determines its location relative to a known location of the base station 902. If the PID 132 is in close proximity to the base station 902, the mobile telephone 502 considers the area a cellular telephone communication drop-out area in which communication should be switched to the base station 902. For instance, when the signal strength from the base station 902 is as strong as that of the cellular signal strength reported in the status message from the mobile telephone 502, the PID 132 considers that cellular communication is not available. In stage 1006, if the cellular communication is available, the PID 132 sends the data through the wireless provider telephone system 104 in stage 1008, via the mobile telephone 502. At stage 1010, the mobile telephone 502 continues using the technique.

When cellular communication is unavailable and/or is undesirable in stage 1006, the cellular telephone 502 checks to see if Bluetooth communication is available with another device, such as base station 902, in stage 1012. It should be appreciated, however, that the PID 132 can establish wireless communication to other types of devices besides the base station 902. If Bluetooth communication is available in stage 1014, the PID 132 sends the data via the Bluetooth standard in stage 1016. When Bluetooth is not available in stage 1014, the PID 132 checks to see if ZigBee communication is available in stage 1018. The PID 132 sends data through the ZigBee communication protocol to the desired device, such as base station 902, when ZigBee communication is available in stage 1020. In stage 1022, when ZigBee communication is available, the PID 132 communicates with the base station 902 via ZigBee. Otherwise, in stage 1024, the PID 132 checks whether or not 802.11 communication is available. When in stage 1026, 802.11 communication is available, the PID 132 sends the data through the 802.11 connection in stage 1028. Otherwise, in stage 1030, the thread or subroutine running the technique returns a communication failure report to the PID 132 in stage 1030. As should be appreciated, the above-described technique can incorporate other types of devices for communicating, such as wireless routers, infrared ports or computer cables. Moreover, it should be understood that in other embodiments, the communications can be detected in a different order. For example, ZigBee communications can be checked before checking the availability of Bluetooth communications. As should be appreciated, with the above-described technique, the risk of communication failure is reduced.

Figure 11:
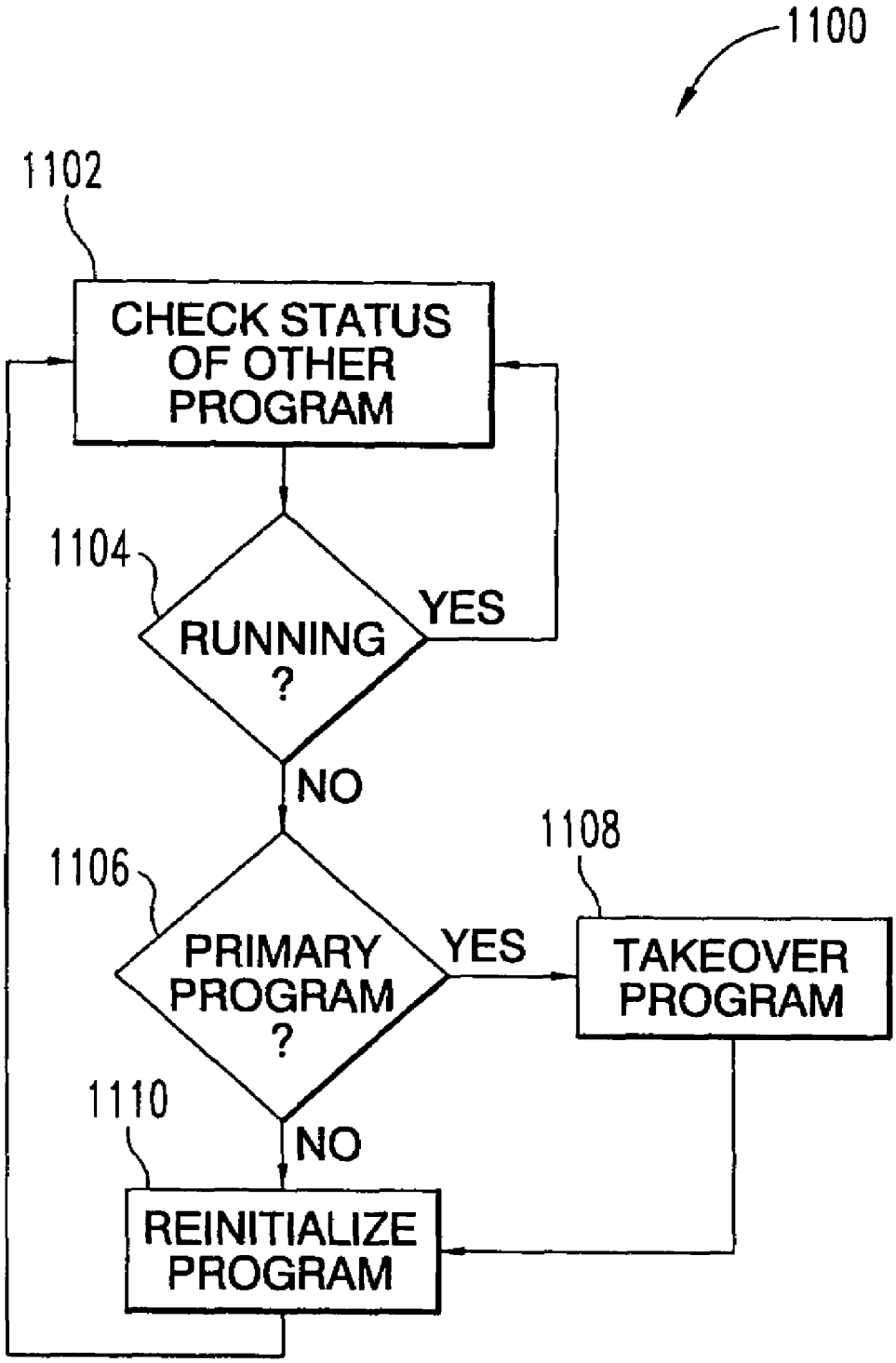
FIG. 11 is a flow diagram illustrating a technique for checking the operational status of software on the tracking device.

Due to the critical nature of tracking monitored persons, such as criminals, it is desirable that the personal tracking device 102 has a low failure rate. To increase the operational up time of the tracking device 102, a technique for operating the personal tracking device 102 according to one embodiment will be described with reference to flowchart 1100 in FIG. 11. During operation, two programs or threads run at the same time on the processor 218 of the mobile device 116, a primary program and a backup program. If the primary program fails, then the backup takes over so as to become the primary program, and the now primary program restarts the previously failed primary program. It is contemplated that in other embodiments a similar technique can be used in the processor 206 of the PID 132. In stage 1102, both programs check the status of the other via a heartbeat. If the other program is running, the program continues checking the status of the other program in stage 1102. Otherwise, if the failed program in stage 1106 was the primary program, the backup program takes over operation of the tracking device 102 and acts as the primary program before reinitializing the failed program in stage 1110. When the backup program fails, the primary program restarts the backup program in stage 1110. With the above-described technique, downtime of the tracking device 102 is reduced; while at the same time, the risk that a monitored individual will successfully circumvent the security features of the tracking device 102 is also reduced.

Figure 12:
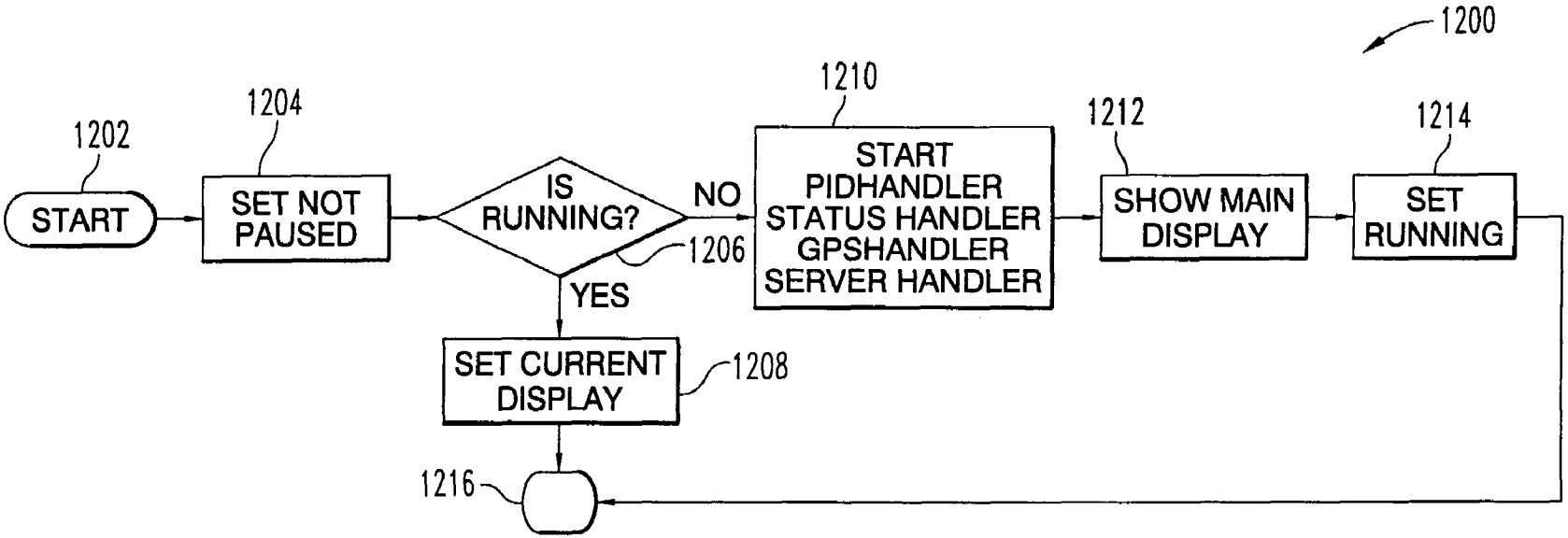
FIG. 12 is a flow diagram illustrating a technique for initializing threads on the tracking device.
Figure 13:
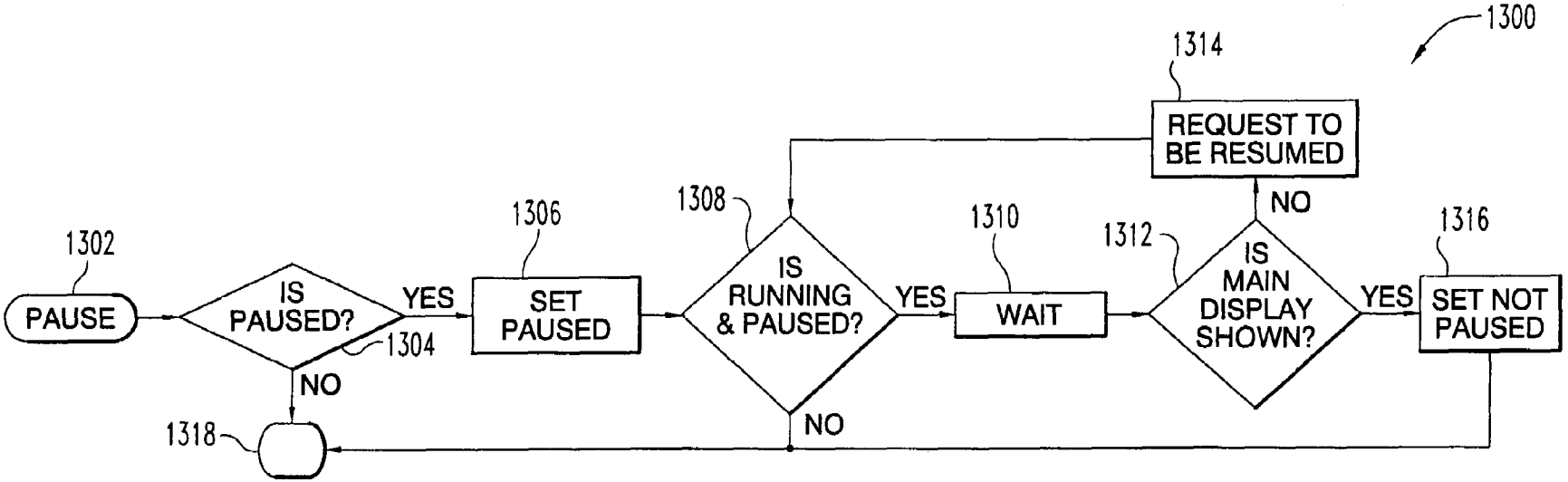
FIG. 13 is a flow diagram illustrating a technique for pausing threads on the tracking device.

A technique for operating the personal tracking device 102 will initially be described with reference to FIGS. 12 and 13. As noted above, the personal tracking device 102 can be controlled via software, hardware, a combination thereof and/or in other generally known manners. The illustrated technique will be described with reference to software, but it should be appreciated that the technique can be accomplished in other manners. In one embodiment, among many, the personal tracking device 102 has one or more J2ME based applications or threads running on its processor 218. The below discussed techniques will be described with reference to a mobile telephone 502, which is J2ME capable, that is used in conjunction with a PID 132. Nevertheless, it should be appreciated that other types of tracking devices 102 can utilize these techniques. The J2ME based applications are initialized and started or paused by the operating system on the personal tracking device 102. FIG. 12 includes a flow chart 1200 that illustrates a technique for initializing a main or PID tracker application that is responsible for starting a number of threads on the processor 218 of the tracking device 102. As noted above, so as to minimize failure rates, the tracking device 102 can include two or more PID tracker applications, a primary and a backup, that track the operational status of the other PID tracker programs in order to back up the primary application, if it should fail. For the sake of clarity, the techniques for operating the personal tracking device 102 will be described with reference to a single PID tracker application, but it should be understood from the discussion above that more than one PID tracker application can run on the personal tracking device 102.

Flowchart 1200 in FIG. 12 illustrates a technique for initializing the PID tracker application on the portable tracking device 102. Although the techniques described in the following drawings are described with reference to a J2ME telephone, such as a Motorola brand GPS enabled cellular telephone, it should be appreciated that these techniques can be adapted for other types of devices, including portable devices 116. A start-up application is initiated to start the PID tracker application, for example, by selecting the "Java Apps" menu item on a Motorola i-58 or i-88 brand telephone. It nonetheless should be appreciated that the application can be initiated in other manners such as by being automatically started when the tracking device 102 configured or when simply turned on. After the application is initiated, in stage 1202, the start-up application in stage 1204 sets the status of the PID tracker application in memory 220 to "not paused." The operating system on J2ME type telephones is able to pause the operation of specific applications or threads in the processor 218 so as to not interfere with the operation of the telephone. For example, when a call or text message is received, the operating system on the mobile telephone 502 pauses selected applications so as to allow the receipt of the telephone call or the text message. By setting the application to "not paused" in stage 1204 ensures that the application is in a running status. In that regard, in stage 1206, the start-up application determines if the PID tracker application is running on the processor 218. If the PID tracker application is running in stage 1208, the display 518 on the mobile telephone 502 displays a current display screen, which is whatever was previously shown on the display 518.

When the PID tracker application is not running in stage 1206, the PID tracker application via the start-up program initializes and then executes a number of threads on the processor 218 of the portable device 116. Generally, the PID tracker application is designed to run without user interaction and does not allow any other functions on the mobile telephone 502 with the exception of receiving incoming communications, such as a direct connect message, a text message or telephone call, to name a few. With reference to FIG. 12, the PID tracker application in stage 1210 starts a number of threads on the processor 218, including a PID handler thread, a status handler thread, a location or GPS handler thread, and a server handler thread. Normally, the PID handler thread is responsible for handling communications with the PID 132. For instance, with the personal tracking device 102*a* illustrated in the FIG. 7 embodiment, the PID handler thread is responsible for all communications between the mobile telephone 502 and the receiver module 504 that is attached the mobile telephone 502. The receiver module 504 transfers an encrypted message from the PID 132 to the memory 220 of the mobile telephone 502, which decrypts the message and updates PID status information with status handler thread. Typically, the status handler thread receives GPS and PID status information and creates a status message, which is stored in memory 220. This status message is usually sent to the monitoring system 108 via the server handler thread at every report interval (RI). Each zone can have its own specified reporting interval, and as a result, the reporting interval of status messages can vary depending on the location of the monitored individual. However, if a violation occurs, the violation may be reported sooner than the designated report interval. By and large, the GPS thread is responsible for handling the location tracking information. On receipt of GPS and/or other location information from the GPS receiver 224, the status handler compares the GPS coordinates to each zone that is configured on the personal tracking device 102, and if a zone breach is detected, a notification is issued. Although the GPS thread will be described with reference to a GPS system, it should be appreciated that other location determination systems and techniques can be used. In one embodiment, such as with the mobile telephone 502 of FIG. 7, the GPS thread is responsible for handling all interactions with a GPS chip set 224 on the mobile telephone 502, if so equipped. In one particular form of this embodiment, the GPS thread uses Nextel's Position Applications Program Interface (API) designed for use with J2ME. Nevertheless, the GPS thread can be configured for use with the other types of systems. Upon a successful GPS fix, the GPS thread will gather location parameters and pass them to the status handler thread, which in turn generates a status message that is sent by the server handler thread to the monitoring system 108. The server handler thread responsibilities generally include all interactions with the monitoring system 108, such as sending and receiving messages from the wireless network 104. After the PID tracker application initializes and executes the threads in stage 1210, a main display is shown on the display 518 of the mobile telephone 502 in stage 1212, and the PID tracker application is set to run in stage 1214. In stage 1216, the PID tracker application continues to operate.

To allow direct communication between the monitored individual and the corrections officer (or other official), the tracking device 102 runs one or more routines that manage the communications so that these communications do not interfere status and location messages sent to the monitoring system 108. As mentioned above, when a walkie-talkie call, a telephone call, a text message or some other type of communication is processed, the operating system in the mobile telephone 502 calls the pause routine of the PID tracker application. The pause routine pauses the processing of selected threads on the processor 218; while at the same time allows the processing of other threads to continue. In one embodiment, the pause routine temporarily halts all threads that might effect communication. For instance, the pause routine in one particular embodiment pauses operation of the server handler thread during communications; while at the same time permits continued operation of the PID handler, GPS handler and status handler threads on the processor 218 of the portable device 116. In another embodiment, the entire PID tracker application is paused during communications. It should be appreciated that other combinations of threads can be paused, during communications or during other activities on the tracking device 102.

When the pause routine is called, the PID tracker application will start a background thread that is set to ask the operating system to resume the paused thread to the foreground periodically. This allows the PID tracker application to become the foreground application when the communication has ended. A technique for pausing and resuming threads on the tracking device 102 is illustrated in flowchart 1300 in FIG. 13. Once the pause routine is requested in stage 1302, the routine checks to see if the pause command was received in stage 1304. If so, the routine is then set to paused in stage 1306. If the telephone call or other type of communication is being handled with the mobile telephone 502 in stage 1308 and the application is paused, the pause routine waits a period of time in stage 1310 before determining if the main display is shown in the display 518 in stage 1312. If the main display is not shown in stage 1312, the pause routine places a request with the operating system in stage 1314 to ask for the application to be resumed, and thereafter continues to check to see if the communication has ended in stage 1308. In stage 1314, the pause routine makes a resume request call to the J2ME operating system so as to request that the PID tracker application be placed into the foreground. If the resume request call is honored, the main or PID tracker application will be placed at the top of the Z order. However, if the resume request call is not honored, such as when a telephone call has not ended, the operating system ignores the request. When the main display is shown in stage 1312, the PID tracker application or thread is set to "not paused" in stage 1316, and the processor 218 runs the now active thread in stage 1318. Likewise, if the application is running and not paused in stage 1308 or stage 1304, the pause routine is exited in stage 1318. By being able to pause one or more threads, the PID tracker application allows tracking device 102 to track the monitored individual and communications with the monitored individual at the same time. This gives corrections officers as well as other officials the ability to monitor and instantaneously communicate with monitored individuals, which can facilitate quicker resolution of actual or potential problems.

As discussed above, the PID tracker application is designed to function on the tracking device 102 without user interaction so that the monitored individual is not able to circumvent or exit the PID tracker application. Occasionally, a service technician might need to access certain features or information concerning the tracking device 102 or may even to exit the PID tracker application entirely. The PID tracker application in one embodiment can be configured to use secret key combinations on the keypad 520 to allow the view of specific menu options. When the specific key combination is entered on the keypad 520, the PID tracker application can display the information on the display 518 and/or perform the actions listed below in Table 1. In addition to the secret key combinations, the PID tracker application in another embodiment requires a password before the below menu options can be accessed.

TABLE 1

| | MENU OPTION | KEY |
|---|---|---|
| 1. | Diagnostics information. | *1. |
| 2. | Current Configuration information. | *2. |
| 3. | Force RFRM to Power down or Power up. | *3. |
| 4. | Enable Application Logging. | *4. |
| 5. | Display Log information. | *5. |
| 6. | Force a status message to be issued to the Host Server. | *6. |
| 7. | Exit Application. | *7 |

As should be appreciated, these secret keys can be eliminated or limited in number so as to reduce the risk of the monitored individual gaining access to the PID tracker application. It is contemplated that in still yet another embodiment the tracking device 102 is configured to alert a corrections officer if keys on the keypad 520 are being pressed in a manner so as to indicated that the monitored individual is attempting to gain access to the PID tracker application.

Figure 14:
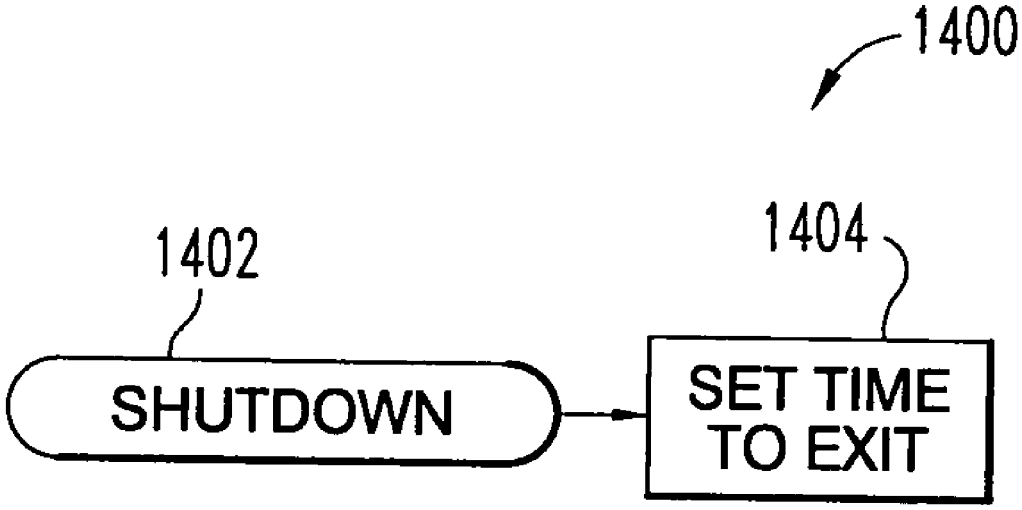
FIG. 14 is a flow diagram illustrating a technique for shutting down threads on the tracking device.

As noted above, a technician can shutdown or exit the PID tracker application by pressing a specific key combination of the keypad 520. When the application has exited, a shutdown procedure is entered that terminates all running threads by calling their shutdown routines. These routines toggle a Boolean exit variable in memory 220 of the portable device 116 to "TRUE". Each thread is cycling continuously, but will terminate the cycle when its exit variable is set to true. For example, flowchart 1400 in FIG. 14 illustrates such a technique that can be used to shut down the individual threads. When the shutdown subroutine for an individual thread is initiated in stage 1402, the time to exit thread is set to "TRUE" in stage 1404.

Figure 15:
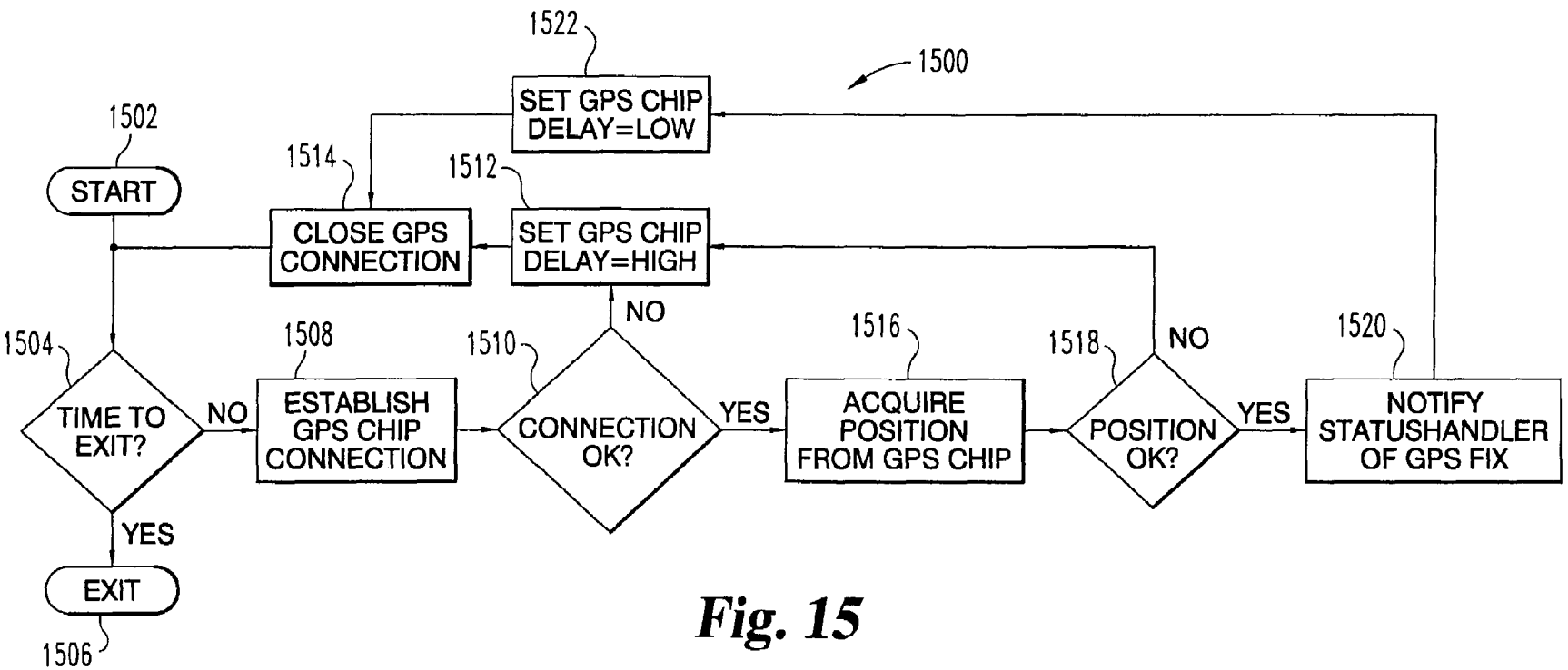
FIG. 15 is a flow diagram illustrating a technique for acquiring location coordinates of the tracking device.

A technique that the GPS handler thread uses to detect the position of one or more monitored individuals will now be described with reference to flowchart 1500 in FIG. 15. As should be appreciated, selected stages of the technique illustrated in FIG. 15 can be modified in other embodiments. After the GPS handler thread is initialized on the processor 218 of the portable device 116 in stage 1502, the processor 218 determines whether or not the GPS handler thread should shut down in stages 1504. As mentioned above with reference to flowchart 1400 in FIG. 14, the time to exit variable in memory 220 of the portable device 116 is set to true in order to shutdown the active threads. If in stage 1504 the exit thread is true, then the GPS handler thread shuts down or exits in stage 1506. Generally, the GPS handler thread is responsible for handling all interactions with a GPS chip set or receiver 224 on the tracking device 102. For example, the GPS handler is responsible for interacting with the GPS chip set 224 on a GPS enabled telephone 502. In one form, the GPS thread uses Nextel's position API designed for use with J2ME. Upon a successful GPS fix, the GPS handler thread gathers location parameters and passes them to the status handler thread.

If it is time to exit variable is false in stage 1504, the processor 218 via the GPS handler thread establishes connection with the GPS chip 224 in stage 1508. The personal tracking device 102, according to one embodiment of the present invention, is designed to conserve battery power as much as possible, thereby allowing participants to be mobile for up to a day or more before requiring recharging of the tracking device 102. The GPS handler thread is configured conserve energy used by the GPS chip 224. According to the illustrated embodiment, the GPS chip 224 on the tracking device 102 includes a delay feature in which the GPS chip 224 can use extra attempts to acquire a location fix. If the portable device is having trouble in acquiring a location fix, the delay is set to high so as to allow the GPS chip 224 greater time to acquire the current location of the tracking device 102. When a high delay is set, more requests are made over a longer period of time in order to acquire the current location. Since the GPS chip 224 is active for a longer period of time, this high delay results in greater power consumption in the tracking device 102. To conserve power, the delay for the GPS chip 224 is set to low when the tracking device 102 does not experience difficulty in acquiring its location. When a low delay is used, the fix must be acquired over a shorter period of time, resulting in the GPS chip 224 being powered for a shorter time period.

In stage 1510, the processor 218 via the GPS handler thread determines if the connection established with the GPS chip 224 in stage 1508 is acceptable. In the embodiment that uses Nextel's GPS API, a GPS fix is determine to be a valid response from the GPS chip 224 when the GPS API returns a "POSITION_RESPONSE_OK" value. As should be appreciated, the status of the connection can be determined differently in other embodiments. If the position response is not acceptable (i.e., not "OK"), the GPS handler sets the delay for the GPS chip 224 to "high" in stage 1512. As mentioned above, this high delay allows the GPS chip 224 greater time in order to determine a location fix. After the delay is set to high in stage 1512, the connection to the GPS chip 224 is closed in stage 1514, and GPS handler thread proceeds to stage 1504. When the connection to the GPS chip 224 is acceptable in stage 1510, the GPS handler thread acquires the position information (i.e., latitude and longitude) from the GPS chip 224 in stage 1516. In stage 1518, the GPS handler thread determines whether the returned position values are valid. For example, in one embodiment, a returned position value of "null" would be considered invalid. When an unsatisfactory position value is returned in stage 1518, the GPS handler thread sets the chip delay to high in stage 1512 and then proceeds to stage 1514 where the connection to the GPS chip is closed. Otherwise, the GPS handler thread notifies the status handler thread of a GPS position fix and stores the position, such as the latitude and longitude, in memory 220 in stage 1520. Since the GPS handler thread was able to acquire a valid position in stage 1520, the GPS handler thread sets the GPS delay to low in stage 1522 in order to conserve power. After lowering the GPS delay in stage 1522, the GPS handler thread in stage 1514 closes the connection to the GPS chip 224, and the technique continues until shutdown (stage 1504). By adjusting the GPS delay, the technique illustrated with flow chart 1500 in FIG. 15 extends the time between recharging and/or refueling of the tracking device 102.

In addition to monitoring the location of the monitored individual, the tracking device 102 monitors the status of the PID 132. The PID 132 is monitored in order to detect a number of conditions, such as PID tampering or low battery conditions. As mentioned before, the PID handler thread monitors and controls communications with the PID 132. In one form, the PID handler thread is responsible for all communications between the mobile telephone 502 (J2ME application), and the receiver module 504 that communicates with the PID 132. It should also be appreciated that the PID handler thread can be configured to directly communicate with the PID 132, and not via the receiver module 504, in other embodiments. For instance, the PID handler thread in other embodiments is responsible for directly communicating with the PID 132, such as illustrated in FIG. 8 (FIG. 8). Nevertheless, it is contemplated that PID handler thread can be used in other types of configurations of the tracking device 102.

Referring to the embodiment illustrated in FIG. 7, the receiver module 504 transfers encrypted messages from the PID 132 to the portable device 116*a*. Generally, the portable device 116*a*, such as mobile telephone 502, decrypts the information and updates the information with the status handler thread. According to one embodiment, interaction between the PID handler thread and the receiver module 504 is performed by opening a serial connection with the connector 506 of the mobile telephone 502. In one form, the mobile telephone 502 communicates with the receiver module 504 via an RS-232 connection. However, as noted above, the receiver module 504 can be connected to the portable devices 116 in other manners generally known to those skilled in the art, such as via a USB or a parallel connection, to name a few. Once a connection is established between the PID handler and the receiver module 504, the PID handler looks for incoming information from the PID 132. In one form, messages between the PID handler and the receiver module are communicated via ASCII messages. In particular, each messages is framed with a leading, start of text (STX) ASCII character, and trailing end of text (ETX) ASCII character. Each message type is denoted by a specific character. Table 2 below provides examples of some types of messages that are communicated in one embodiment.

TABLE 2

| Character | Command | Description |
|---|---|---|
| A | Acknowledge | Acknowledges a communication. Typically, an acknowledgment from the receiver module, usually returned after waking up the receiver module. |
| B | Buffer Data | Sent from receiver module. A valid PID encrypts the message, must be decrypted and status issued. The message includes a PID identification number. STX-data bytes (PID ID, data)-ETX |
| C | Charge State | Indicates the charge state of the battery in the PID. Sent from the PID handler. Receiver module responds with STX-C-data byte-ETX, where data byte is 0–64 for RFRM supply voltage = 0 to 6.4 volts. Charge state message can be sent from receiver module to PID handler whenever battery voltage changes by 0.1 volts consistently. |
| D | Show Data | Sent by the PID handler. Shows data on laptop monitoring pin. |
| E | Error Message | Sent by PID handler. Requests error messages and codes be sent as they occur from now on (default = off). The receiver module sends the error message when received from the PID. Typically, the second byte is the error code. This code is passed back to the monitoring system. |
| F | Signal Strength | PID handler requests signal strength of PID's transmissions or the PID requests the signal strength for communications with the monitoring system (cell phone signal strength). |
| G | Input | Send receiver module's input current measurement. |
| H | Firmware ID | Request for receiver module's firmware ID. |
| I | Hardware ID | Request for receiver module's hardware ID. |

As noted in the example illustrated above in Table 2, when an "A" character is received, it is an acknowledgement from the receiver module 502, which is typically returned after the receiver module 504 is awakened. The designation "B" at the beginning of the message indicating that the PID unit 132 sent a valid encrypted message that must be decrypted. The "E" designation indicates that an error has occurred. The error message is typically followed by a second byte, which is the error code. The error code indicates a specific problem in the PID 132. In one embodiment, the error code is denoted by a number. Different types of error codes can be sent based on the number sent. For instance, an error code of 3 indicates that the battery in the ankle bracelet is low, or a value of 8 indicates that the strap has been cut or removed.

An error code value of zero indicates no error has occurred. As should be appreciated, other numbering schemes can be used to indicate errors in the PID 132 and/or the receiver module 504. As should be appreciated, by using individual numbers to designate specific errors in the PID 132, the amount of data transmitted from the PID 132 to the monitoring device is reduced. Thus, the PID handler thread is able to understand, decrypt, see and send a single variable describing the full condition of the PID 132. Reducing the amount of data transmitted and processed, improves the overall energy efficiency of the tracking device 102, which in turn increases the time between recharges and/or refueling of the PID 132 and the portable device 102.

Once the PID handler in the portable device 116 receives the start and end of text characters, which indicate that a message has been issued, the message is decoded and then decrypted. To conserve power of the portable device 116, the receiver module 504 is periodically energized and de-energized. The energization of the receiver module 504 coincides with the expected reception time of messages from the PID 132. In one form, the PID 132 sends status messages in a periodic manner, and in another form, the PID 132 sends messages in a pseudo-random fashion. It is contemplated that the PID 132 can send messages in other manners. In one embodiment, to wake up (power on) the receiver module 504, a serial connection is opened by the PID handler on the connector 506 of the mobile telephone 502.

A technique the PID handler thread uses in processing communications with the PID 132 will now be described with reference to flowchart 1600 in FIG. 16. After the PID handler thread is initialized in stage 1602, the PID handler waits until the next wake-up time for the receiver module 504 in stage 1604. As noted above, the receiver module 504 is placed in a sleep state in order to conserve energy in the tracking device 102. Likewise, the PID 132 is periodically or in a pseudo-random fashion energized and de-energized in order to conserve energy. The PID handler wakes up or energizes the receiver module 504 when needed, for example, just before the next message from the PID 132 is expected to be received. It is contemplated that in other embodiments, the receiver module 504 can include an internal timer in which the receiver module 504 wakes itself up. In that embodiment, the PID handler keeps an internal timer and schedules communications at the time the receiver module 504 is expected to be awake. In stage 1606, the PID handler thread determines whether or not the thread is being shut down, as was described above with reference to FIG. 14. If the shut down variable in memory 220 is true, the PID handler thread shuts down in stage 1610. Otherwise, the PID handler thread in stage 1610 determines if a connection has been established with the receiver module 504. When a connection has not been established, the PID handler thread establishes a connection with the receiver module 502 in stage 1612. As mentioned above, the mobile telephone 502 via the PID handler thread in one embodiment establishes a serial connection with the receiver module 504, but it should be appreciated that a connection can be established in other manners. If the PID handler is unable to establish a connection with the receiver module 504 in stage 1612, the PID handler notes the exception in memory 220 and closes the connection in stage 1614. The exception noted in memory 220 is later used by the status handler thread in order to generate error message. Upon closing the connection with the receiver module 504, the PID handler waits until the next receiver module wake-up time before proceeding in stage 1604.

Once the connection is established (stage 1612) or was previously established (stage 1610), the PID handler pauses or waits for the receipt of data from the receiver module 504 in stage 1616. When data is received, the processor 218 of the portable device 116 via the PID handler reads the incoming data from the receiver module 504. In one embodiment, the PID handler thread attempts to read the serial data one byte at a time, initially looking for the start of text byte. Once the start of text (STX) byte is received, all bytes received thereafter until receipt of the end of text (ETX) byte is stored in a byte array in memory 220 for processing. While the data is read, if an exception occurs, the exception is noted in memory 220 and the connection is closed in stage 1614. For example, an exception can occur if the message does not include an end of text byte. After a complete message from the receiver module 504 is received in stage 1618, the processor 218 of the portable device 116 decodes the message in stage 1620. As discussed above with reference to Table 2, the receiver module 504 can send a number of messages to the mobile telephone 504. In stage 1620, the PID handler decodes the type of message by the command character in the message. For instance, if the message after the start of text byte contains the "A" character, the PID handler determines the message to be an acknowledgement message and proceeds accordingly.

After decoding the message in stage 1620, the PID handler determines the source of the message in stage 1622 and processes the message accordingly. If the message concerns the receiver module 504, such as a firmware ID message (H) or a hardware ID message (I), the PID handler in stage 1624 processes the receiver module message in stage 1624. After processing the message in stage 1624, the PID handler sets up the next wake-up time for the receiver module 504 in stage 1626 so that the receiver module 504 is awake when the next message is expected to be received from the PID 132. As noted above, the PID 132 can transmit its messages in a periodic and/or pseudo-random basis. The PID handler sets the wake-up time of the receiver module 504 to be at or before the next wake-up time for the PID so that the receiver module 504 is able to receive data from the PID 132, while at the same time minimizing the amount of energy consumed. In stage 1622, if the message is from the PID 132, such as a buffer data message (B) in Table 2, the PID handler in stage 1628 decrypts the message from the PID 132. For example, the message from the PID 132 can include a unique PID identification number as well as status information that alerts the PID handler thread to any problems with the PID 132. The PID handler in stage 1630 notifies the status handler of the information, such as the error code, and subsequently, sets the next wake-up time for the receiver module 504 in stage 1626. After stage 1626, the PID handler closes the connection with the receiver module 504 in stage 1614. The PID handler thread continues the routine until the thread is shut down in stage 1606.

Figure 17:
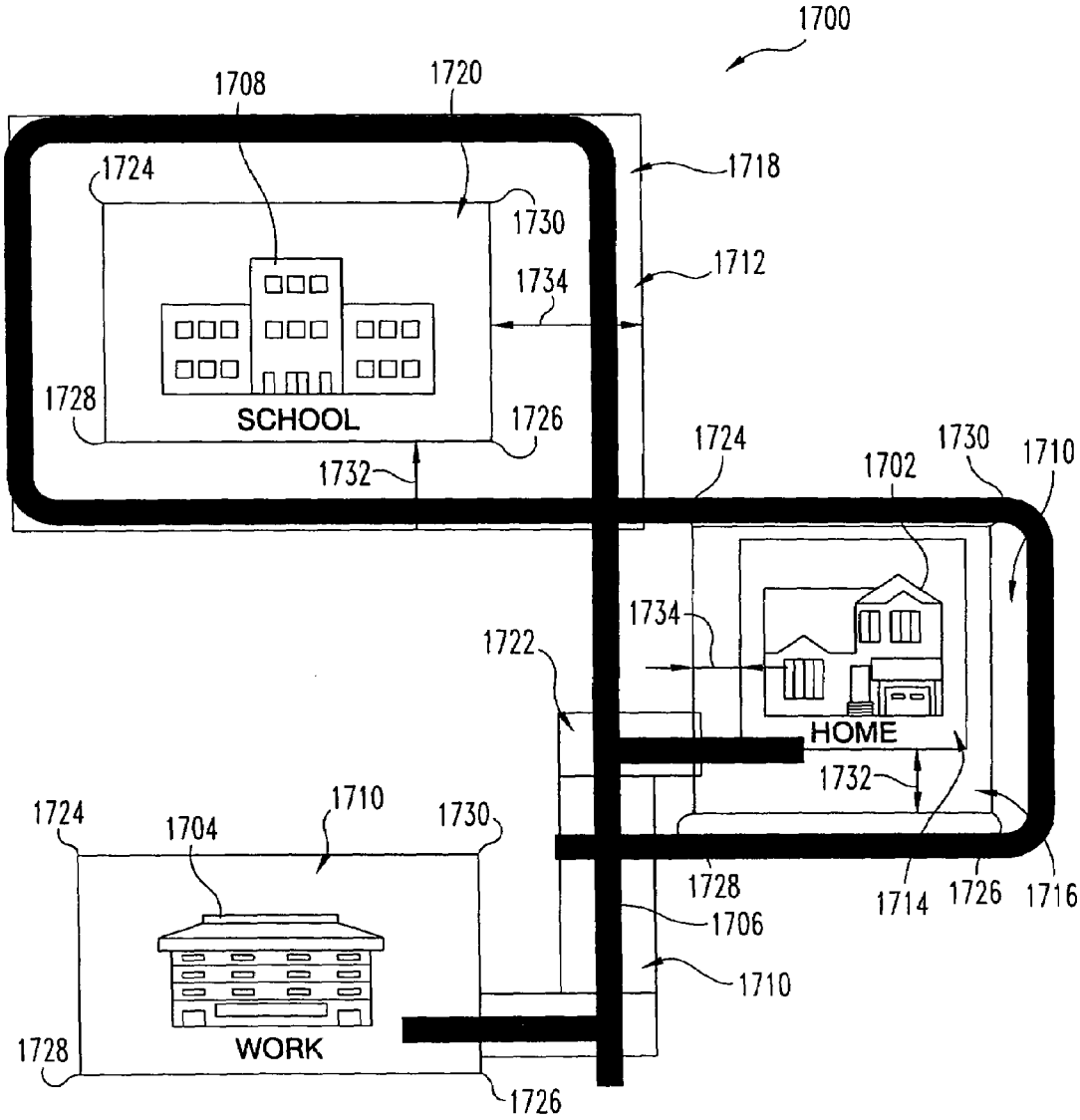
FIG. 17 is a diagrammatic view of an example of exterior and interior regions defined for the tracking device.

To help illustrate and describe how the status handler thread handles different events, a map 1700 in FIG. 17 illustrates a number of different types of zones that the monitoring system 108 uses in monitoring an individual. It should be noted that the map 1700 shown in FIG. 17 is only an example, and it should be appreciated that other different types of zone combinations and/or areas can be used. Although the example in FIG. 17 will be described with reference to a single monitored individual, the monitoring system 108 can also specify regions for groups of individuals. For instance, the monitoring system 108 can specify that a group parolees with a history of violent crimes can be prohibited from entering gun shops. In the illustrated example, a monitored individual is on a work-release program. The terms of the monitored individual's parole allow the monitored individual to live at home 1702, and at certain times, the monitored individual is allowed to travel to and from work 1704 along roads 1706 and the like. Another term of the monitored person's parole requires that the individual stay a specified distance from schools 1708.

The monitoring system 100 utilizes a number of different types of zones or regions for monitoring the position of an individual. As should be appreciated, these zones are not limited to specific buildings and/or geographic features. As shown around the home 1702 and the work area 1704, the monitored area can include interior regions or inclusion zones 1710 in which the monitored individual must stay. Furthermore, the monitored person can have exterior regions or exclusion zones 1712 in which the monitored person is prohibited from entering. The regions 1710, 1712 can be stationary (static) and/or can be dynamic so as to change over time. For example, the location of an exterior region 1712 can vary over time as the person with a restraining (device 120) goes about their daily routine. The interior regions 1710 can, if so wished, be subdivided into warm interior regions 1714 and hot interior regions 1716. When inside the warm interior regions 1714, the tracking device 102 only reports the position and status information (if so desired) at a low rate. When in the hot interior region, the device reports location as well as status information, if so desired, at a higher rate. Similarly, the exterior regions 1712 can be subdivided into warm exterior regions 1718 and hot exterior regions 1720. When the monitored person enters the warm region 1718, an alarm sounds on the tracking device 102 in one embodiment. When the monitored person enters a hot exterior region 1720, the reporting rate increases as well as other alerts can be provided. It should be appreciated that the type of alarms and actions can be individualized for different circumstances. In other embodiments, the interior 1710 and the exterior 1712 regions can include tepid regions that have a lower priority than the warm and hot regions. The specified interior 1710 and/or exterior 1712 regions for the monitored individual can also include a series of geo-routes 1722 along which the monitored individual can travel. These geo-routes 1722 can have designated time periods of when they are effective, like the other regions. In the illustrated example, the geo-routes 1722 include a series of interior regions 1710 that generally coincide with the shape of the road 1706. It should be appreciated, however, that the geo-route 1722 can be defined by exterior regions 1712, or a combination of exterior and interior regions. Crossing a boundary of one of these regions at a time that is not approved will cause a violation. According to one configuration of the tracking device 102, a violation can for example cause one or more of the following events: a change in the reporting rate, a change in the amount of data transmitted in a message, an audible alert sound and/or a visual alert can be displayed, to name a few.

As should be noticed, the zones in FIG. 17 have a square or rectangular shape, that is, they are non-circular. By using a rectangular shape, the computing power required to calculate the latitude and longitude of the rectangular zone is significantly reduced as compared to computing the latitudes and longitudes of a circular zone. The use of rectangular shaped zones is especially helpful with portable devices 116, such as mobile telephones 502, which usually have limited computing power. Although the zones described below have a rectangular shape, it is contemplated that the zones in others embodiments can have other polygonal shapes. Moreover, due to the curvature of the Earth, it should be appreciated that the boundaries of the zones may be slightly bowed.

Referring to FIG. 17, the monitoring system 108 in one embodiment sends to the tracking device 102 upper left 1724 (northwest) and lower right 1726 (southeast) latitude/longitude coordinates. In addition to sending the upper left 1724 and lower right 1726 coordinates, the monitoring system 108 sends one or more identifiers that identify the zone type (i.e., interior, exterior, tepid, warm, and hot). Further, the monitoring system 108 can specify the reporting interval for the specific zone, if needed. In one embodiment, if the reporting interval is not set, the tracking device 102 uses a default reporting interval, which can be set when the tracking device is configured. The tracking device 102 performs a one-time calculation for the four (4) boundary coordinates that define the zone and store the boundary coordinates in memory 220 along with the other information pertaining to the zone. For instance, the tracking device 102 determines lower left coordinates 1728 (southwest) of a zone by combining the longitude of the upper left coordinate 1724 with the latitude of the lower right coordinate 1726. Similarly, the tracking device 102 calculates upper right coordinates 1730 of a zone by combining the latitude of the upper left coordinate 1724 with the longitude of the lower right coordinate 1726. To specify a warm or tepid region, the monitoring system 108 sends a latitude perimeter distance 1732 and a longitude perimeter distance 1734 for the desired warm or tepid region. The tracking device 102 determines the warm or tepid regions by adding or subtracting the perimeter distances 1732, 1734, depending on the region type. Nevertheless, it should be appreciated that boundary coordinates for the rectangular zone can be communicated and/or calculated in other manners. For instance, the monitoring system 108 can send to the tracking device 102 a center coordinate along with the length and width of the rectangular zone. To update the zone coordinates, the monitoring system 108 simply transmits the new coordinates to the tracking device 102, which in turn updates the boundary coordinates in memory 220. In one embodiment, the personal tracking device 102 is able to handle a maximum number of interior and/or exterior zones, such as four (4) zones or two-hundred and fifty-five (255) zones. In another embodiment, the number of zones is not limited to a specific maximum number. Even when the number of zones are fixed, the zones can be changed as the tracking device 102 is running, thereby providing a virtual unlimited number of zones available to monitor an individual.

As mentioned above, the zones can be defined in the form of other polygonal shapes by the tracking device 102 receiving two or more coordinates that define the polygonal shape. For example, when in the form of an equilateral triangle, the monitoring system 108 sends the coordinates for two corners of the triangle, and the tracking device 102 determines the third coordinate using a trigonometric function. In the case of a zone shaped in the form of a right triangle, selected coordinates and/or angles can be used to define the shape of the zone through trigonometry. In another example, the coordinates for the five corners of a pentagon are used to define a zone having the shape of a pentagon. Further, it should be appreciated that a combination of different polygonal shapes can be used to define zones.

With the above discussed background information in mind, the status handler thread will now be described with reference to FIGS. 18, 19, 20 and 21. As mentioned above, the status handler receives GPS information from the GPS handler (FIG. 15) and PID/receiver module status information from the PID handler (FIG. 16) and forms a status message. This status message is then sent to the monitoring system 102 via the server handler thread. The status handler is configured to immediately generate a status message upon a violation, such as a zone violation or PID tampering, as well as generate periodic status messages at a rate depending on which zone the monitored individual is located.

Figure 18:
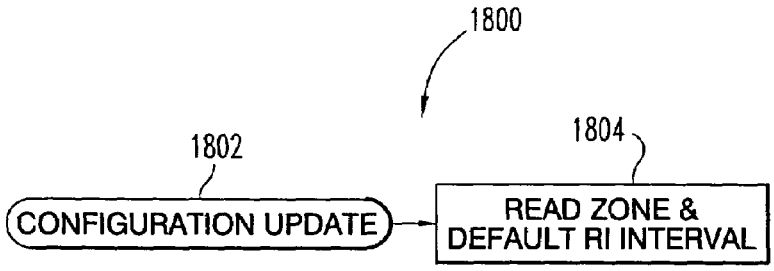
FIG. 18 is a flow diagram illustrating a technique for configuring the tracking device.

As previously noted, the monitoring system 102 sends to the tracking device 102 zone coordinate information as well as the corresponding reporting interval for the zone, if needed. When a reporting interval for a zone is not supplied, the tracking device 102 relies upon a default reporting interval that was previously configured in the tracking device 102. Flowchart 1800 in FIG. 18 illustrates a technique for updating the zone information and reporting interval information in the tracking device 102. After the technique is initiated in stage 1802, the processor 218 of tracking device 102 receives and stores in memory 220 the configuration information from the monitoring system 108 in stage 1804. In one embodiment, the configuration information includes the zone information and default reporting interval information. However, it should be appreciated that other types of configuration information can be stored in memory of the tracking device 102. According to one embodiment, during configuration of the tracking device 102 in stage 1804, the default reporting interval is stored in memory 220 of the tracking device 102. When zone information is processed in stage 1804, upper left 1724 (northwest) and lower right 1726 (southeast) latitude/longitude coordinates along with the zone type (i.e., hot exterior) and the reporting interval, if provided, are stored in memory of the tracking device 102.

Figure 16:
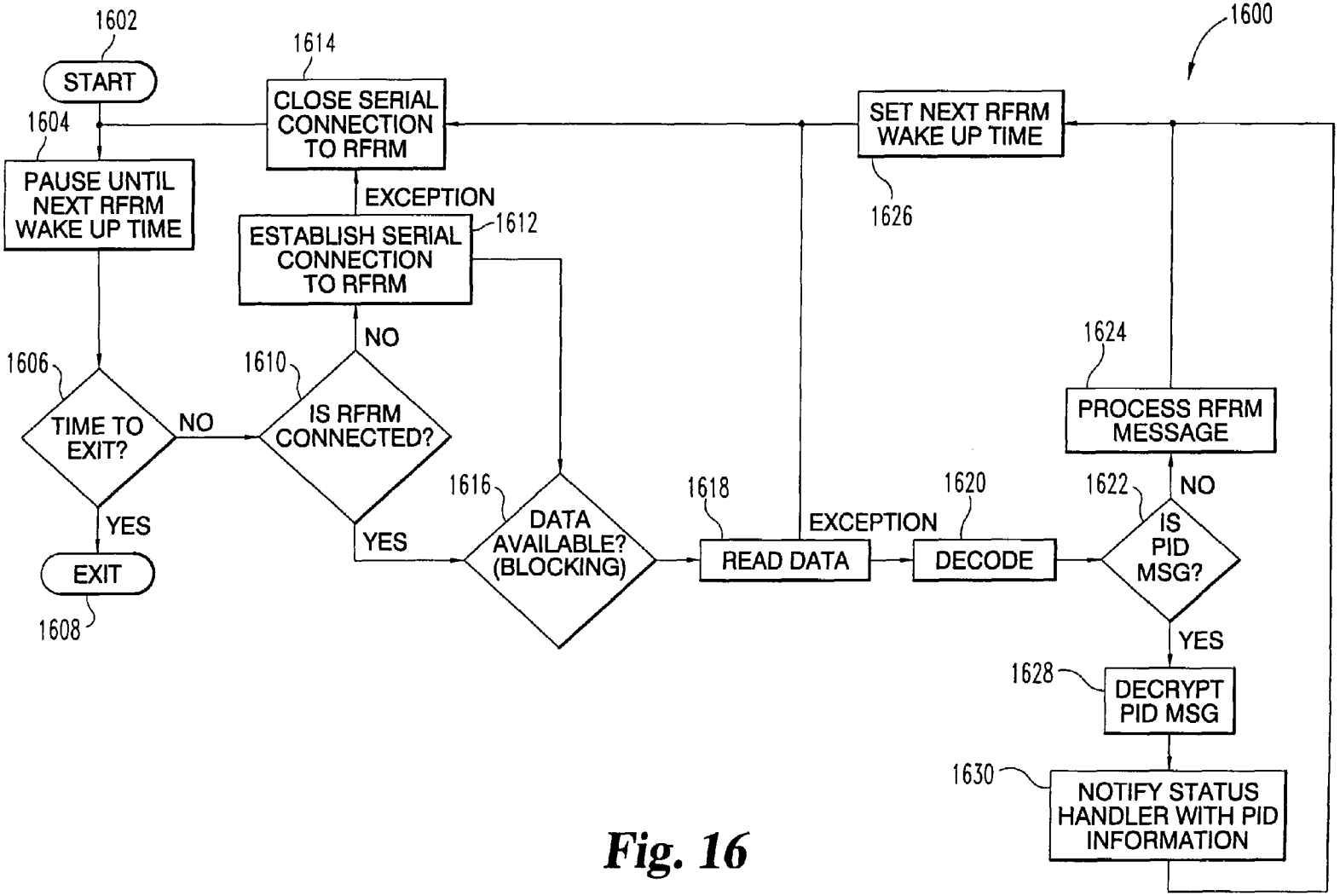
FIG. 16 is a flow diagram illustrating a technique for processing communications with a personal identification device of the tracking device.
Figure 19:
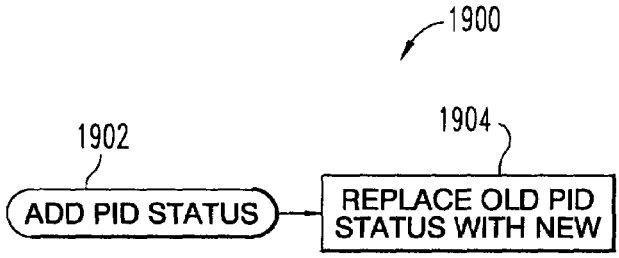
FIG. 19 is a flow diagram illustrating a technique for updating the status of the personal identification device of the tracking device.

As discussed in detail above with reference to FIG. 16, the PID handler thread in stage 1628 provides the status handler thread information about the PID 132, such whether someone tampered with the PID 132. FIG. 19 illustrates a technique for updating the status of the PID 132 from the PID handler thread. In stage 1902, PID status information from the PID handler is stored in memory 220 of the tracking device 102, and as shown in stage 1904, the old PID status information is replaced with the new PID status information. By replacing old PID status information with new information, the PID information that is sent from the tracking device 102 contains the most recent information.

Figure 20:
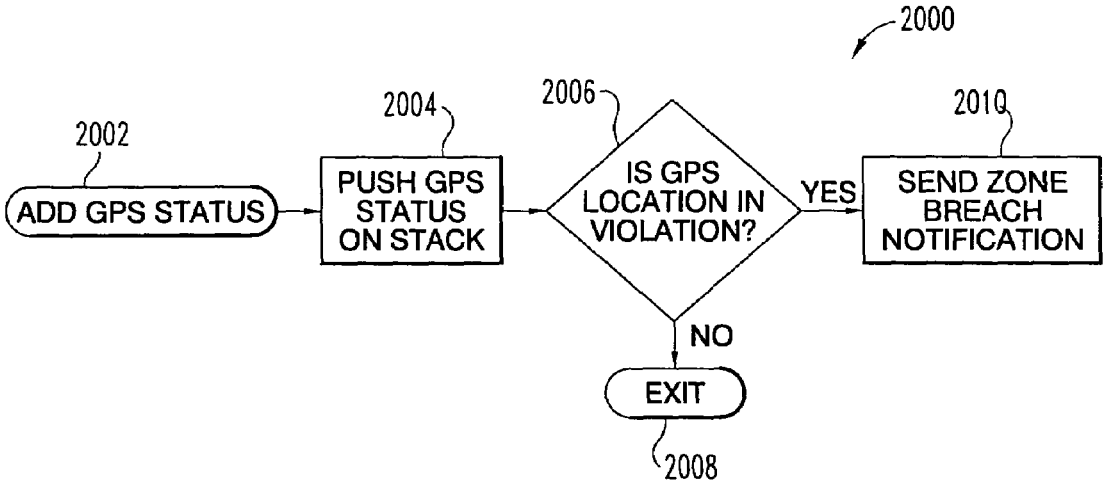
FIG. 20 is a flow diagram illustrating a technique for detecting zone or region violations.
Figure 21:
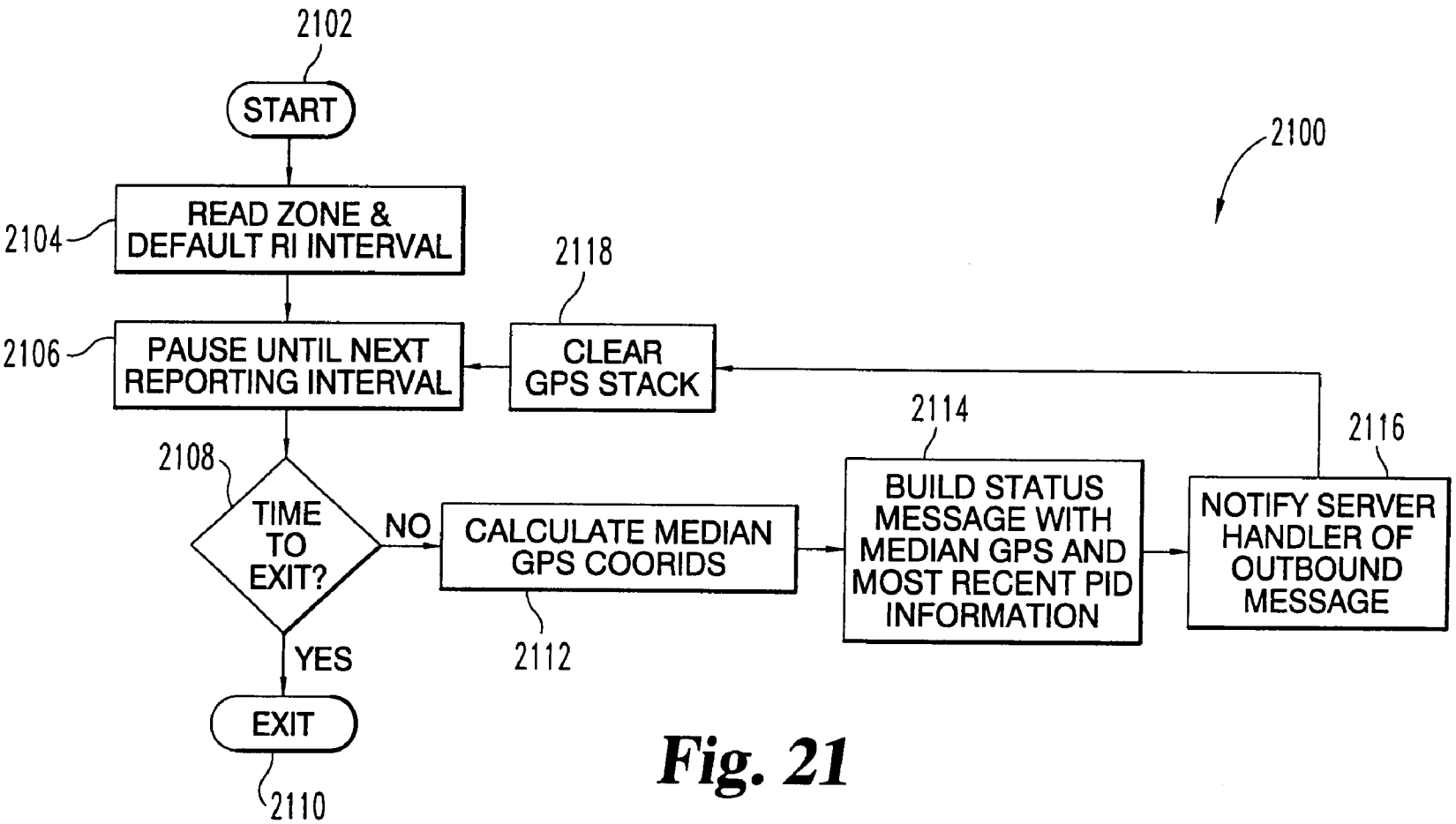
FIG. 21 is a flow diagram illustrating a technique for reducing errant location readings of the tracking device.

In addition to monitoring the status of the PID 132, the status handler thread monitors for any zone violations. The status handler thread listens for any new GPS status objects that have been created by the GPS handler thread. Upon receipt of a new GPS status object, the contents (GPS coordinates) of the GPS object are compared to the zone coordinates stored in memory 220 to check for any zone violations. FIG. 20 has a flowchart 200 that illustrates a technique for checking for zone violations according to one embodiment. As the GPS status object is added by the GPS handler thread in stage 2002, the GPS status information in stage 2004 is placed on a GPS status stack in the memory 220 of the tracking device 102. In stage 2006, if the current GPS location on the GPS status stack does not violate any of the zones stored in memory 220, the status handler thread exits in stage 2008. Otherwise, upon a zone violation, the status handler in stage 2010 sends a zone notification breach to the monitoring system 108 via the server handler thread. So as to conserve space in memory 220 of the tracking device 102, the individual date/time stamps for the GPS coordinates from the GPS chip 224 in one embodiment are not stored on the tracking device 102. Instead, the time that the GPS status information is sent to or received at the monitoring system 108 is used to track the monitored individual's location.

As was described above with reference to FIG. 20, the tracking device 102 is configured to immediately (or nearly immediately) notify the monitoring system 108 of a zone violation, if so configured. Further, the tracking device 102 is configured to periodically provide the monitoring system 108 the location of the monitored individual. The reporting interval between location reports can vary depending on which zone the monitored individual is currently located. A technique, according to one embodiment, for reporting the location of the tracking device 102 will now be described with reference to flowchart 2100 in FIG. 21. After initializing in stage 2102, the processor 218 of the tracking device 102 via the status handler thread reads the zone and reporting interval information from memory 220 in stage 2104. Each zone stored in memory 220 can have a different reporting interval or can share a common reporting interval. When the zone information stored in memory 220 does not specify a reporting interval, the tracking device 102 uses the default reporting interval stored in memory 220. In stage 2106, the status handler thread pauses until the next reporting interval. The reporting interval used in stage 2106 changes based on the current or previously reported location coordinates. It should be appreciated that in stage 2106 the status handler can also change the reporting interval based on changes in the zone information, the default interval and/or the location of the tracking device 102. Upon the next reporting interval, the status handler thread determines whether or not it is time to exit in stage 2108, as was described before with reference to FIG. 14. If the status handler is being shut down in stage 2108, the status handler thread shuts down in stage 2110. If not, the status handler thread in stage 2112 calculates the median GPS coordinates. The status handler thread can receive up to approximately 1–60 GPS locations every minute, but typically has a reporting interval less than the GPS reporting interval, such as thirty seconds. Thus, for example, the status handler thread could possibly receive thirty GPS locations for every status message that is sent. In one embodiment, the status handler thread stores all GPS locations received and calculates the median of the stored locations to determine the location that is sent to the tracking system 108. By calculating the median, stray or "one off" GPS fixes that are errant are reduced or eliminated. Sometimes the GPS chip 224 can report a misread or errant location. The median calculation removes such stray or errant locations so that the GPS location that is most prevalent from the set is supplied to the tracking system 108. Since the median location is sent to the monitoring system 108, the individual date/time stamps for the individual location readings have no real meaning or values, and therefore, to save memory space, the individual date/time stamps are not stored in memory 220. Rather, as discussed above, the message sent or received time is used to chronologically track the monitored individual's location. In other embodiments, it is contemplated that other types of statistical measures can be used to reduce the effect of stray GPS fixes, such as the average of location fixes.

After the median coordinate is calculated in stage 2112, the status handler thread builds a status message with the median GPS coordinate and the most recent PID information from the PID handler thread. As described above with reference to flow chart 1900 (FIG. 19), the status handler thread constantly replaces old PID status information with new PID status information so that the monitoring system 108 receives the most recent information. In one embodiment, the status handler thread reports the most recent PID information, and in another embodiment, it is contemplated that the PID handler reports only alerts or violations from the PID 132 that may have occurred during the last interval so that message space is conserved. Once the status message has been created, the status handler thread in stage 2116 notifies the server handler of an outbound message in stage 2116. The stack of GPS coordinates are then cleared from memory 220 in stage 2118, and the status handler thread pauses until the next reporting interval so as to repeat the routine until the thread is shut down in stage 2110. With the above-described technique, the number of false or stray location coordinates transmitted to the monitoring system 108 are reduced.

Figure 42:
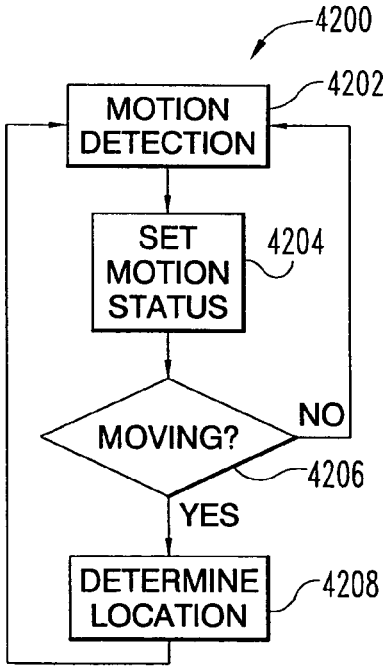
FIG. 42 is a flow diagram illustrating a technique for improving location determination when a monitored individual is nearly motionless.

Another technique for reducing the number of false or stray location readings will be described with reference to flowchart 4200 in FIG. 42. With GPS systems, the measured location of the GPS receiver when not in motion can tend to drift overtime due to many factors, such as from the canyon affect created by GPS signals reflecting off of buildings or other objects. These errors can be quite significant overtime so as to make accurate tracking of monitored individuals when not in motion difficult, or even practically impossible. For instance, location-reading errors from up to three (3) miles can be quite common when an individual is not moving for a period of time. In the embodiment illustrated in FIG. 2, the tracking device 102 utilizes the motion sensor 223 to reduce the amount of drift in the location readings when the tracking device is motionless or nearly motionless. The motion sensor 223 in stage 4202 determines whether or not the tracking device 102 has moved, and the tracking device 102 in stage 4202 records in memory 220 whether the tracking device 102 has moved. As an example, when the tracking device 102 is motionless, the motion status variable in memory 220 for the tracking device 102 is set to a value of zero (0), and when the tracking device 102 moves, the variable has a value of one (1). It should be recognized that the motion status of the tracking device 102 can be identified in other manners. If the tracking device 102 has not moved (stage 4206), the tracking device 102 continues to monitor for motion (stage 4202). Otherwise, the tracking device 4208 determines its location through a single GPS reading or through multiple GPS readings in stage 4208, and continues motion detection in stage 4202. A considerable amount of power is drained each time the GPS receiver 224 is energized to take a reading. In the illustrated embodiment, the tracking device 102 determines only a single GPS reading in stage 4208 so as to conserve battery power, and only this single GPS reading is sent to the monitoring system 108. It is envisioned that in other embodiments multiple GPS readings can be taken when the tracking device 102 is in motion and a statistical measure of the readings, like the ones previously described, or all of the readings can be transmitted to the monitoring system 108. Although the technique has been described with reference to the motion of the tracking device 102, it should be recognized that the motion sensor 223 can be directly or indirectly attached to the monitored individual, such as through the PID 132, so as to monitor the actual motion of the individual.

Where power consumption is not a concern, the tracking device 102 in an alternate embodiment can take GPS readings all of the time, regardless whether the tracking device 102 is moving or not, but the location coordinates are only transmitted to the monitoring system 108 when the tracking device 102 is moving. Further, it is contemplated that the tracking device 102, even when motionless, might occasionally determine and transmit its location so that the monitoring system 108 is able to determine if the motion sensor 223 or other components are operating properly in order to detect any tampering. Alternatively or additionally, the tracking device 102 in other forms might detect (and transmit) its location when it first becomes motionless, but afterwards, does not detect (and/or transmit) its location again until it moves. In still yet further embodiments, the tracking device 102 determines its location regardless of whether or not the tracking device 102 is moving, but when motionless, the tracking device 102 continues to transmit the same old location reading of when the tracking device 102 first stopped moving. In other forms, the tracking device 102 may still transmit new location readings when the tracking device 102 is motionless, but the readings are flagged so that the monitoring system 108 knows that the readings might be suspect and not worth processing. As should be further should be appreciated, the location information resulting from the above-described techniques can be utilized for processing internally within the tracking device 102. For instance, if the tracking device 102 has not moved, the tracking device 102 can skip some or all of the stages used to determine if the monitored individual has violated a zone or other rules, which can in turn improve overall operational performance. To reiterate, by ceasing the determination, processing and/or transmission of location readings when the tracking device 102 and/or the monitored individual is not in motion, the number of erroneous readings can be reduced.

As previously mentioned, the server handler thread handles communications between the tracking device 102 and the monitoring system 108. According to one embodiment of the present invention, the tracking device 102 and the monitoring system 108 communicate via a user datagram protocol (UDP). It should be appreciated that in other embodiments, other types of communication protocols such as transmission control protocol (TCP) can be used. For example, in situations where the guarantee of packet delivery is a concern, TCP/IP can be used. Practically speaking, when TCP/IP is used for communications, messages in one embodiment are typically bundled together, and the transmission rates of the messages are reduced so as to keep the communication workload at an economical level. For instance, instead of sending status and location messages every minute, which is possible with UDP, the information from sixty (60) messages are bundled together in a single message that is sent every hour when using TCP/IP. With TCP/IP, when a violation or a change of status occurs, an appropriate message is then sent immediately.

Nevertheless, it was discovered that UDP communications were well suited for personal tracking devices 102 since, among other reasons, it is faster because there is no socket set-up, most of the messages are less than one datagram packet so packet assembly is not needed, and the monitoring system 108 does not have to create a server socket thread for each message or device, which could potentially be hundreds of thousands of devices. Since UDP packets talk directly to a given port, it is envisioned the monitoring system 108 can have multiple UDP servers on different ports for a single Internet Protocol (IP) address and users would be grouped into a certain number assigned to a particular port on a particular server IP. With UDP, the monitoring system 108 does not have to create a server socket thread for each message or device. In contrast, if multiple individuals were monitored via TCP, a large number of sockets would have to be created on the monitoring system 108, which in turn would significantly increase the workload on the system 108. UDP allows the monitoring system 108 to grow by both additional server threads and network interfaces to handle foreseen growth.

In contrast to TCP, a packet's delivery or sequence of packets is not guaranteed using UDP. Nonetheless, to reduce communication traffic congestion and communication costs, the messages communicated according to one embodiment in system 100 are designed to be transmitted as a single packet, and further, only selected messages are acknowledged. As discussed above, reducing the communication overhead can significantly reduce the cost in running the monitoring system 108, and therefore, by eliminating most acknowledgement packets can significantly reduce the communication costs and workload. In one type of pricing plan, communication service providers charge rates based on the amount of data transferred in a specified period, such as per hour. For example, a communication provider may charge a relatively low rate if usage does not exceed five megabytes per hour (5 MB/h) and a significantly higher rate for higher usage. For cash strapped government agencies, these differences in price can be significant, such that the cost of operating a home detention program may not be cost justified. The communication architecture according to one embodiment of the present invention reduces the size of messages communicated so as to conserve on communication costs. Most messages are less than one datagram packet so packet assembly is not needed. According to one embodiment, only the configuration, text/voice, and zone messages are acknowledged by the tracking device 102. By acknowledging these messages, the monitoring system 108 is assured that the tracking device 102 was configured properly or received the test/voice message. It should be noted that receipt of the status messages from the tracking device 102 is not acknowledged by the monitoring system. Even though status messages are not acknowledged, the status messages occur so frequently that if a very small number were missed this would not present a problem. Moreover, the time between sending the status message and receipt of the acknowledgement can be greater than the time between status messages, thereby leading to needless network congestion and increased power drain on the tracking device 102.

A number of different types of messages are sent between the personal tracking device 102 and the monitoring system 108. These messages include a ping message to determine the existence or state of the tracking device 102 so as to verify network connectivity, an acknowledgement message to confirm receipt of certain types of messages, a configuration message so as to configure the personal tracking device 102, and a status message that is sent by the tracking device 102 to provide status information about the device 102. Another type of message is a text message that is sent to be displayed and/or played on the tracking device 102. The monitoring system 108 sends a request for status message so as to command the tracking device 102 to acquire its location coordinates and the latest status of the PID 132 immediately. Another type of message is a zone message for configuring the particular monitored zones on the personal tracking device 102. Of these types of messages, the ping message, the configuration message, the text message and the zone message are acknowledged with an acknowledgment message in one embodiment. It is contemplated that, in other embodiments, acknowledgement messages can be sent in response to other types of messages. For example, the status message can be acknowledged in other embodiments. It is also envisioned that multiple acknowledgement messages can be sent in response to a single message. For instance, as will be described in greater detail below, the text message can be first acknowledged by the tracking device 102 once it is received and can be acknowledged a second time when the individual has reviewed the message.

Each message sent between the personal tracking device 102 and the monitoring system 108 includes a message header. In a selected embodiment, the message header is a five (5) byte message that contains the PID address, the message type ID, and revision of the message structure. In the initial byte, the lower four (4) bits contain the message type structure, and the high four (4) bits contain the message identifier. This provides a maximum of sixteen different types of messages and revisions of each message type's data structure. The remaining four (4) contain a unique identifier for the PID 132. The PID 132 can be assigned the unique identifier, such as a serial number, when it is originally manufactured or it can be configured at a later time with the unique identifier. It nevertheless should be understood that other types of message structures can be used in communications between the tracking device 102 and the monitoring system 108. Table 3 provided below depicts the message header according to the embodiment that was described above.

TABLE 3

| | | |
|---|---|---|
| Message Type and Revision | 1 bytes | Bits 0–3 message Id<br>Bits 4–7 protocol version |
| PID ID | 4 bytes | Unique ID of PID |

As mentioned above, the ping message determines the existence or state of the personal tracking device and verifies network connectivity. For example, referring to FIG. 1, the monitoring system 108 sends a ping message to the tracking device 102, and in response, the tracking device sends an acknowledgement message back to the monitoring system 108 to confirm that the ping message was received. As noted above, the acknowledgement can be in response to a number of messages, such as ping, configuration, text and zone messages. Table 4 below provides the data structure for an acknowledgement structure according to one embodiment of the present invention.

TABLE 4

| | | |
|---|---|---|
| Message Type/Version | 1 byte | Message Type/Protocol Version Acknowledging. |
| The following data values are dependent on the Message Type being acknowledged. | | |
| Configuration<br>Text<br>Zone | 1 byte | Configuration. Set to 0 if configuration set correctly, or the configuration type Id of the configuration parameter that failed.<br>Text.<br>Bit 0–4 contains the Message number (0–31) to identify this message.<br>Bit 5 identifies the message acknowledgement status.<br>0 = Received<br>1 = Read or Viewed<br>Zone. Set to 0 if configuration set correctly, or a value of 1–255 indicating error code. |
| Ping | 4 byte | Ping: Returns Tracking Device ID. |

As described above, the body of the acknowledgement message depends on the type of message being acknowledged. For example, if a configuration message is received, the tracking device 102 returns a value of zero (0) when the configuration was set up properly on the tracking device 102, or the configuration type ID of the configuration parameter that failed (see, Table 5 below for a list of configuration types). Similarly, the acknowledgement message for a text message can indicate receipt of the text message as well as whether the message was reviewed. The zone information indicates whether the zone was set up correctly or if not, the value of the error code for the problem in setting up the zone. As should be appreciated, the acknowledgement message also incorporates the requisite addressing information so that the acknowledgement message can be directed to the proper server and port in the monitoring system 108. It is contemplated that the acknowledgement message can be modified in other manners so as to omit information and/or include additional information.

The configuration message is sent by the monitoring system 108 so as to alter the configuration variables stored on the tracking device 102. The structure of the configuration message is variable depending on what type of configuration parameters are being sent, such as the new server internet IP address, or the PID transmission time. Table 5, which is shown below, illustrates a number of configuration messages as well as the corresponding data sent along with the message according to one embodiment. Although not shown in Table 5, it should be appreciated from the discussion of above that the configuration message also includes the message header information of Table 3.

TABLE 5

| | | |
|---|---|---|
| Configuration Types | 1 byte | Configuration Parameter to set.<br>Can be a combination of any defined configuration updates. For example, if the value of this byte is:<br>= 1 - only the default reporting interval was sent.<br>= 3 - the default reporting interval and new Host Server address was sent. (Bit 0 & Bit 1 are set)<br>= 6 - new Host Address and new PID ID sent (Bit 2 and Bit 1 are set)<br>= 5 - new Reporting Interval and new PID ID sent (phone will read Interval then PID ID) (Bit 0 & Bit 2 are set)<br>If multiple configurations are issued, the tracking device will always read the configuration types in the order they are listed here. |
| The following data values are dependent on the configuration parameter being set: | | |
| Default Reporting Interval (1) | 1 byte | Default reporting interval in minutes (1–255). |
| Host Server Address (2) | 4 byte | Address of the new Host server to report to in the monitoring system |
| PID ID (4) | 4 byte | PID ID to accept from PID Unit |
| Host Server Port (8) | 2 byte | Port address to connect to at Host Server IP |
| Secondary Host Server (16) | 4 byte | Secondary Host Server for back up to Primary Host Server |
| Phone ID (32) | 4 byte | Phone ID. Unique ID supplied by Server for the Phone. |
| Display Message (64) | X + 1 byte | 1st byte (0–X) represent the number bytes to read following the 1st byte and display as text on the main display of the phone. If 0 is passed display text is removed from phone. |

Some of the configuration messages include updating the default reporting interval for the tracking device 102. For example, the default reporting interval can be in minutes up to 255 minutes, according to one embodiment, but it is contemplated that different interval ranges can be used. In one form, the configuration type value is set to one (1) (i.e., the zero (0) bit in the configuration type is set to one (1)), followed by the default reporting interval in minutes, in order to set the default reporting interval. Another parameter on the tracking device 102 that can be updated is the address of a server in the monitoring system 108. According to one embodiment, the address is enabled by setting the one bit (1) of the configuration type byte to a value of one (1), such that the configuration type has a value of two (2). Another configuration variable that can be set by the monitoring system 108 on the personal tracking device 102 is the unique identifier for the PID 132. When a configuration type value of four (4) is sent (i.e., bit two (2) is set), the configuration message initializes the tracking device 102 with the identifying number or PID ID to look for when it receives a message from the PID 132. In the case that the PID identifying number is zero (0), then the existing PID identifier is removed from memory 220, and tracking device 102 will not receive or transmit any status messages from any PID units. In another embodiment, when the PID identifying number is zero (0), then the tracking device 102 is configured to send information from all PID's 132 within its communication range, which can be useful for halfway house environments. The host server port in the monitoring system 108 that the tracking device 102 communicates with can also be identified by setting bit three (3) of the configuration type. When bit four (4) of the configuration type is set, a backup or secondary host server in the monitoring system 108 is stored in memory of the tracking device 102. The unique identifying number of the portable device 116, such as the mobile telephone 502, can be designated by setting bit five (5) of the configuration type. Messages can be displayed or removed from the display 518 of the mobile telephone 506 or other types of tracking devices 102 by setting bit six (6) of the configuration type portion of the configuration message. It should be appreciated that other types of parameters can be set by sending a configuration message. After the sent configuration parameters are stored in memory 220, the tracking device 102 sends an acknowledgement message of the type as was described above with reference to Table 4.

As noted above, the status message is sent by the tracking device 102 to the monitoring system 108 in order to report the operational status of the tracking device 102 as well as its location. The status message or data packet is sent periodically at intervals based on the reporting interval in memory 220 that is associated with the current zone in which the tracking device 102 is located. In addition to adjusting the reporting interval, the tracking device 102 according one or more embodiments of the present invention is able to reduce the size of the status message, depending on the current status conditions, so as to reduce communication workload and costs. Table 6 provides a message structure for one such type of status message. Although not shown in Table 5, it should be appreciated from the discussion of above that the status message also includes address information that directs the status message to the server address and port of the monitoring system 108 that was specified with the configuration message.

TABLE 6

| | | |
|---|---|---|
| GMT Time Stamp (Packed data) | 4 bytes | Bit 0–4 (Hour 0–23)<br>Bit 5–10 (Minute 0–59)<br>Bit 11–16 (Second 0–59)<br>Bit 17–21 (Day of Month 1–31)<br>Bit 22–25 (Month 1–12)<br>Bit 26–31 (Year 03–63) |
| PID Status | 1 byte | Bit 0 (Tamper)<br>Bit 1 (Latched Tamper)<br>Bit 2 (PID Battery Low)<br>Bit 3 (Internal Error)<br>Bit 4 (Power Reset)<br>Bit 5 (Latched Cleared)<br>Bit 6 (PID Data Freq. Err)<br>Bit 7 (PID Comm. Err) |
| Phone/GPS Status | 1 byte | Bit 0 (Phone Battery Low)<br>Bit 1 (GPS Error, 1 byte error code follows instead of GPS Lat/Long)<br>Bit 2 (No location change from last status. There is no GPS Lat/Long data sent)<br>Bit 3 = 0 (Not Moving)<br>= 1 (Moving)<br>Bit 4 (GPS using 3rd party assisted tracking)<br>Bit 5 (Latitude is negative - South)<br>Bit 6 (Longitude is negative - West)<br>Bit 7 Future |
| Battery Voltage | 1 byte/ No data | Number ranging from 0–69 with an implied decimal point. Thus 48 = 4.8 volts |
| Zone Status | 1 byte/ No data | Bit 0 = 0 Interior (Inclusion).<br>= 1 Exterior (Exclusion).<br>Bit 1 = 1 Tepid<br>Bit 2 = 1 Warm<br>Bit 3 = 1 Hot<br>Bits 4–7 = Other Zones |
| GPS Lat/Long | 8 bytes/ 1 byte/ No data | 4 byte Latitude/4 byte Longitude or 1 byte error code or no data if Bit 2 of Phone / GPS Status set.<br>Lat/Long is in 1/1e5 minutes |
| Message Local Time Stamp | 4 bytes | Bit 0–4 (Hour 0–23)<br>Bit 5–10 (Minute 0–59)<br>Bit 11–16 (Second 0–59)<br>Bit 17–21 (Day of Month 1–31)<br>Bit 22–25 (Month 1–12)<br>Bit 26–31 (Year 03–63) |

As shown above, the time stamp portion of the status message provides the Greenwich Mean Time (GMT) of when the position was acquired. According to one embodiment, the message further includes a message local time stamp portion that provide the local time when the message was sent. It nevertheless should be appreciated that the status message can be organized in other manners. Selected bits in the PID status portion or byte indicates whether or not the PID 132 is operating properly, and if the PID 132 is malfunctioning, what problem has occurred. For example, the PID status byte has a value of zero (0) when the PID 132 is operating properly. The GPS/mobile phone status portion or byte indicates whether or not the portable device 116 is operating properly and/or location information. For example, when the power of the battery or fuel cell in the portable device 116 is low, it can be indicated by setting the zero (0) bit in the phone status byte to a value of one (1). To reduce the size of the message, the tracking device 102 has the ability to reduce the size of the message depending on the current status of the tracking device 102. When an error or problem has occurred on the tracking device 102, instead of sending the entire location coordinates of the device 102, which can occupy eight (8) bytes, the tracking device 102 sets the one (1) bit to a value of one (1), and further, returns an error code in the form of a single byte to identify the problem. An example of an error code can include that the tracking device 102 was unable fix its location. As should be appreciated, the tracking device 102 can return other types of error codes in its status message.

The tracking device 102 is also configured to reduce the size of the status message by not including the location coordinates when the monitored individual has remained in the same general location or has not moved at all. By setting the two (2) bit in the GPS/mobile phone status byte to a value of one (1), it is indicated that the general location of the tracking device 102 has not changed, and as a result, the location of the tracking device 102 is not sent, thereby conserving eight (8) bytes of message space. In one embodiment, the location of the monitored individual is considered not changed when the tracking device 102 remains in the same zone. In another embodiment, the tracking device 102 is considered in the same location when the latitude and longitude values have not changed or only changed within a small margin of error. Alternatively or additionally, information from the motion sensor 223 can be sent via the third (3) bit in the GPS/mobile phone status byte, which has a value of zero (0) when the tracking device 102 is not moving and a value of one (1) when the tracking device is in motion. When the tracking device 102 is not moving, as is indicated by the third bit being zero (0), the location of the tracking device 102 is not sent again, thereby conserving eight (8) bytes of message space. Once the tracking device 102 is in motion, its new location is then sent. It is contemplated that the location of the tracking device 102 can be considered the same for status reporting purposes using other techniques, such as statistical measures (i.e., 6-sigma). Bit four (4) in the GPS/mobile phone status byte indicates that third party assisted tracking, such as via the location tracking system 131 of FIG. 1, was used in determining the location of the tracking device 102. Bits five (5) and six (6) of the GPS/mobile phone status byte respectively indicate if the sent latitude or longitude values are negative. Bits zero (0), three (3), four (4), five (5), six (6) and seven (7) of the GPS/mobile phone status byte can be set independently.

As shown in Table 6, the status message can also provide the battery voltage of the PID 132 and/or the portable device 116. By receiving the battery voltage, the monitoring system 108 can send messages to the appropriate personal, such as a police office or even the monitored individual, that the power on the tracking device 102 is running low. Typically, when the battery is low, the ability to pull a GPS location is the first feature lost, and as a result, the tracking device 102 sends an error message indicating the same. As the battery continues to drain, the ability to send communications becomes sporadic until communication with the tracking device 102 is completely lost. By having the ability to measure and communicate battery voltage, the monitoring system 108 is able to address the situation before the low battery causes a problem. It should be appreciated that the battery voltage information can be used for other purposes. For instance, the battery voltage portion of the message in other embodiments can indicate that the battery is being recharged when a specific value, such as "255", is sent to the monitoring system 108.

In addition, the status message is able to provide the current type of zone in which the tracking device 102 is located. For example, even when the exact coordinates of the tacking device 102 are not supplied because its location has not significantly changed, the tracking device 102 in the status message can indicate the type of zone in which it is located, such as a hot, warm or tepid, interior/exterior region. The zone information can further be supplied along with the location coordinates of the tracking device 102. Referring to Table 6, four (4) bytes of the GPS location portion of the status message includes the latitude and four (4) bytes include the longitude coordinates of the tracking device 102. As noted above, the tracking device 102 in one embodiment provides the median value of the longitude and latitude coordinates of the tracking 102 in order to reduce errant coordinates. It is contemplated that the location coordinates can be specified with more or less bytes in other embodiments.

The monitoring system 108 can send messages such as text messages for display on the tracking device 102 via the text message command. Likewise, the tracking device 102 can send messages for display on the monitoring system 108 via the text message command. When a text message is sent, each message is time stamped and given a unique message identifier relative to the sender. Table 7 below illustrates a text message structure according to one embodiment of the present invention. Like the other messages, the text message further includes address information in order to route the message (i.e., Table 3). It is contemplated that text message can be structured in other manners.

TABLE 7

| | | |
|---|---|---|
| GMT Time Stamp | 4 bytes | Bit 0–4 (Hour 0–23)<br>Bit 5–10 (Minute 0–59)<br>Bit 11–16 (Second 0–59)<br>Bit 17–21 (Day of Month 1–31)<br>Bit 22–25 (Month 1–12)<br>Bit 26–31 (Year 03–63) |
| Message Type and Number | 1 byte | Bit 0–4 Message number (0–31) to identify this message.<br>Bit 5–7 Number (0–7) to identify a particular message type (notification (1), alert (2), alarm (3), priority (4). |
| Subject or Title Length | 1 byte | Subject or Title for the message (255 character max). |
| Subject or Title Content | 0 to 255 bytes | Text of the Title or Subject line for the message. |
| Message Length | 2 bytes | Content of the message, up to maximum packet size. |
| Message Content | X bytes | X characters as specified in the Message Length. |

As shown, the text message includes a time stamp, a message type that identifies the particular type of message such as a notification, alert, alarm or high priority message as well as a subject or title length. The text message also includes a subject or title of the message, the message length and the content of the message. The length of the text message can vary depending on the type of message and its content. In the embodiment according to Table 7, the text message can be a minimum of eight (8) bytes in length, with no title or message, such as when an alarm is sent. With the Table 7 embodiment, the length of the text message is only limited by the maximum allowable packet size. It nevertheless should be appreciated that the size of the text message can be bigger or smaller in other embodiments. For example, the text message can span across multiple packets when TCP/IP is used.

As discussed above, the tracking device 102 is designed to run without any user interaction, with the exception of the participant responding to messages. For example, a parolee may automatically receive a text message from the monitoring system 108 indicating when the next scheduled meeting with the parole board is scheduled. In this example, the display 518 of the mobile telephone 502 will display the content of the text message sent from the monitoring system 108. Upon receipt of the text message, the mobile telephone 502 automatically sends an acknowledgement message to the monitoring system 108, as was discussed above with reference to Table 4 (Bit 5=0). Also, an alert can be sounded, such as a ring tone, to alert the monitored individual of the message. If so desired, the message displayed on the mobile telephone 502 can request the monitored individual to acknowledge their review of the message, and once acknowledged, the mobile telephone 502 sends a second acknowledgement message to the monitoring system 108. For example, the monitored individual can acknowledge their review of the message by pressing a specific button on the tracking device 102, such as the walkie-talkie button 532 on the mobile telephone 502 and/or verbally acknowledge review via the microphone 522. Biometric information, such as a picture of the monitored individual taken by the mobile telephone 502 or an electronic fingerprint, can be required to acknowledge the message. Referring to Table 4, when acknowledging the text message in this example, the mobile telephone 502 sets bit five (5) of the acknowledgement message equal to one (1).

As was described with reference to FIG. 17, the personal tracking device 102 can store in memory 220 interior 1710 as well as exterior 1712 regions or zones. Furthermore, these zones can be further subdivided into tepid, warm and/or hot zones, if so desired. According to one embodiment, these zones have a rectangular area, which in turn makes determining the boundaries for violations easier than requiring the tracking device 102 to compute circular longitudinal and latitudinal zones. As noted above, a zone message is sent from the monitoring system 108 to the tracking device 102 to set the specific regions in which a person is to be monitored. Table 8 below provides an example of a zone or region message structure according to one embodiment. It should be appreciated that other types of zone messages may be sent.

TABLE 8

| | | |
|---|---|---|
| Number of Zones | 1 byte | Number from 1 to maximum allowed (4). A value of 0 is used to delete all zones in the tacking device. No additional information is sent or needed for this. The tracking device should ignore any additional zone information in this packet if the number of zones is 0. |

TABLE 8-continued

| | | |
|---|---|---|
| Zone Type | 1 byte | Bit 0 = 0 For interior zone, 1 for exclusive zone<br>Bit 1 Future<br>Bit 2 = 0 if no RI or 1 is RI is supplied.<br>Bit 3 UL (Latitude is negative - South)<br>Bit 4 UL (Longitude is negative - West)<br>Bit 5 LR (Latitude is negative - South)<br>Bit 6 LR (Longitude is negative - West)<br>Bit 7 = 1 if Warm Zone supplied, 0 if not. |
| Zone Upper Left Corner Coordinates | 8 bytes | 4-byte Latitude followed by 4-byte Longitude. Integer values of 1/100,000 degrees. |
| Zone Lower Right Corner Coordinates | 8 bytes | 4-byte Latitude followed by 4-byte Longitude. Integer values of 1/100,000 degrees. |
| Zone Reporting Rate | 1 byte | Reporting interval. If the Zone Type is an exterior zone then the RI will be in seconds (1–255). If the Zone Type is an interior zone then the RI will be in minutes (1–255). |
| Warm Zone Latitude perimeter distance/Longitude perimeter distance | 4 bytes | 2-byte size of warm perimeter Latitude distance followed by 2-byte Longitude perimeter distance. If the 4 bytes are zero then the zone does not have a warm zone. |
| Tepid Zone Latitude perimeter distance/ Longitude perimeter distance | 4 bytes | 2-byte size of tepid perimeter Latitude distance followed by 2-byte Longitude perimeter distance. If the 4 bytes are zero then the zone does not have a tepid zone. |

According to the Table 8 embodiment, the number of zones stored in the tracking device 102 is limited to a maximum number of zones. It is contemplated that the tracking device 102 can handle more or less zones than as specified in Table 8. In a further embodiment, the tracking device 102 can handle more than one-hundred (100) zones. In still yet another embodiment, the number of zones is not limited to a specific maximum number. Even when the number of zones are limited, the zones can be changed as the tracking device 102 is operating, thereby providing a virtual unlimited number of zones available to monitor an individual. The number of zones portion of the zone message indicates the number of zones being defined by the message. A value of zero indicates that all zones are being deleted from memory 220 of the tracking device 102. When all of the zones are deleted, no additional information is sent or needed, and the tracking device 102 ignores any additional zone information contained in the zone message or data packet. The zone message also includes a byte that specifies the zone type, interior or exterior zone, as well as whether the coordinates for the individual zone are negative. The zone type portion of the zone message can also indicate if a warm zone perimeter is provided. In addition, bit two (2) of the zone type portion in the zone message can indicate if a reporting interval has been supplied. If no reporting interval is supplied, the tracking device 102 uses the default reporting interval stored in memory 220.

Referring to FIG. 17 and Table 8, the monitoring system 108 in the illustrated embodiment sends to the tracking device 102 upper left 1724 (northwest) and lower right 1726 (southeast) latitude/longitude coordinates. As shown, the coordinates specified by four (4) byte latitude and four (4) byte longitude integer values in 1/100,000 degree. All latitude and longitudinal values in the zone message of Table 8 are given in 1/100,000 degree integer values, but it is contemplated that this can be different in other embodiments. The zone reporting rate portion of the zone message specifies the reporting interval. If the zone type is an exterior zone, and then the reporting interval is in seconds (1–255 seconds) and if the zone type is an interior zone, then the reporting interval is in minutes (1–255 minutes). It should be appreciated, however, that the reporting interval can incorporate different lengths of time. In Table 8, the warm and tepid zone latitude and longitude perimeter distances are specified, each by 2-byte perimeter distance. If the warm perimeter distance is zero (0), then the zone does not have a warm zone. Likewise, if the tepid perimeter distance is zero (0), then the zone does not have a tepid zone. So for example, when both the warm and tepid perimeter distances are zero (0), the region only has a hot region. As should be appreciated, the above-described messages provide the desired information in a compact format so as to reduce the communication charges and/or bandwidth of communications with the personal tracking device 102. By using such a compact communication protocol, the UDP protocol can be used in these communications.

Figure 22:
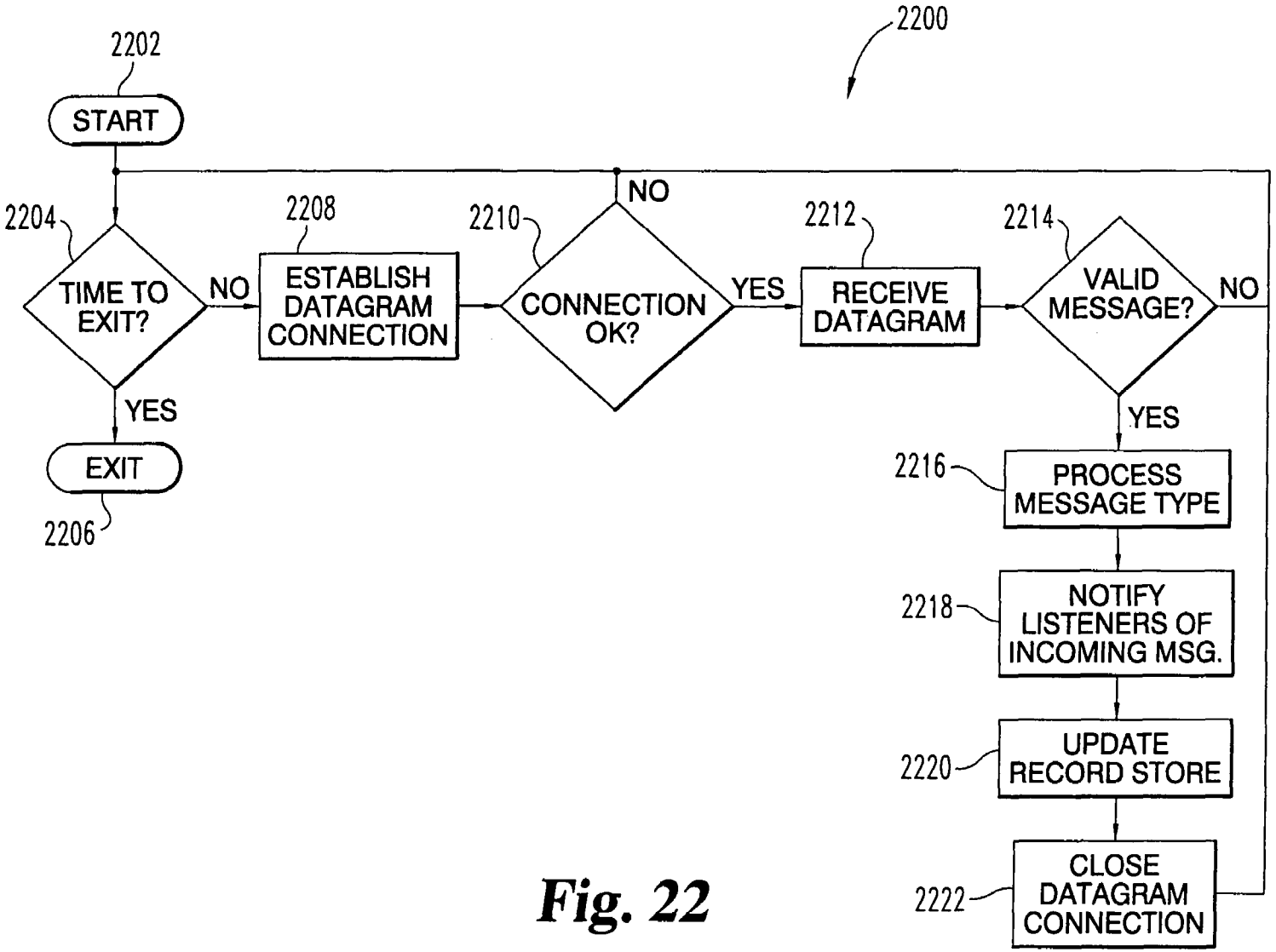
FIG. 22 is a flow diagram illustrating a technique the tracking device uses to receive incoming messages.
Figure 23:
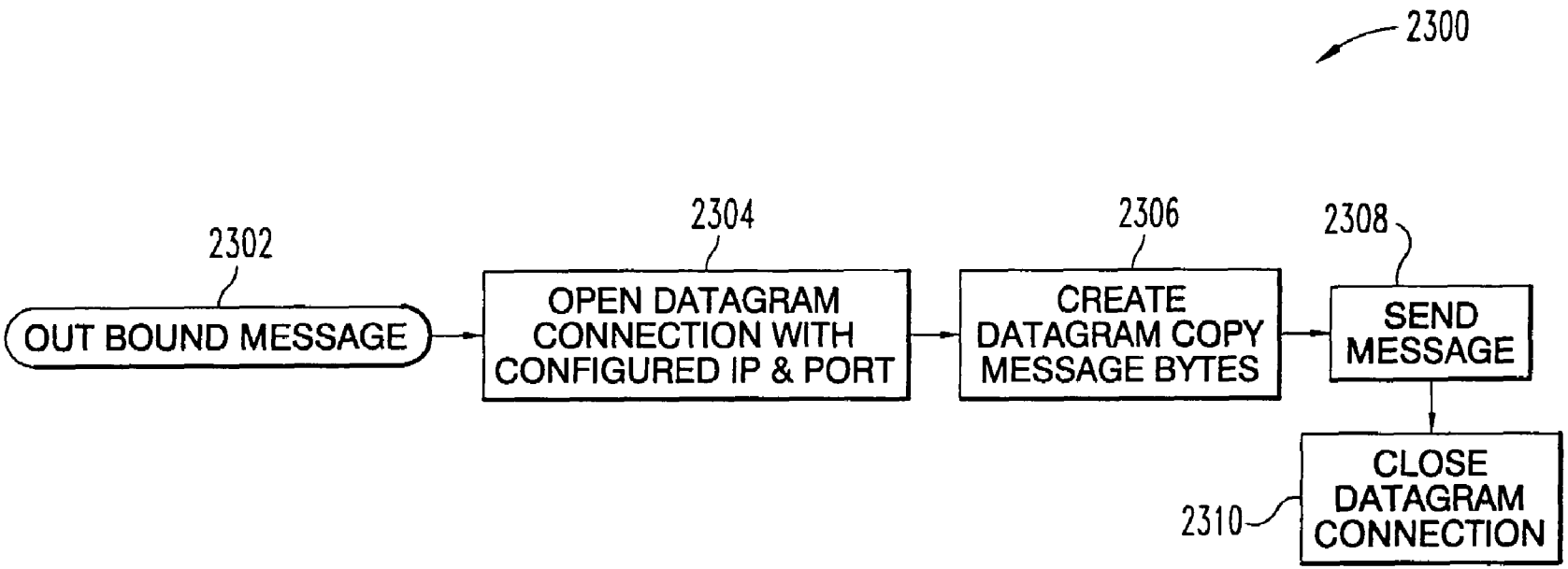
FIG. 23 is a flow diagram illustrating a technique the tracking device uses to send outgoing messages.

With the above discussion in mind, the server handler thread that runs on the processor 218 of the tracking device 102 will now be described with reference to FIGS. 22 and 23. Flowchart 2200 in FIG. 22 illustrates a technique in which the server handler thread receives and processes an incoming message from the monitoring system 108. After initializing in stage 2202, the server handler thread in stage 2204 determines whether or not to shut down. In stage 2204, if the exit value equals true (FIG. 14), then the server handler thread shuts down in stage 2206. Otherwise, the server handler thread establishes a datagram connection in stage 2208. As shown in flowchart 2200, the server handler thread loops continuously looking for incoming messages. The service handler thread in stage 2208 opens a datagram connection and blocks (the operating system waits for incoming bytes) until bytes are available to read. In stage 2210, the server handler thread determines whether or not an adequate connection has been established. When an adequate connection has not been established, the server handler thread returns to stage 2204 so as to re-establish a connection in stage 2208. If the connection is adequate, the personal tracking device 102 receives the message or datagram in stage 2212. The status handler thread determines whether or not a valid message has been received in stage 2214. If the message is invalid, the server handler thread proceeds to stage 2204. A message may be invalid for a number of reasons including if the message contains the wrong identification information. For example, the message can be invalid when it contains the wrong PID identifier (PID ID) in the message header. As described above with respect to Table 3, the incoming messages contain a message ID that identifies the type of message being received as well as the message type and the revision for the message. When the message is valid, the server handler thread via the processor 218 of the tracking device 102 processes the specific message type in stage 2216. As noted before, examples of different message types include configuration messages, acknowledgement messages, zone messages and the like. Upon processing the type of message in stage 2216, the server handler thread in stage 2218 notifies selected threads, such as the status handler thread, of the incoming messages in the tracking device 102, and the records are updated in stage 2220. For example, when a configuration message is received from the monitoring system 108, the configuration information contained in the message is stored in memory 220 in stage 2220. Afterwards, the connection is closed in stage 2222. After closing the connection, the server handler thread proceeds to stage 2204, and the cycle is repeated process other incoming messages.

A technique for sending an outbound message from the personal tracking device 102 to the monitoring system 108 will now be described with reference to flowchart 2300 in FIG. 23. The outbound message can be generated for a number of reasons such as when the status handler thread generates a status message. Once the outbound message has been generated in stage 2302, the server handler thread in stage 2304 opens a connection with the IP address and port stored in memory 220 that was previously designated during configuration of the tracking device 102. As noted above with respect to Table 5, the monitoring system 108 sends a configuration message in order to configure, among other things, the address and port of the server in the monitoring system 108 with which the tracking device 102 should communicate. After the connection is opened, a copy of the message is created in stage 2306, and in stage 2308, the message is sent to the monitoring system 108. After the message is sent, the datagram connection is closed in stage 2310. Additional outgoing messages are handled in a similar manner. As should be appreciated, both the incoming and outgoing messages in the tracking device 102 can be handled by the server handler thread in accordance with the techniques described above.

Its should be appreciated from the discussion above that the length of the packet or message can change based on the current status of a monitored individual. As described above with reference to Table 6, the packet size can be reduced by removing the GPS and status information if there are no violations and the participant remains within the same relative area for a period of time. For example, when the participant stays within say 150 feet of a location, such as within an interior region, for more than ten minutes, the tracking device 102 sends a status message that indicates no change in location, and the status message does not contain the coordinates of the monitored individual. This technique reduces the amount of data transmitted, which in turn can reduce communication costs. It is further contemplated that composite status messages can be used to conserve data space by including more than one set of GPS and status readings in one packet. This saves data space because only the one message header is sent. The composite status message can dynamically change the content and therefore, size, by using a set of configuration parameters set by the configuration message to the personal tracking device 102. From the discussion above, it should be appreciated that other types of messages can utilize the packet size reduction technique.

Figure 24:
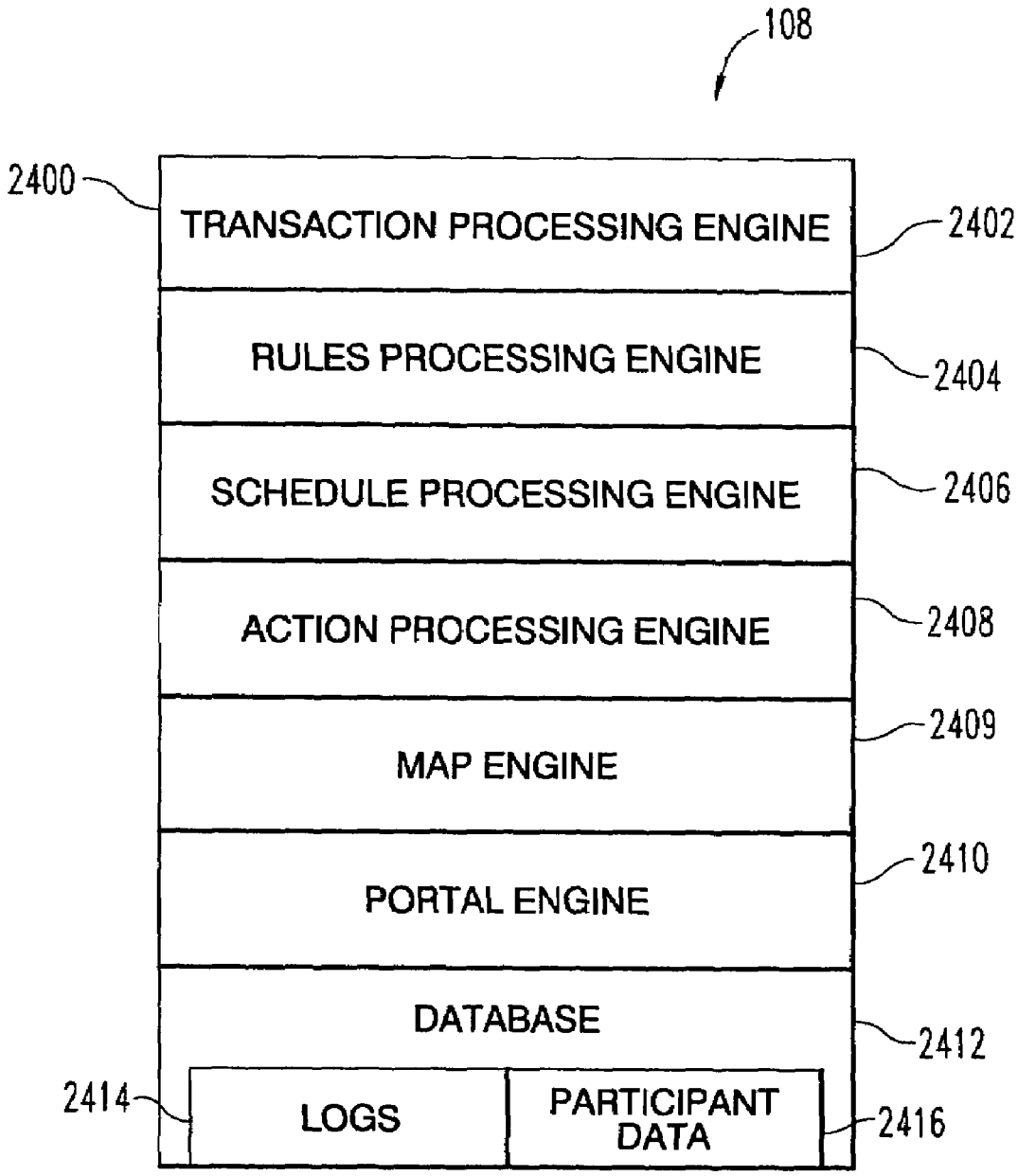
FIG. 24 is a diagrammatic view of a monitoring system according to one embodiment of the present invention.

FIG. 24 illustrates various programs 2400 that run on the processor 122 of the monitoring system 108 according to one embodiment of the present invention. These processes or programs 2400 perform another number of functions including receiving and processing incoming communications and outgoing communications with the tracking device 102, monitoring rules and alerting corrections officers or other individuals of violations of the rules. In one embodiment, the various programs are in the form of a number of engines and/or databases on the monitoring system 108. As should be appreciated, various functions of the programs 2400 can be combined with one another and/or omitted. In one form, programs 2400 are a series of threads or routines the processor 122 on the monitoring system 108 performs. As should be appreciated, these components can utilize some or all of the components of the server, such as the processor 122, memory 124, and clock 126. For example, the processor 122 is configured to execute these programs 2400, and the resulting information can be stored in memory 124.

The arrangement of these programs 2400 in FIG.24 are for discussion purposes only, and it should be appreciated that all of these components can communicate with one another, if needed. The transaction processing engine 2402 is configured to receive and process communications to and from the personal tracking device 102. The rules processing engine 2404 determines whether or not a violation has occurred. If a violation has occurred, the violation is logged in memory 124, and the violation is forwarded to the scheduled processing engine 2406. The schedule processing engine 2406 is responsible for handling any actions that are created by the rules engines, user input or created from other actions. The schedule processing engine 2406 in one embodiment acts as a background service that, at predetermined intervals, checks for actions to be processed and forwards them to action processing engine 2408. As an example, the schedule processing engines 2406 periodically checks to determine if a tracking devices 102 has sent a status within the required time period. The action processing engine 2408 is responsible for processing each action that is sent to it. For instance, these actions can come in the form of messages sent from corrections officers, two-way text messages sent to monitored individuals, faxes, emails, checks for lost communications, creation of new actions, checking for the receipt of messages, scheduling reporting actions, and the like. Map engine 2409 is used locate a monitored individual, and portal engine 2410 provides a user interface for access by the administrator 110, either locally and/or across the network 106. The portal engine 2410 also provides access to the monitoring system 108 by other users such as corrections officers, for example. Database 2412 is used for the storage and retrieval of information from memory 124 in the monitoring system 108. In the illustrated embodiment, the database 2412 includes logs 2414 and participant data 2416. The logs 2414 can include error logs, communication logs, as well as other types of logs generally known to those skilled in the art. The participant data 2416 includes information that identifies the participant or monitored individual as well as historical information related to past violations and other information relating to the participant. In one form, each monitored individual is identified in the participant data 2416 of the database 2412 via the PID ID of the PID 132 that is sent in the header of each message (Table 3). According to one embodiment, the database 2412 includes a relational database, but it is contemplated that the database 2412 can include other types of data storage and retrieval systems.

Figure 25:
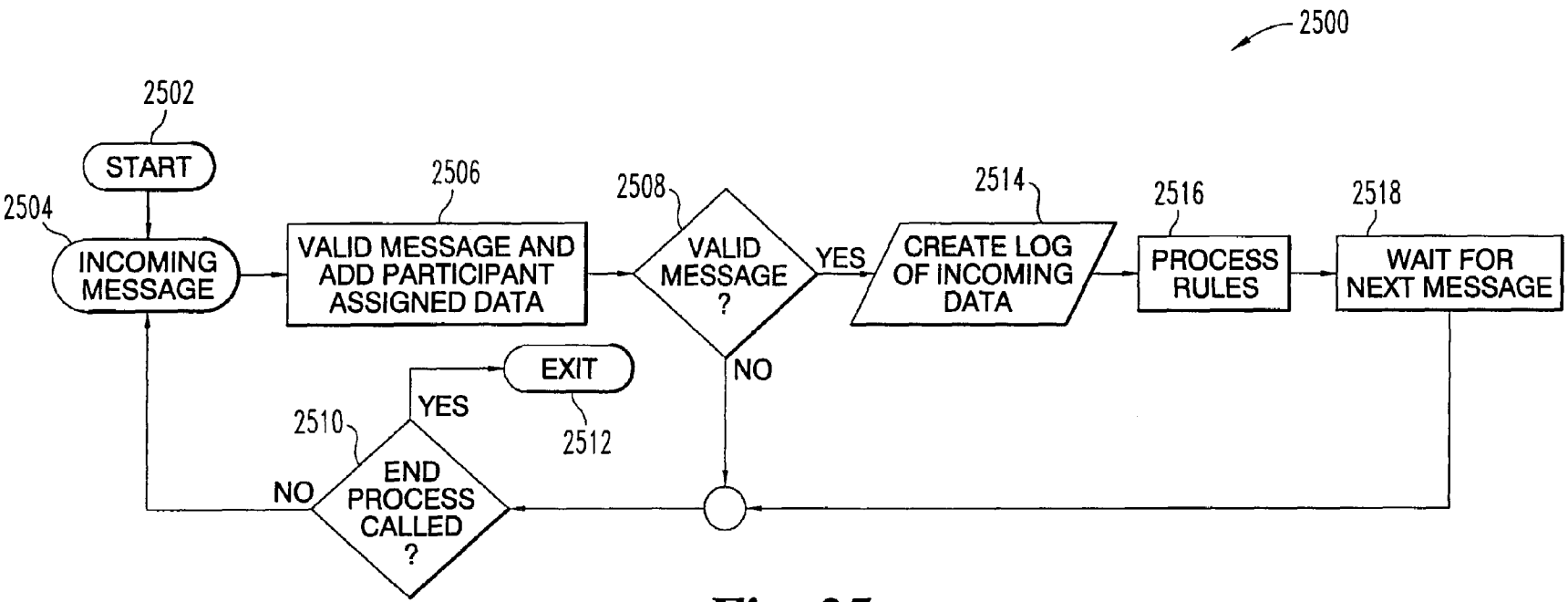
FIG. 25 is a flow diagram illustrating a technique for processing incoming messages with the monitoring system.

A technique that the transaction processing engine 2402 uses to process incoming messages according to one embodiment of the present invention will now be described with reference to flowchart 2500 and FIG. 25. After the transaction processing engine 2402 is started in stage 2502, the processor 122 of the monitoring system 108 monitors for incoming messages from one or more of the tracking devices 102 in stage 2504. Next, the transaction processing engine 2402 adds the participant data to the participant data 2416 in the database 2412 and checks to see if the message is valid in stages 2506 and 2508. An incoming message can be invalid for a number of reasons. For instance, an incoming message can be invalid when the PID ID in the message header does not match a valid PID ID in the participant data 2416. If the incoming message is not valid in stage 2508, the monitoring system 108 checks to see if a shut-down or end process is called in stage 2510. If an end of process has been called, the transaction processing engine 2402 is shut down in stage 2512. Otherwise, the server via the transaction processing engine 2402 continues to monitor incoming messages in stage 2504. Referring again to stage 2508, if the message is valid, the monitoring system 108 in stage 2514 updates the logs 2414 with the incoming data. The monitoring system 108 processes the rules via the rules processing engine 2404 in stage 2516 in order to determine if a violation has occurred. In stage 2518, the monitoring system 108 waits for the next incoming message, and checks to see if the transaction processing engine 2402 should shut down in stage 2510. The transaction processing engine 2402 continues to monitor for and handle incoming messages until an end of process is called in stage 2510.

Figure 26:
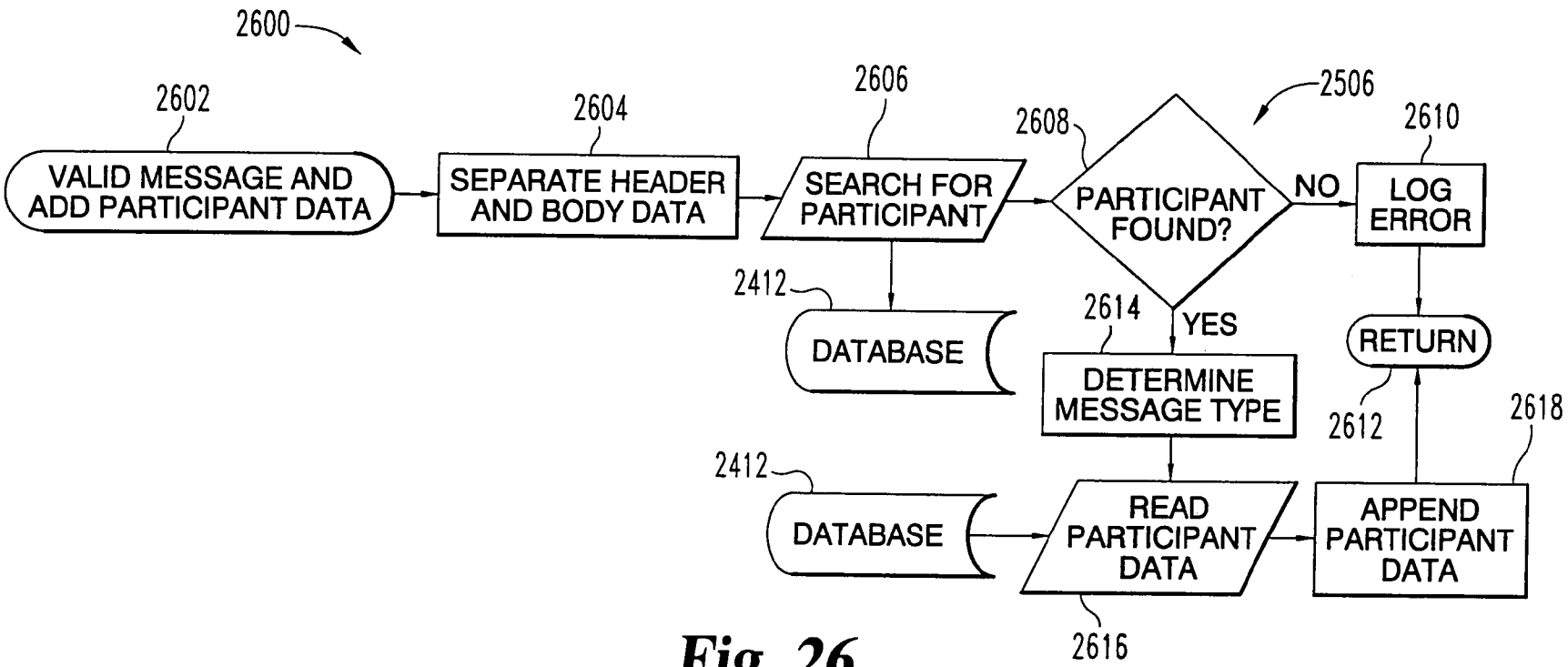
FIG. 26 is a flow diagram illustrating a technique for validating incoming messages with the monitoring system.

A technique the transaction processing engine 2402 utilizes to determine the validity of the incoming message in stage 2506 is illustrated with flowchart 2600 in FIG. 26. When the validate message and add participant data subroutine is called in stage 2602 (stage 2506 in FIG. 25), the processor 122 of the monitoring system 108 separates the header information from the body of the message in stage 2604. As previously mentioned with respect to Table 3, each message header contains the message type as well as the PID ID of the PID 132, which is unique to the monitored individual. When the monitored individual is a victim or an at risk individual, their device 120 can have or be assigned a unique device identifier to substitute for the PID ID in the message header. In one form, the participant data 2416 in the database 2412 is indexed by the PID ID or other device identifiers. In stage 2606, using the PID ID from the message header, the transaction processing engine 2402 locates a participant in the database 2412. In stage 2608, the processor 122 of the monitoring system 108 determines whether or not the participant was found in the participant data 2416. If no participant is found, an error log is generated in log 2414 of the database 2412 in stage 2610. As previously mentioned, the database 2412 maintains a number of logs 2414 including an error log that tracks errors within the monitoring system 108. After the error log is generated, in stage 2612, the subroutine returns to stage 2508 (FIG. 25). Referring to Table 3, if a valid participant is found in the database 2412 in stage 2608, the processor 122 of the monitoring system 108 determines the type of message received from the message header in stage 2614. Based on the participant information and the message type, the monitoring system 108 in stage 2616 reads the relevant participant data 2416 from the database 2412 and appends the new data from the message to the participant data 2416 in stage 2618. For example, when the type of message is a status message that contains the current location of a participant, the monitoring system 108 adds the current location information to the participant data 2416. After updating the information, the subroutine returns to the originally called program in stage 2612.

As mentioned above, the monitoring system 108 in stage 2604 separates the header from the body of the incoming message. A technique for separating the header from body of the message according to one embodiment will now be described with reference to flowchart 2700 in FIG. 27. The purpose of this separate header and body data technique is to break down the header section so as to determine how the message should be processed. This is accomplished by retrieving the message type and the version of the message from the header, and the message is processed based on its type and version. As discussed in greater detail above, the type of message can include, for example, an acknowledgement message, a status message or a composite status message as well as other messages. With this technique, if the data in the message is compressed and/or encrypted, then the message is decompressed and/or decrypted.

Figure 27:
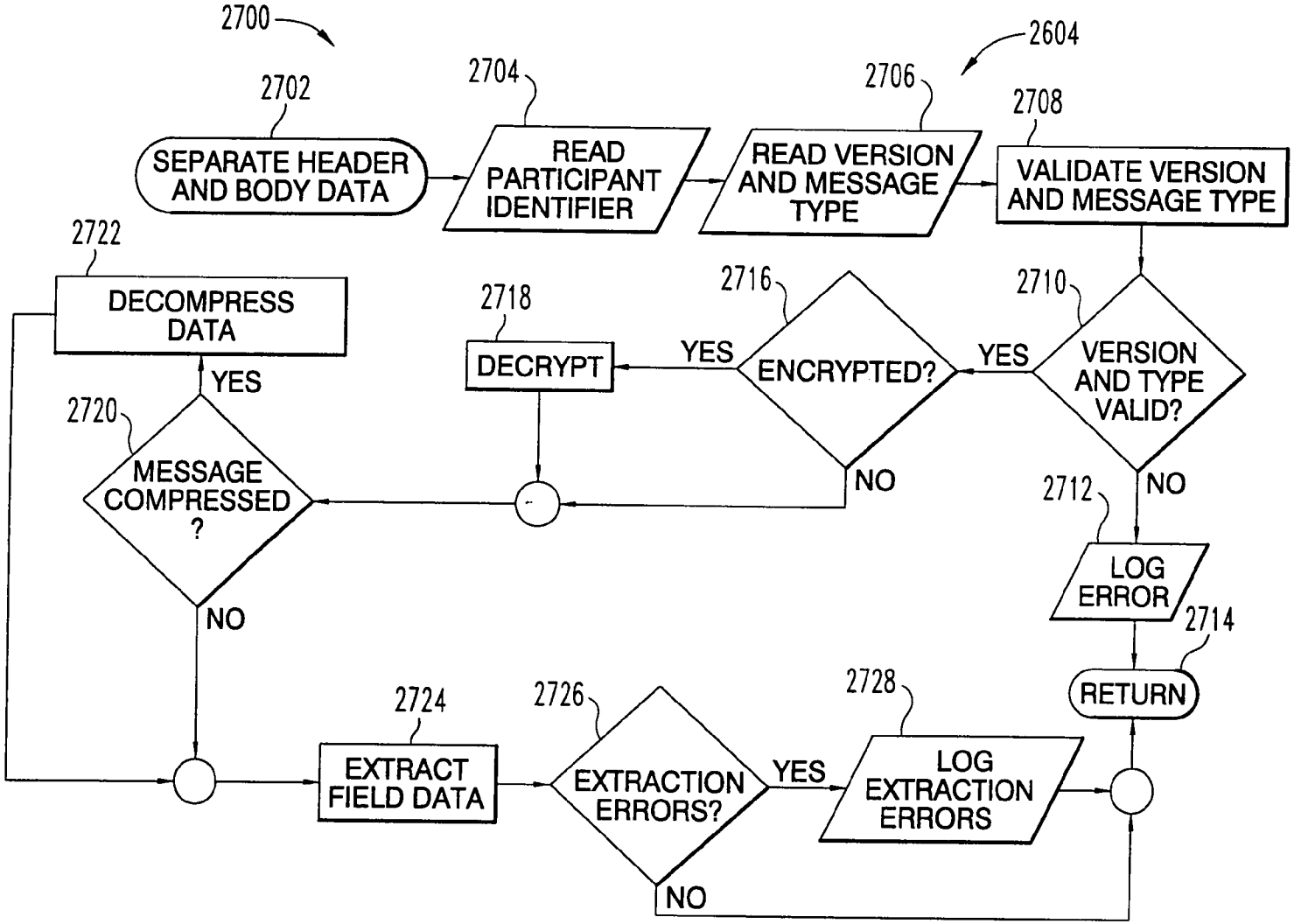
FIG. 27 is a flow diagram illustrating a technique for separating header and body information of the incoming messages with the monitoring system.
Figure 28:
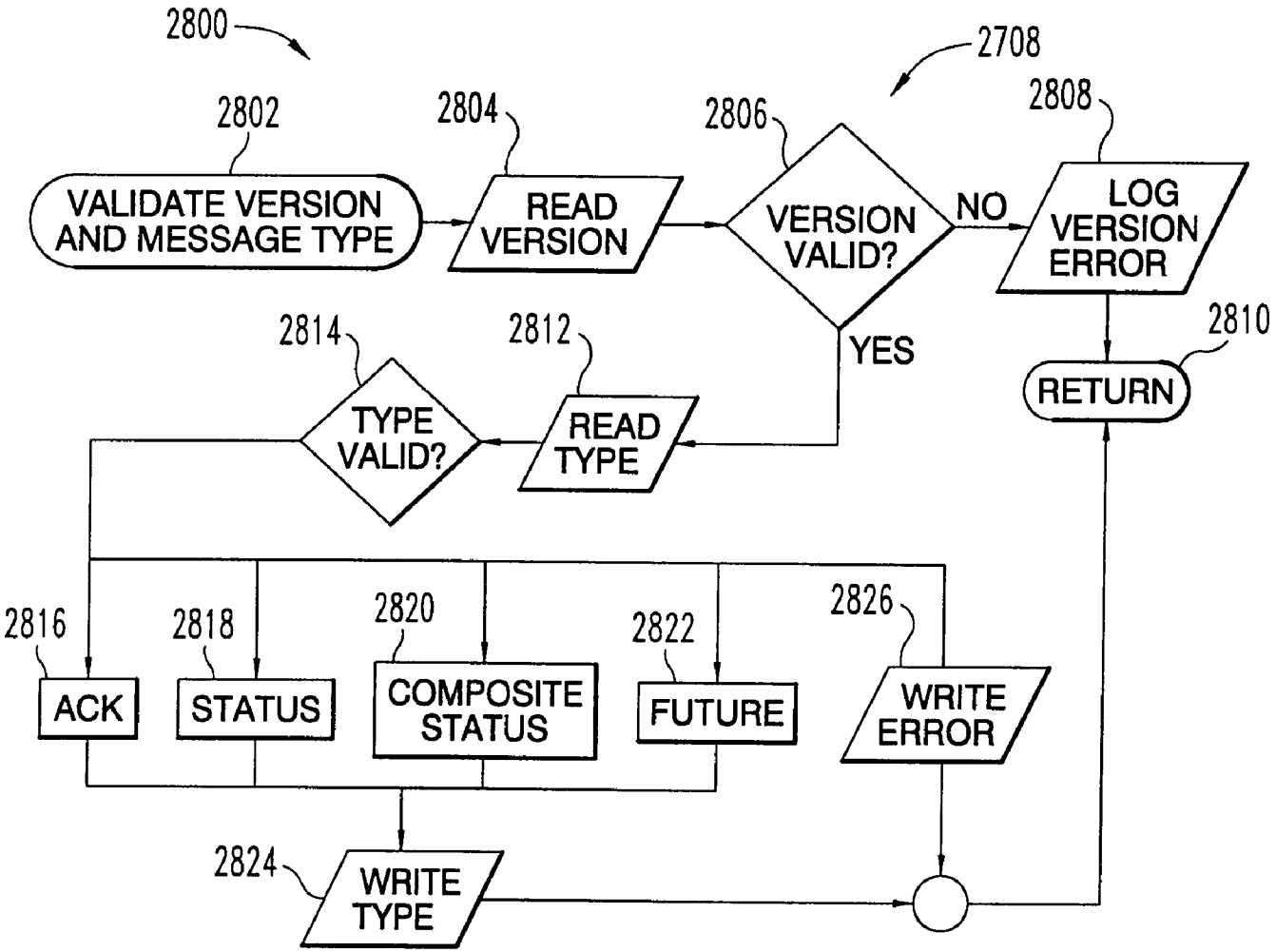
FIG. 28 is a flow diagram illustrating a technique for validating the version and message type of the incoming message.

As illustrated in FIG. 27, when the separate header subroutine is called in stage 2702, the processor 122 of the monitoring system 108 reads in stage 2704 the participant identifier, which for example can be the PID ID and/or some other identifier. Referring to Table 3 and FIG. 27, the server in stage 2706 reads the message type and version in stage 2706. After reading the version and message type, the monitoring system 108 validates the version and message type in stage 2708, based on the valid message and version types in memory 124. By validating the messages, the risk that the monitored individual will be able to circumvent the monitoring system 108 by sending false status messages as well as other types of messages is reduced. A technique for validating the version and message type will be discussed in greater detail below with reference to FIG. 28. In stage 2710, the processor 122 of the monitoring system 108 determines if the version and message type are valid. If not, the processor 122 of the monitoring system 108 generates an error log, which is stored in the logs 2414 of the database 2412. Upon generating an error log, the subroutine returns to the calling routine in stage 2714. When the version and type of message are valid in stage 2710, the processor 122 of the monitoring system 108 determines if the body of the message is encrypted in stage 2716, and if encrypted, the monitoring system 108 decrypts the message in stage 2718. Once the message is decrypted or if the original message was not encrypted, the monitoring system 108 in stage 2720 checks to see if the data in the message is compressed, and if compressed, the processor 122 in stage 2722 decompresses the data in the message. The now decompressed or the originally decompressed data in the message is extracted for use in stage 2724. For example, when a status message is received, the monitoring system 108 can extract the location coordinates and battery voltage information from the status message in stage 2724 (Table 6). The monitoring system 108 checks for extraction errors in stage 2726 and if errors exist, the errors are recorded in an error log in the database 2412 in stage 2728. If no extraction errors occur, the subroutine simply returns to stage 2714.

As mentioned above, the monitoring system 108 in stage 2708 validates the version and type of message in stage 2708. A technique or subroutine for validating the version and type of message will now be described with reference to flowchart 2800 in FIG. 28. After the subroutine is called in stage 2802, the message version is read in stage 2804 from the message header. As was discussed above with reference to Table 3, the message header includes the message version. In stage 2806, the monitoring system 108 determines if the message version is valid based on the valid message versions maintained in memory 124. If the message version is not valid, then the monitoring system 108 logs in the logs 2414 of the database 2412 the version error in stage 2808, and the subroutine returns to the calling routine in stage 2810. If in stage 2806 the version is valid, the monitoring system 108 reads the message type from the header in stage 2812. The monitoring system 108 determines if the type of message is valid in stage 2814. If the message is an acknowledgement message (stage 2816), a status message (stage 2818), a composite message status (stage 2820), or another type of message (stage 2822), the processor 122 of the monitoring system 108 writes into memory 124 the particular message type in stage 2824. If the message type does not fall into one of the designated categories, a write error is recorded in the database 2412 in stage 2826. Subsequent to stages 2824 or 2826, the subroutine of FIG. 28 returns to the calling routine in stage 2810.

Referring again to FIG. 25, the rules processing engine 2404 in stage 2516 processes the incoming message to determine if a rules violation occurred. A technique that the rules processing engine 2404 uses in processing rules is illustrated with flowchart 2900 in FIG. 29. The evaluate rule subroutine determines the correct rule to process for a given message. With this technique, rules for the monitored individual or participant are sorted by priority and evaluated in order based on their priority. To reduce the workload on the processor 122, the monitoring system 108 organizes the rules so that redundant rules are eliminated. For instance, selected rules can be inclusive of one another, that is a child rule is a subset of a parent rule. By designating rules being inclusive of one another, child rules are only processed if their parent rules are processed. Additionally, rules that are mutually exclusive are eliminated during the evaluation process. An example of mutually exclusive rules would be two interior regions that cover different territories. So for example, a monitored individual can have an interior region rule that is specifically created for a doctor's appointment and an interior region rule that covers the monitored individual's home (and not the doctor's office) in most circumstance. The doctor's appointment rule is given a higher priority than the home interior region rule so that the doctor's appointment rule is evaluated first. If the monitored individual attends the doctor's visit at the appropriate time, then the home interior region rule is not evaluated. Further, rules can be assigned an effective date and time. If the rule is not within a given date range, then the rule is not processed. Table 9, below, provides an example of a table structure for rules stored in the participant data 2416 of the database 2412.

group of participants in one embodiment is identified through the PID ID. In stage 2906, the rules are sorted by their priority. The highest priority rules are processed before the lower priority rules. After the rules are sorted in stage 2906, the rules processing engine 2404 determines if the rules to be processed are greater than zero in stage 2908. If so, the rule is evaluated in stage 2910, and the monitoring system 108 continues evaluating the rules until all of the rules for the participant have been processed in stage 2908. Upon processing all the rules, the evaluate rules subroutine returns to the calling routine.

A technique for evaluating rules in stage 2910 will now be described with reference to flowchart 3000 in FIG. 30. In addition to being initiated (stage 3002) when a message is processed in stage 2910, the monitoring system 108 can initiate the evaluate rules subroutine of FIG. 30 on a periodic basis via the schedule processing engine 2406 in order to monitor for time violations. For example, the monitoring system 108 in one embodiment periodically determines if a status check message has been received from one or more of the tracking devices 102, and if the status message has not been received within a designated time frame, the monitoring system 108 generates an action, such as an alarm, to handle the violation. Nevertheless, it should be appreciated that the evaluate rules subroutine can be initiated in other situations.

Figure 30:
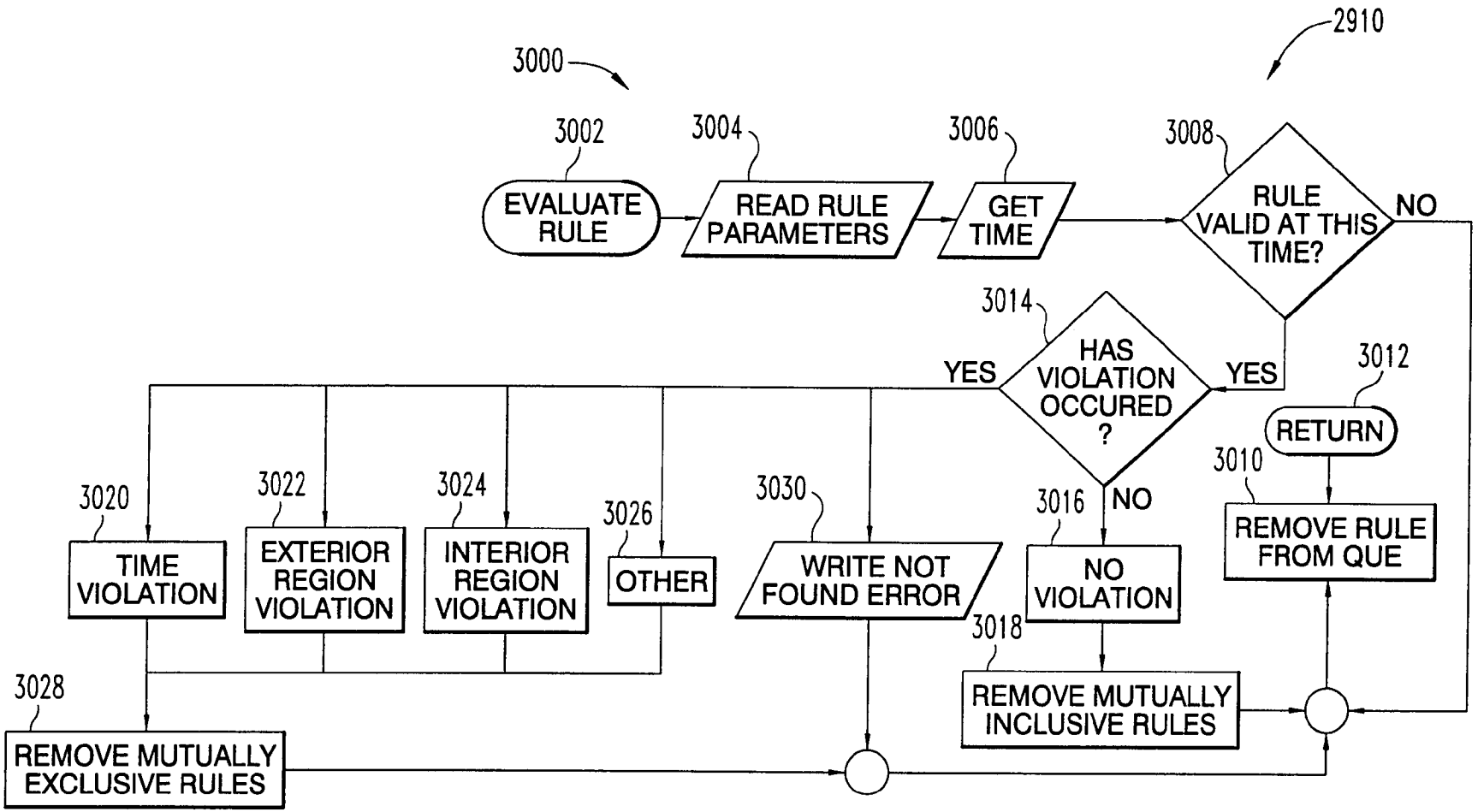
FIG. 30 is a flow diagram illustrating a technique for evaluating rules with the monitoring system.

With reference to FIG. 30, after the evaluate rules subroutine is initiated in stage 3002, the processor 122 of the monitoring system 108 reads the rule parameters from the

TABLE 9

| Rule ID | PID ID(s) | Priority | Start Date/ Time | End Date/ Time | Rule/ Zone Type | Zone Upper Left Coordinates | Zone Lower Right Coordinates | Inclusive Rule ID | Exclusive Rule ID | Action |
|---|---|---|---|---|---|---|---|---|---|---|
| 1 | 123 | 2 | Jan. 1, 2001 08:00 | Jan. 2, 2001 13:00 | 0000000 interior | N40° 1.000' W110° 0.000' | N40° 5.000' W111° 0.000' | Null | Null | Alarm |
| 2 | 123 | 3 | Feb. 2, 2001 11:00 | Feb. 5, 2001 22:00 | 0000000 interior | N40° 1.000' W110° 0.000' | N40° 7.000' W110° 5.000' | 1 | 3 | Alarm |
| 3 | 456, 789 | 4 | Feb. 2, 2001 11:00 | Feb. 5, 2001 22:00 | 0000001 exterior | N36° 3.240' W112° 8.340' | N36° 3.640' W112° 9.120' | Null | 2 | Email |

In Table 9, the rules are identified based on a rule identifier or "Rule ID" field, and a monitored individual or a group of monitored individuals to which the rule applies is designated in the "PID ID" field. The order in which rules are evaluated is designated by the "Priority" field, and Table 9 also specifies the effective date and time for the rules. As should be appreciated, the "Rule/Zone Type" field (i.e., interior or exterior region) in Table 9 is specified in the same manner as discussed above with reference to Table 8. Likewise, the upper left and right coordinates for the zones can be designated in a manner similar to the coordinates of Table 8. Parent-child relationships for inclusive rules are designated with the "Inclusive Rule ID" field, and rules that are exclusive of one another are defined with the "Exclusive Rule ID" field. The "Action" field specifies what should occur in the event of a violation of the rule. It should be appreciated that in other embodiments the rules can be structured in other manners and can include additional information and/or omit selected fields.

Figure 29:
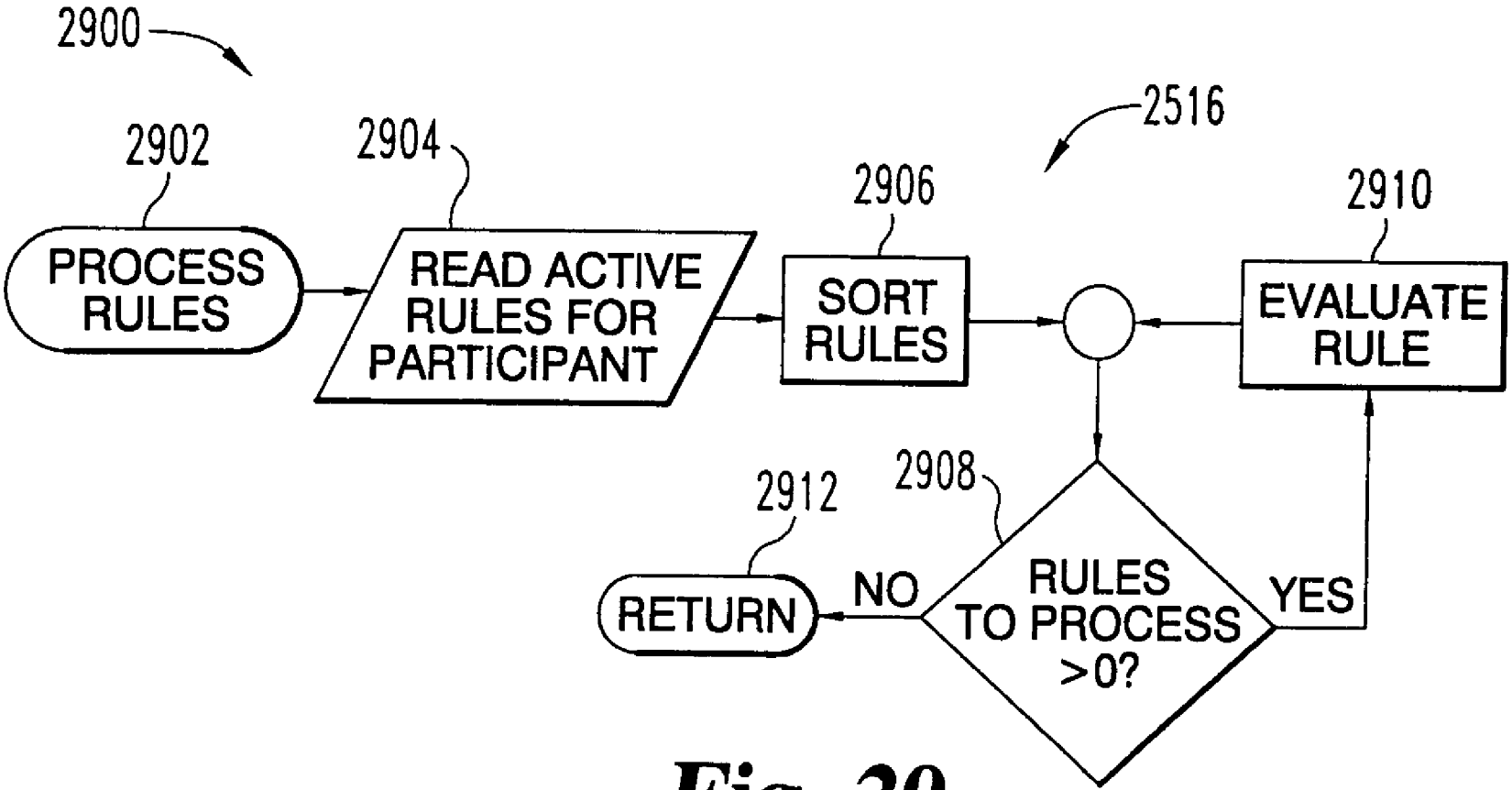
FIG. 29 is a flow diagram illustrating a technique for processing rules with the monitoring system.

With reference to FIG. 29, when the process rules subroutine is called in stage 2902, the processor 122 of the monitoring system 108 in stage 2904 reads the active rules for the participant from the participant data 2416 in the database 2412. As discussed above, the participant or a database 2412 in stage 3004. In stage 3006, the processor 122 retrieves the current date and time from the clock 126 so as to determine if the rule is valid at the present time in stage 3008. For example, a rule may require that the monitored individual be at work at a certain time during the day, and at night this rule would be invalid. If the rule is not valid at the current time in stage 3008, the processor 122 via the rules processing engine 2404 removes the rule from the stack of rules to be processed and returns to the called subroutine in stage 3012. On the other hand, if the rule is presently valid in stage 3008, the monitoring system 108 checks to see if a violation has occurred in stage 3014. If no violation has occurred in stage 3016, then the mutually inclusive rules in stage 3018 are removed from the stack of rules to be processed in stage 3010. For instance, if no violation occurred for rule ID number "1" in Table 9, then rule ID number "2" would also be removed from the stack without being evaluated. By removing the mutually inclusive rules in stage 3018, the processing workload as well as processing time is reduced on the monitoring system 108. If a violation has occurred in stage 3014, the monitoring system 108 determines what type of violation has occurred. In stage 3020, time violations are evaluated. Time violations, for example, include failures to receive status messages and other messages from the tracking device 102 in predetermined time period. It is contemplated that other type of actions can have time violations in stage 3020. In stage 3022, exterior region violations are processed, and interior region violations are processed in stage 3024. Other types of violations are evaluated in stage 3026. After processing the violations of stages 3020, 3022, 3024 and 3026, rules that are mutually exclusive to the violated rule are removed from the stack of rules to be evaluated in stage 3028. If the violation type cannot be determined or found, a write not found error is written into the logs 2414 in stage 3030. Subsequent to stages 3028 and 3030, the evaluated rule is removed from the stack of rules to be evaluated and the subroutine returns to the calling routine in stage 3012.

Figure 31:
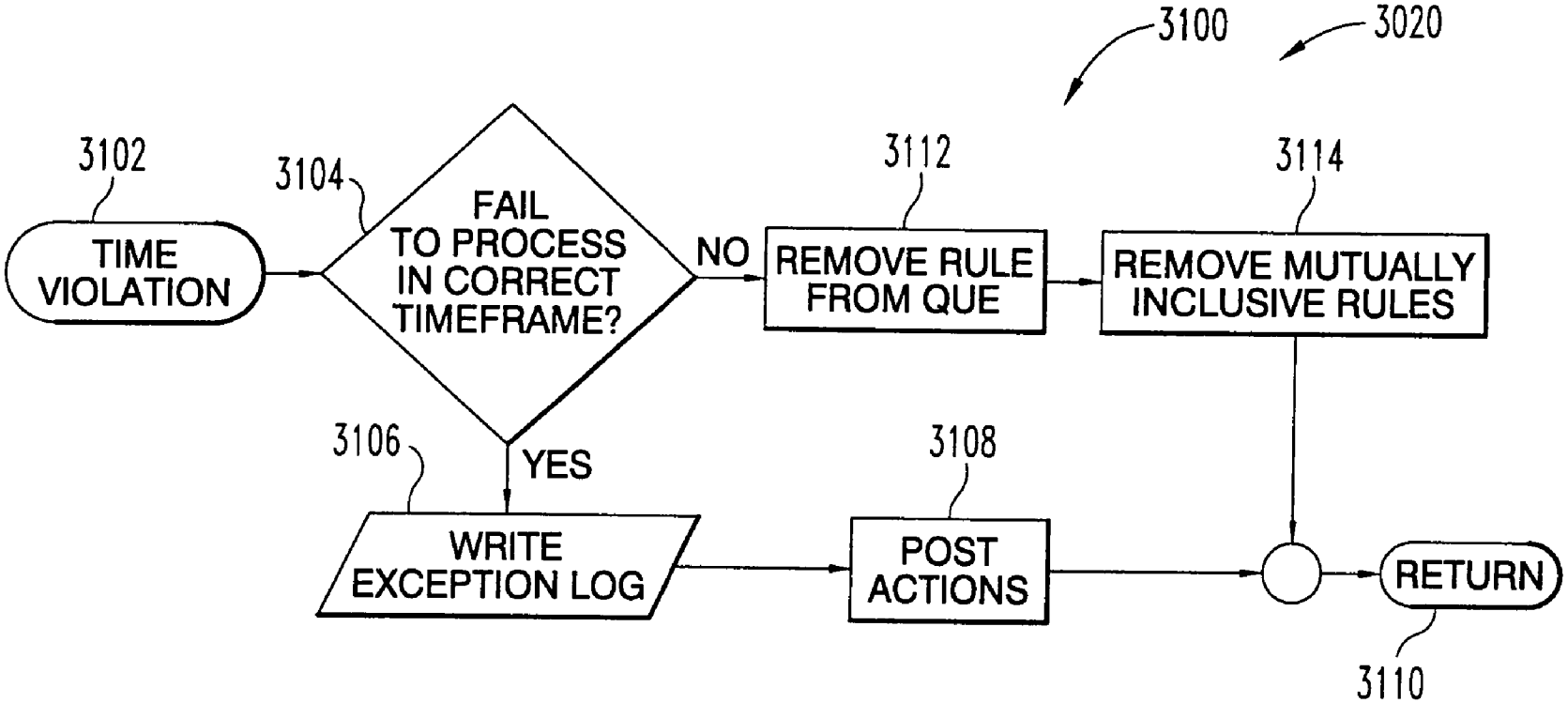
FIG. 31 is a flow diagram illustrating a technique for evaluating time based rules with the monitoring system.

In FIG. 31, a technique for evaluating a time violation in stage 3020 is illustrated with flowchart 3100. As mentioned above, time violations can also be evaluated in other circumstances. After the time violation subroutine has been initiated in stage 3102, the processor 122 of the monitoring system 108 checks to see if a rule has failed to process in the correct time frame in stage 3104. For example, after a status message is received from a tracking device 102, the monitoring system 108 stores a rule in the database 2412 that the monitoring system 108 must receive the next status message from the tracking device 102 within a predetermined time period, such as within a half hour. If the tracking device 102 fails to report within the specific time frame, the monitoring system 108 in stage 3106 writes into the logs 2414 of the database 2412 that an exception or violation has occurred in stage 3106. In the logs 2414, exceptions or violations can be designated as being "open", that is the violation not been addressed, or "closed", that is the violation has been handled. Returning to the previous example, when the tracking device 102 fails to report in a timely fashion, the monitoring system 108 creates an exception log entry that has an open status. Once the problem is addressed (i.e., the corrections officer apprehends the monitored individual), the status of the log entry can be automatically or manually closed. Subsequent to stage 3106, the processor 122 of the monitoring system 108 posts an action in memory 124 in stage 3108 and returns to the calling routine in stage 3110. As mentioned above, the action processing engine 2408 handles the processing of the posted actions along with the schedule processing engine 2406. Actions, for example, can include sending a message, such as sending a text, fax or email message, creating other actions, creating log entries, evaluating open log entries, running reports and tracking errors, to name a few. For instance, one type of action can include sending an email to alert the appropriate authorities for a violation. Referring again to stage 3104, if the action was processed in the correct time frame, then the rule is removed from the stack of rules to be processed in stage 3112, and all rules that are mutually inclusive of the removed rule are also removed in stage 3114. After stage 3114, the subroutine returns to the calling routine in stage 3110.

As mentioned above, in addition to checking for time violations, the monitoring system 108 checks for exterior region violations in stage 3022 and interior region violations in stage 3024 (FIG. 30). A technique according to one embodiment for evaluating exterior region violations is illustrated with flowchart 3200 in FIG. 32. Once initiated in stage 3202, the processor 122 reads from the database 2412 the exterior regions associated with the particular monitored individual in stage 3204. As described above with reference to Table 9, the monitored individual is identified with a unique PID ID number that is unique to the tracking device 102. Next, the monitoring system 108 via the rules processing engine 2404 determines if the number of exterior regions to be evaluated is greater than zero (0) in stage 3206. If not, the subroutine returns to the calling routine in stage 3208. When the number of exterior regions to be evaluated is greater than zero (0), the map engine 2409 in stage 3210 maps the current location received from the personal tracking device 102 against the exterior region being evaluated in stage 3210. The rules processing engine 2404 in stage 3212 determines whether or not the current location of the personal tracking device 102 is within the exterior region. If tracking device 102 is not within the exterior region, then this exterior region rule has not been violated, and the exterior region is removed from the regions to be evaluated in stage 3214. The monitoring system 108 then evaluates the next exterior region in stage 3206. For example, referring to FIG. 17, if the individual is at home 1702, they are not within the exterior region 1712. Therefore, the monitored individual is not in violation of the exterior region rule. On the other hand, in stage 3212, if the tracking device 102 is located within the exterior region 1712, for instance near the school 1708 in FIG. 17, the rules processing engine 2404 reads the previous location of the monitored individual from the participant data 2416 in stage 3216.

In stages 3218 and 3220, the monitoring system 108 compares and determines if the previous location also violated the same exterior region 1712. If not, the monitoring system 108 records the new exterior region violation in the logs 2414. When the previous location violated the same exterior region 1712, the violation is not again recorded in the logs 2414 so as to conserve space in the database 2412 by reducing the number of duplicate log entries. Nonetheless, it is contemplated that in other embodiments every violation, including repeat violations, is recorded in the logs 2414. The log of the violations can later be used for reporting purposes in order to predict future behavior of the monitored individual.

Figure 32:
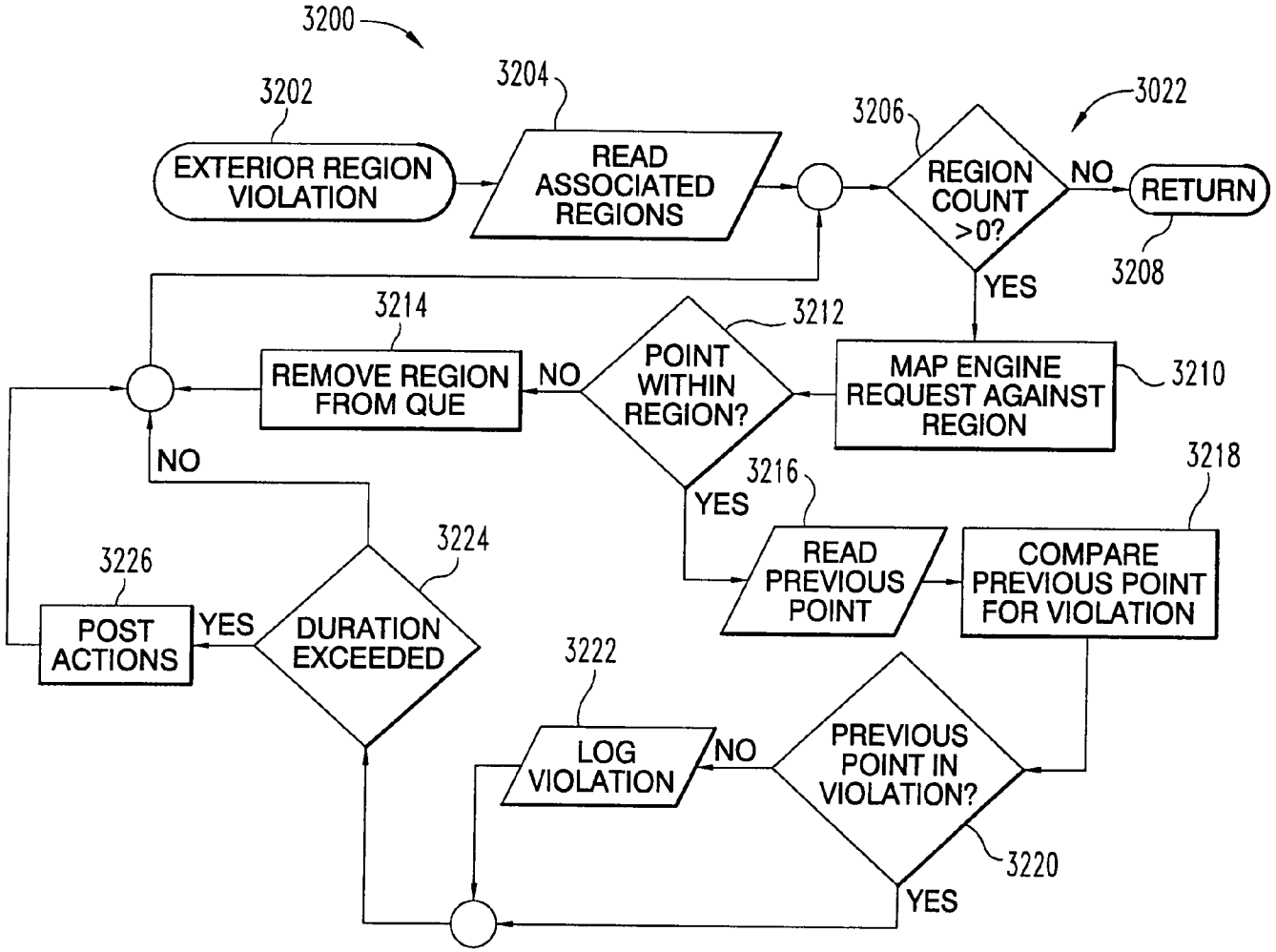
FIG. 32 is a flow diagram illustrating a technique for evaluating exterior region rules with the monitoring system.

As discussed in detail above, a monitored individual may be allowed to be in certain regions for predetermined periods of time. For example, the monitored individual may be allowed within a warm exterior region 1718 for no longer than two (2) minutes. By permitting temporary regional violations, corrections officer and others are not constantly bombarded with incidental or stray violations. Other regions, such as hot exterior regions 1720, can be designated to have an allowable duration of zero (0) so that any violation, no matter how short, is always reported. Subsequent to stages 3220 and 3222, the rules processing engine 2404 determines in stage 3224 whether the duration limit for the region has been exceeded, and if so, the monitoring system 108 posts an action to address the violation, such as sending an alert to the appropriate official. In stage 3224, if the duration limit has not been exceeded, such that the violation is incidental, no action is posted. After stages 3226 and 3224, the exterior region 1712 remains in the stack of exterior regions to be analyzed, and the monitoring system 108 continues the evaluation of the region in stage 3206, until the monitored individual moves outside the exterior region 1712. As should be appreciated, the exterior region subroutine continues until all of the regions have been evaluated. It should be understood that at least some of the stages described above can be ordered differently and/or selected stages can be omitted. For example, the duration determination stage 3224 can occur before or during the stages in which the previous and current locations are compared. The technique of FIG. 32 gives the monitoring system 108 the ability record and track violations without having to alert the appropriate official of every minor violation. For example, if the number of messages coming into the monitoring system 108 from the tracking device 102 was more than one per minute, and each message causes a violation, each violation would result in a log entry and a notification to the corrections officer. This would create too much data to be of value and too much data for the corrections officer to process effectively.

Figure 33:
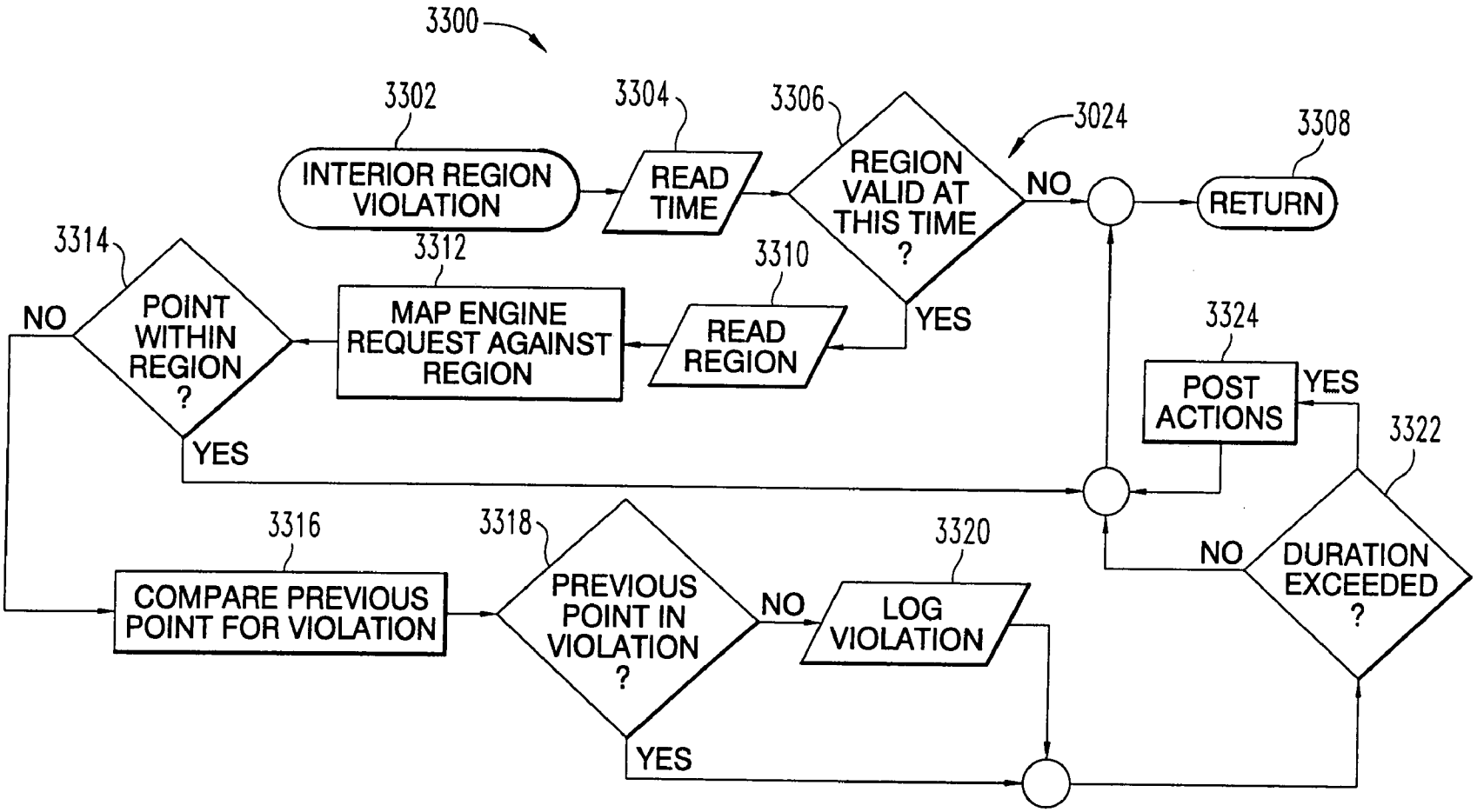
FIG. 33 is a flow diagram illustrating a technique for evaluating interior region rules with the monitoring system.

Flowchart 3300 in FIG. 33 illustrates a technique according to one embodiment for checking for interior region violations. After the interior region evaluation subroutine is initiated in stage 3302, the rules processing engine 2404 reads the current time from the clock 126 of the monitoring system 108 in stage 3304. In stage 3306, based on the current time and the PID ID of the monitored individual, the monitoring system 108 queries the database 2412 to find the one or more interior regions 1710 that are presently valid, if any exist. As noted above, the monitored individual can be restricted to a single interior region 1710 or multiple interior regions 1710. In the monitoring system 108, complexly shaped interior regions 1710 can be formed by combining multiple interior regions 1710. It should be appreciated that complexly shaped exterior regions 1712 can be formed in a similar manner. In the illustrated embodiment, multiple interior regions 1710 are evaluated at the same time, but it is contemplated that in other embodiments multiple interior regions 1710 can be evaluated in a sequential fashion. If in stage 3306 no interior regions 1710 are currently valid at the present time, the subroutine returns to the calling routine in stage 3308. When at least one interior region 1710 is valid in stage 3306, the monitoring system 108 reads information about the valid region or regions, such as their coordinates, from the database 2412. The map engine 2409 in stage 3312 maps the current location of the tracking device 102 against the interior region 1710. In stage 3314, the rules processing engine 2404 of the monitoring system 108 determines whether or not the tracking device 102 is located within the interior region 1710. When the tracking device 102 is located within the interior region 1710, no action needs to be taken because there is no violation, and therefore, the subroutine returns to the calling routine in stage 3308. Referring again to the example illustrated in FIG. 17, if the interior region 1710 around the home 1702 is valid at the time and the monitored individual is in their home 1702, then no action needs to be taken. On the other hand, when the monitored individual is located outside the interior region 1710 so that a violation has occurred, the monitoring system 108 determines if the previously reported location from the tracking device 102 was also in violation in stages 3316 and 3318. If the previous location was not outside the interior region 1710, the monitoring system 108 records the new violation into the logs 2414 in stage 3320. To conserve space in the logs 2414, when the interior region violation is a repeat violation, that is the previous location was also outside the interior region 1710, the violation is not recorded into the logs 2414. It is contemplated that in other embodiments every interior region violation can be recorded or sample of violations can be recorded.

As noted above, a monitored individual may be allowed to be in certain regions for predetermined periods of time. After stages 3318 and 3320, the monitoring system 108 in stage 3322 determines if the monitored individual has stayed outside the interior region 1710 longer than the time allowed for the interior region 1710. When the monitored individual stays outside the interior region 1710 longer than is permitted, such that the violation is not minor, the monitoring system in stage 3324 posts an action in response to the violation in stage 3324, and the subroutine returns to the calling routine in stage 3308. Otherwise, if the permitted duration is not exceeded in stage 3322, the incident is considered minor and no action is taken. The subroutine returns to the calling routine in stage 3308. It should be understood that at least some of the stages described above can be ordered differently and/or selected stages can be omitted. For example, the duration determination stage 3322 can occur before or during the stages in which the previous and current locations are compared. The technique of FIG. 32 gives the monitoring system 108 the ability record and track violations without having to alert the officials of every minor infraction.

Figure 34:
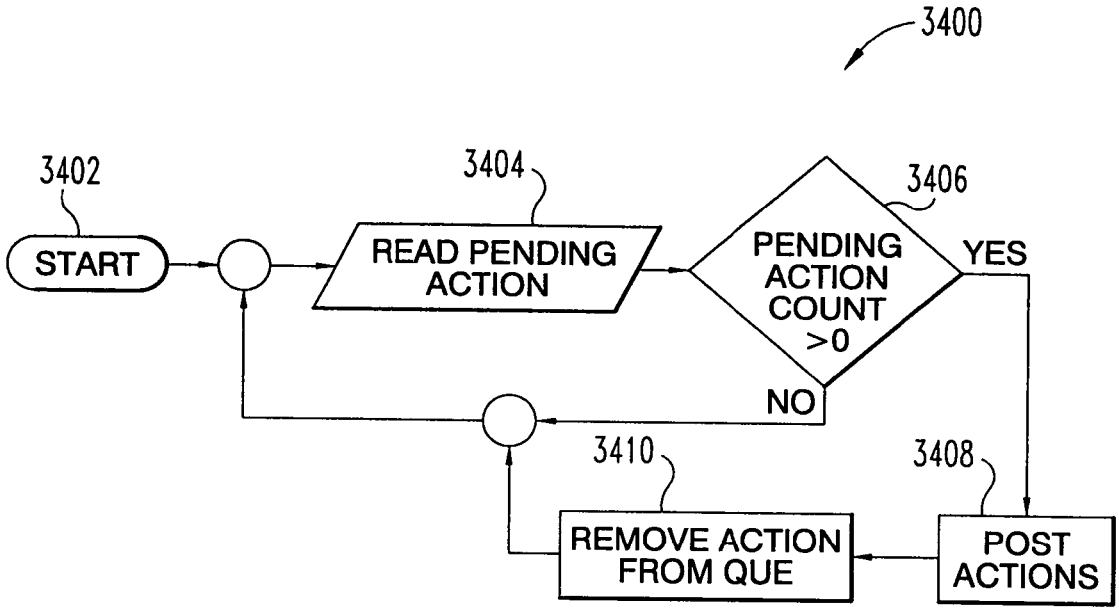
FIG. 34 is a flow diagram illustrating a technique for handling actions in the monitoring system.

As discussed above, the schedule processing engine 2406 is responsible for handling any actions that are created by the rules processing engine 2404, user input from the portal engine 2410, and/or created from another action. In one embodiment, the schedule processing engine 2406 is a background service that at predetermined intervals checks for actions to be processed and forwards them to the action processing engine 2408. A technique the schedule processing engine 2406 uses to handle actions is illustrated with flowchart 3400 in FIG. 34. It should be appreciated that the schedule processing engine 2406 in further embodiments can use other types of techniques for processing actions. Once the schedule processing engine 2406 is initiated in stage 3402, the processor 122 of the monitoring system 108 looks for and reads a pending action, if present, from memory 124. If in stage 3406 the monitoring system 108 determines that no actions are pending, the schedule processing engine 2406 will continue to monitor for pending actions in stage 3404. In contrast, when one or more pending actions are available, the schedule processing engine 2406 posts the action with the action processing engine 2408 in stage 3408. Once posted, the action is removed from the stack of actions to be processed in memory 124, and the monitoring system 108 continues to read for pending actions in stage 3404.

If the number of messages from the personal tracking device 102 and/or the monitoring system 108 becomes rather large, each message could cause a violation, each violation would result in notification of the corrections officer. This would create too much data to be of value so that the corrections officer could not process the violation effectively. To reduce the overall workload on the corrections officer, the first occurrence of a violation is checked to see if it is noise. If the violation is determined not to be noise, then the corrections officer is notified. After this notification, each additional violation is checked to see if it is a continuation of a prior violation. If it is determined that the violation is a continuation of a prior violation, then no additional messages are sent. To ensure that the violation is being handled, the active violation in one embodiment can only be closed by the corrections officer via the portal engine 2410. It is contemplated that in other embodiments active violations can be automatically closed and/or closed by others. If the violation is not closed by a specific time interval set for the specific violation, additional notifications are sent out. For instance, an additional email message may be sent out and/or a message to the supervisor of the corrections officer can be sent. Depending on the settings of the violation, additional notifications can be sent to other personnel. Even though a single notification is sent to the corrections officer, all messages from the personal tracking device 102 are logged in the database 2412 so that the corrections officer has the ability to review prior messages from the personal tracking device 102 before the violation.

Figure 35:
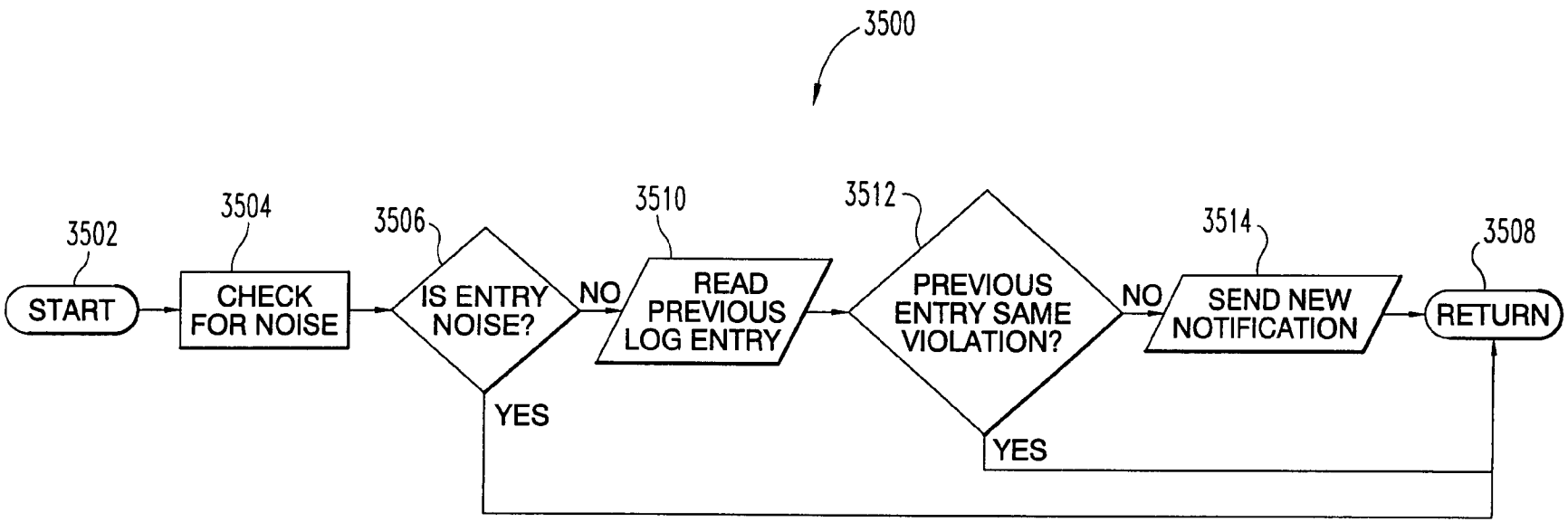
FIG. 35 is a flow diagram illustrating a technique for reducing the number of repeated violation alerts from the monitoring system.

A technique for reducing the number of messages that the monitoring system 108 sends to the corrections officer in response to violations will now be described with reference to flowchart 3500 in FIG. 35. As depicted, after the routine is initiated in stage 3502, the schedule processing engine 2406 of the monitoring system 108 checks for noise in stage 3504. Examples of noise can include, but are not limited to, receiving a location coordinate of the monitored person that in no way correlates to previous known locations, or violations that do not correspond to the current settings for the particular monitored individual. For example, if the monitoring system 108 receives from the tracking unit 102 that the monitored individual is located in China, when in fact it is know that the previous location of the monitored individual is in the United States, then the monitoring system 108 considers that entry noise. Upon determination that a particular entry is noise, the monitoring system 108 takes no action and the subroutine returns to the previously calling routine in stage 3508. If the violation entry is not noise, the monitoring system 108 reads the previous violation log entry in stage 3510 from the logs 2414 of the database 2412. In stage 3512, the schedule processing engine 2406 determines if the previous violation entry is the same as the currently processed violation. When the past and present violations are the same, to reduce the amount of messages sent to the designated individual, such as the corrections officer, the action processing engine 2408 takes no action and returns to the calling routine in stage 3508. Otherwise, when the previous violation is not the same as the current violation, the monitoring system 108 sends a new notification to the corrections officer in stage 3514 and returns to the calling routine of stage 3508.

In the event that a rule is violated, the monitoring system 108 needs to perform one or more actions via the action processing engine 2408. Actions for example can include a set of actions to be performed in the event of a violation, and the actions can also have a hierarchical structure. For instance, actions can have parent-child relationships. Also, some actions are monitored for a response. If a response does not happen within a given time, some additional or alternate action may need to be applied. There are a number of types of actions including logging, email actions, one-way text messaging, two-way text messaging, roller response actions, data forwarding, pings and stalking searches, to name a few. Log type actions generally concern logging of system access, incoming data, outgoing data, violations, and actions taken. Email type actions usually concern the sending of one or more emails to an organization or individual when a rule is violated. One-Way text message type actions involve the sending of one or more text messages to an individual in response to a rule violation or scheduled event. The one-way text message can include information about the rule or event and can include a phone number to be automatically dialed. Similarly, two-way text message type actions concern the processing of one or more two-way text messages with an individual in response to a rule violation or scheduled event. As noted above, two-way text messages can include information about the rule or event and can include a required response that will be processed back in the monitoring system 108. A roller response is an action that is triggered if a response is not received within a given time period. This action includes sending a message to a second person about the violation and/or automatically notifying the monitoring system 108 to trigger another action. Data forwarding type actions are used to forward data to another system, and ping type actions are ping requests sent to the tracking devices 102. Stalking search is a scheduled action that looks for a pattern of stalking between participants. It is contemplated that the monitoring system 108 can incorporate other types of actions.

Figure 36:
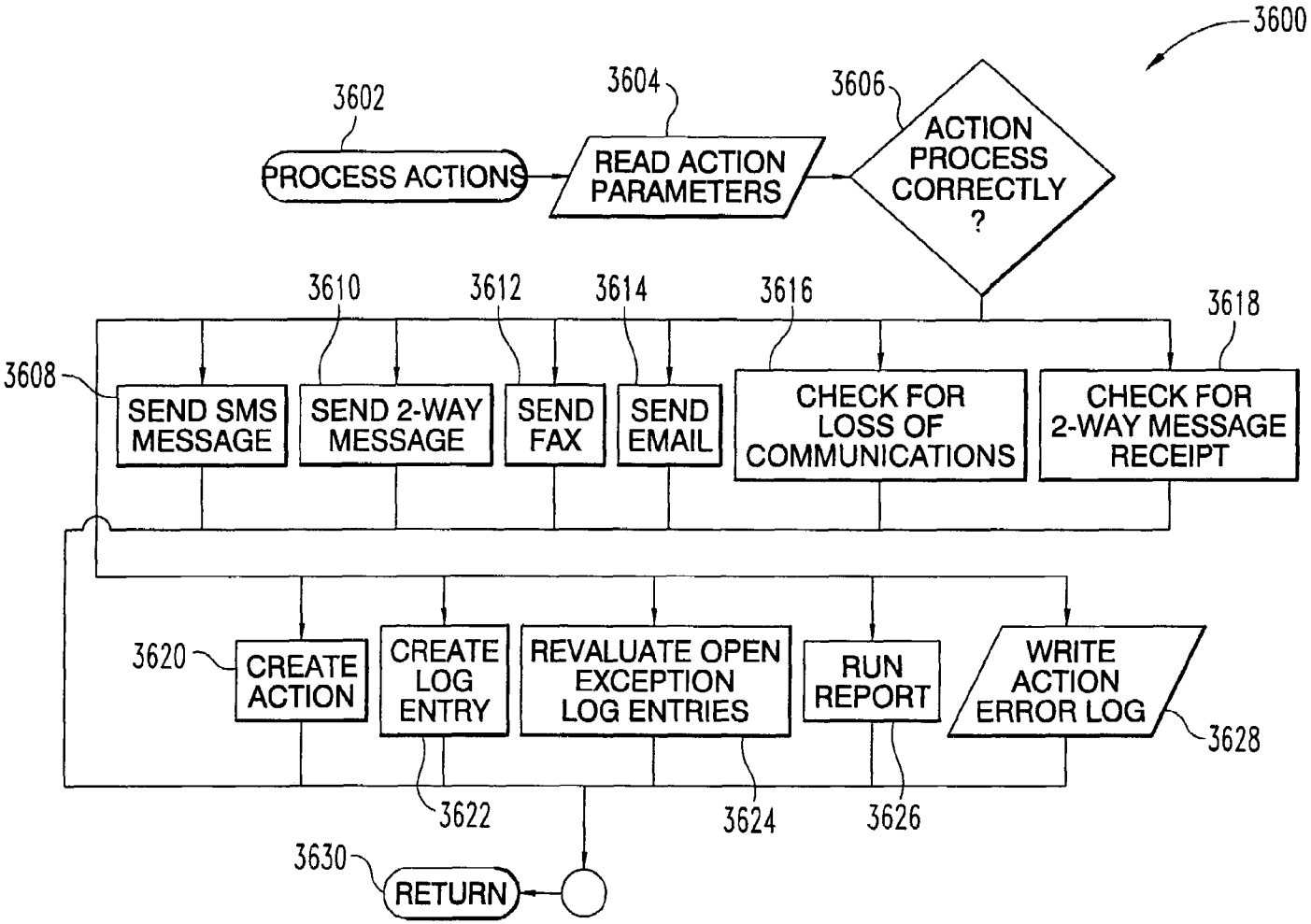
FIG. 36 is a flow diagram illustrating a technique for processing actions with the monitoring system.

A technique for processing actions that the action processing engine 2408 uses in one embodiment is illustrated with flowchart 3600 in FIG. 36. After the process action routine is initialized in stage 3602, the action processing engine 2408 reads the action parameters posted in memory 124 in stage 3604. Following stage 3604, the monitoring system 108 selects which action process to use in stage 3606. To process an action, the monitoring system 108 can use a number of different subroutines or stages. Examples of such actions include sending a message via a short message service (SMS) in stage 3608, sending a two-way text message in stage 3610, sending a fax 3612, sending an email 3614, and/or check for loss of communications 3616. Others include checking for receipt of a two-way message in stage 3618, creating an action in stage 3620, creating a log entry in stage 3622, re-evaluating open exceptions in log entries in stage 3624, running reports in stage 3626 and writing an action error log in stage 3628, among others. It should be appreciated that the action processing engine 2408 of the monitoring system 108 can process other types of actions. After processing one or more of these action entries, the action processing engine 2408 returns to the calling routine in stage 3630.

Figure 37:
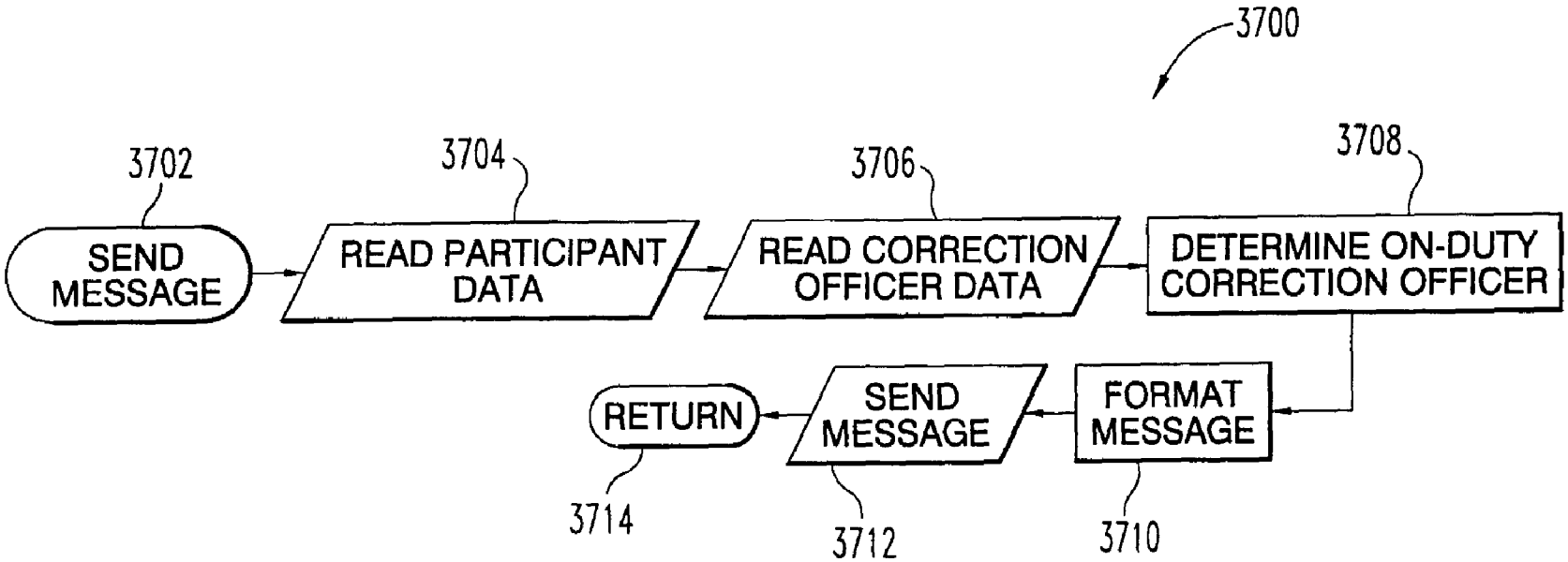
FIG. 37 is a flow diagram illustrating a technique for sending a message to an on-duty corrections officer.

As noted above, the monitoring system 108 can send messages to the tracking device 102 in a number of manners. For example, the monitoring system 108 can send text messages, two-way text messages, fax transmissions, emails, and/or voice communications over the network 106 to the tracking device 102 (FIG. 1). Furthermore, when a violation occurs, the appropriate officials, such as a corrections officer, can receive a message from the monitoring system 108 alerting them to a possible violation. A technique for sending messages from the monitoring system 108 to the tracking device 102 and/or the corrections officer is illustrated with flowchart 3700 in FIG. 37. The illustrated embodiment describes sending a message to a corrections officer. Nevertheless, the illustrated technique can be modified for sending a message to a monitored individual as well as others, such as a person with restraining order. Further, the illustrated embodiment will be described with reference to sending a simple text message (i.e., stage 3608) to a on-duty corrections officer. As should be appreciated, other types of messages can be sent in similar fashion. After the send message action is initiated in stage 3702, the monitoring system 108 reads the participant data from the database 2412. In stage 3706, the monitoring system 108 also reads information concerning the available corrections officers from the database 2412. Next, based on the time of the day or other criteria, the monitoring system 108 determines the appropriate on-duty officer or officers to contact about the violation in stage 3708. The message is formatted by the monitoring system 108 in stage 3710, and the message is sent in stage 3712 to the appropriate corrections officer. Afterwards, the monitoring system 108 returns to the routine that called the send message subroutine. As should be appreciated, other types of messages such as two-way messages, faxes, emails, voice messages, as well as other messages can be sent using the technique as illustrated in FIG. 37.

Figure 38:
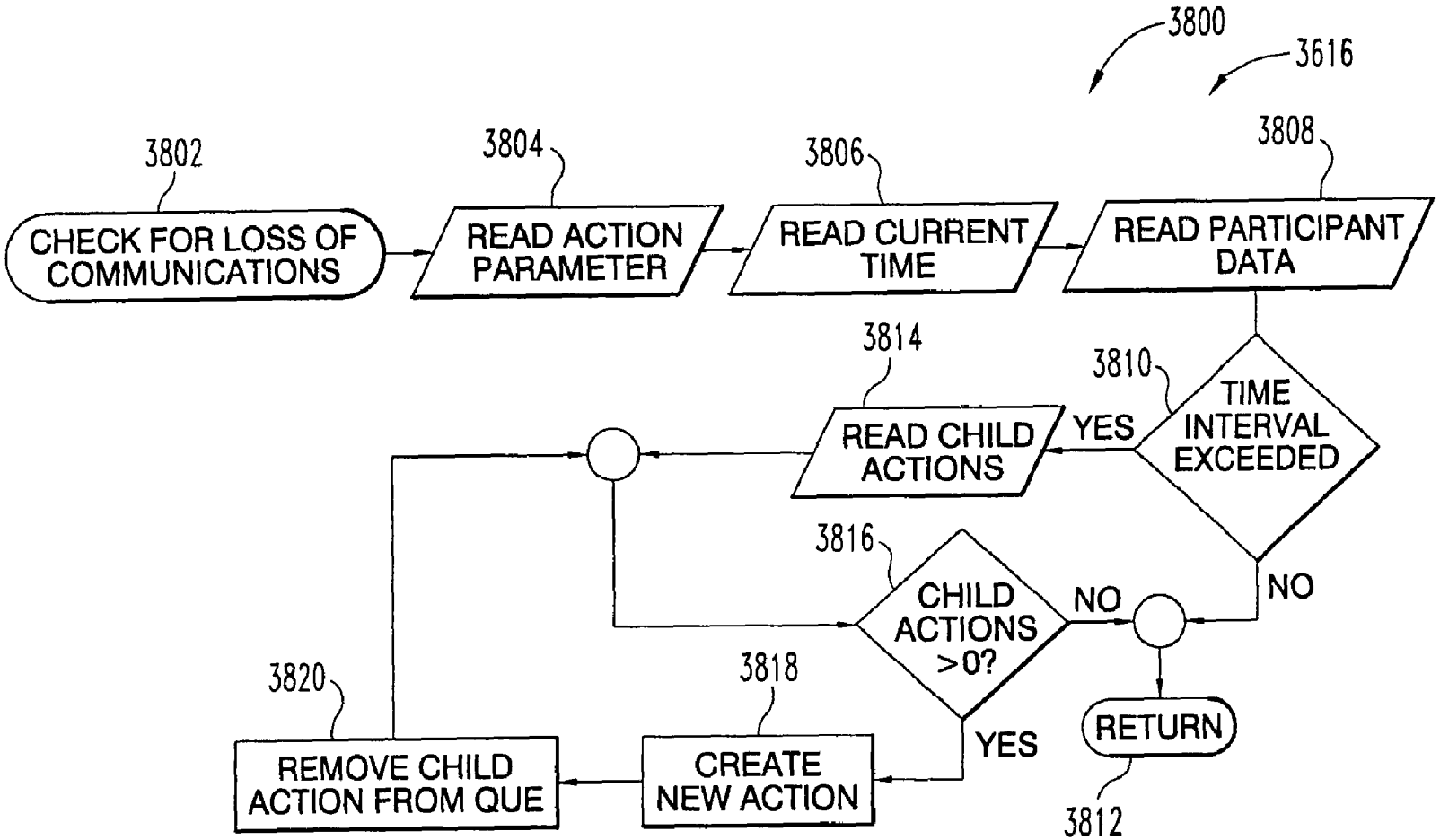
FIG. 38 is a flow diagram illustrating a technique for checking for loss of communications with the tracking device.

Referring to FIG. 38, flowchart 3800 illustrates a technique the action processing engine 2408 utilizes to determine a loss of communication in stage 3616 (FIG. 36). As previously mentioned, the monitoring system 108 periodically checks to see if the individual tracking devices 102 are still communicating their status to the monitoring system 102. If the monitoring system 108 does not receive a communication for a long time, such as greater than half an hour, it is strong indication that the monitored individual is violating the terms of their parole. However, the loss of communication can also indicate that the tracking device 102 is malfunctioning, for example the battery is drained. In any case, the appropriate officials should be alerted of the trouble. In FIG. 38, after the check for loss of communication subroutine is initialized in stage 3802, the monitoring system 108 reads the action parameter for the loss of communication action from memory 124 in stage 3804 and reads the current time from the clock 126 in stage 3806. The processor 122 of the monitoring system 108 also retrieves the participant data 2416 from the database 2412 in stage 3808. The maximum time interval allowed between messages can retrieved with the action parameters and/or the participant data. In the illustrated embodiment, the maximum time interval is defined with the action parameters and is defined as the latest time the message can be received, but it should be understood that the maximum time interval can be defined in other manners. Based on the maximum time interval and the current time, the processor 122 of the monitoring system 108 determines if the time interval for the particular action perimeter has been exceeded in stage 3810. If not, the action processing engine 2408 returns to the originally called routine in stage 3812. If the time interval between communications has been exceeded, the processor 122 reads any child actions that are required in stage 3814. As mentioned above, actions can have a hierarchical structure, such as parent-child relationships, and actions can exist in groups or by themselves. Actions can be assigned to a parent action and are performed automatically if the parent action is called. As an example, a check for loss of communication action can have send message to corrections officer action and a ping the tracking device 102 action as a child action. In the technique illustrated with flowchart 3800, the child actions are processed in a sequential fashion. If in stage 3816 no child actions are available, then the subroutine returns to the originally called routine in stage 3812. Otherwise, the monitoring system 108 creates a new action in stage 3818 and deletes the previous child action from the stack of child actions to be processed in stage 3820. The routine continues until all the child actions have been processed. Referring again to the previous example, if the send message to corrections officer action had a higher priority than the ping action, then a message to the corrections officer would be sent before a ping message is sent to the tracking device 102.

As discussed above, one of the many benefits of the monitoring system 108 according to the present invention is that it provides the ability for communications between the corrections officers and the monitored individuals in a real time basis. This real time communication capability gives corrections officers the ability to quickly remedy situations. In addition, all communications are logged by the monitoring system 108, and the monitoring system 108 is able to confirm that the monitored individual has received the information. For example, the system is configured to send messages, such as, court appearance dates to the monitored individual. Upon reviewing the message, the monitored individual can acknowledge receipt of the message by pressing the appropriate button. This removes the excuse of the monitored individual for failing to meet a court date because they were unaware of it. Also, it makes sure that monitored individuals are informed of other important information. It should be appreciated that other types of information may be sent with the acknowledgement and/or the acknowledgement may be acknowledged in other manners. For example, biometric information or a digital signature may be required in order to acknowledge a message. With a picture phone capable mobile telephone, the monitored individual may be required to send a snapshot or real time video of themselves along with the acknowledgement so as to confirm their identity. Other types of identifiers such as fingerprints, retinal scans, as well as others can also be used to confirm acknowledgement of the message.

Figure 39:
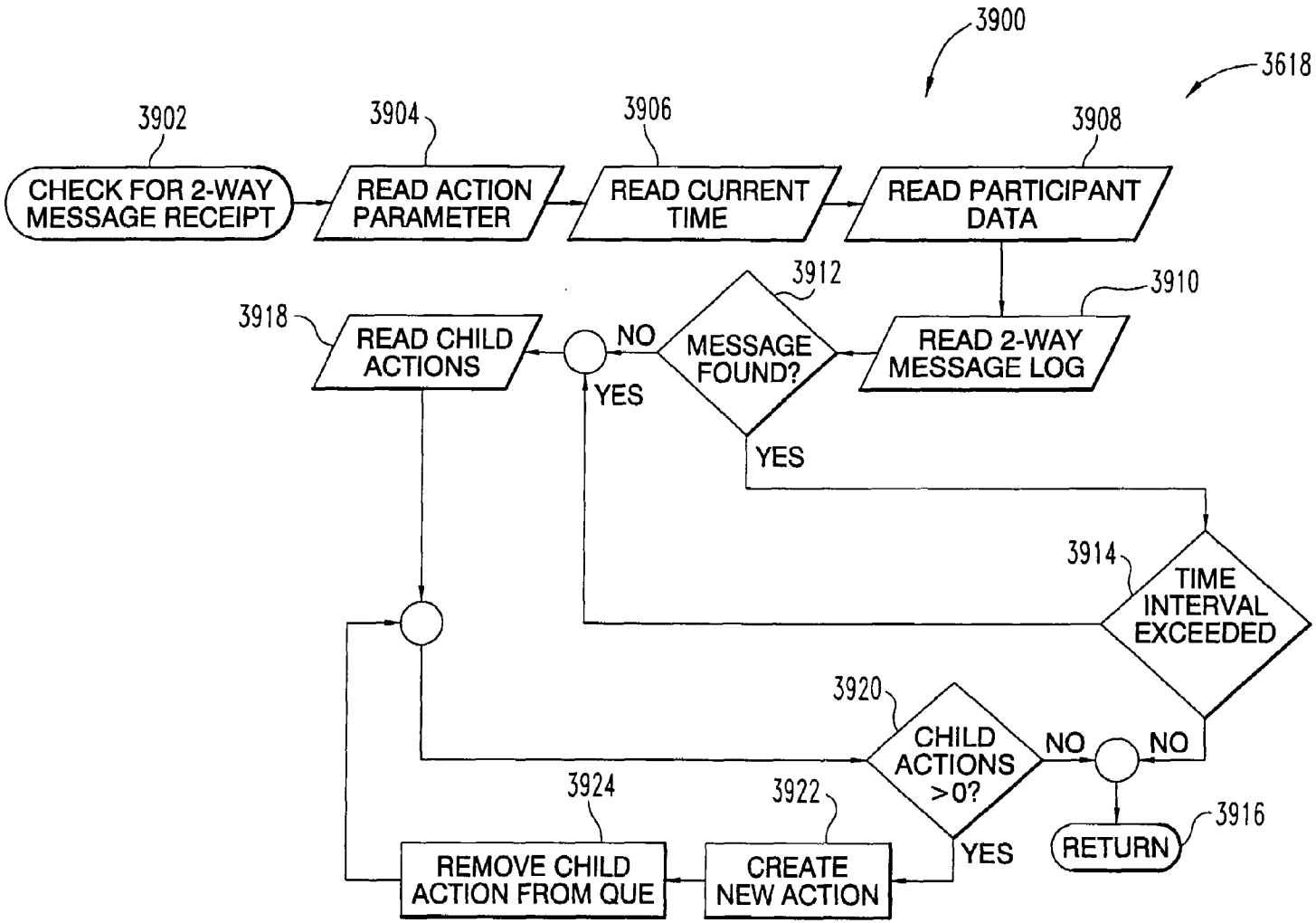
FIG. 39 is a flow diagram illustrating a technique for checking for receipt of a message.

As discussed above, the monitoring system 108 tracks communications to ensure that the monitored individual has acknowledged a particular message, and if not, alerts the appropriate corrections officer that an acknowledgement has not been made in the required time. Flowchart 3900 in FIG. 39 illustrates one technique the action processing engine uses for checking acknowledgement of two-way messages, as was described with reference to flowchart 3600 in FIG. 36 (3618). Upon initialization in stage 3902, the processor 122 of the monitoring system 108 reads the action parameters for the check for receipt of message action from memory 124 in stage 3904. In stage 3906, the monitoring system 108 reads the current time from the clock 126, and participant data 2416 is read from the database 2412 in stage 3908. Afterwards, the monitoring system 108 reads the two-way message log in the database 2412 in stage 3910, and the monitoring system 108 determines whether or not the acknowledgement message was received based on the two-way message log in stage 3912. If an acknowledgement message is found in the message log, the monitoring system 108 determines in stage 3914 whether the maximum time interval between the sending of the two-way message and the receipt of the acknowledgement message has been exceeded. In one embodiment, the action parameters specify the maximum time interval when the acknowledgement should be received. However, it should be appreciated that the maximum time interval can be specified in other manners. If the time interval has not been exceeded, then the no action needs to be taken because the acknowledgement was received in time, and as a result, the subroutine returns to the calling routine in stage 3916. On the other hand, if an acknowledgement message is not found in stage 3912 or the maximum time interval has been exceeded in stage 3914, the monitoring system 108 reads any child actions of the check for receipt of message action from memory 124 in stage 3918. The monitoring system 108 in stage 3920 determines if any child actions need to be processed, and if not, proceeds to stage 3916. If child actions still need to be processed, the monitoring system 108 in stage 3922 creates a new action based on the child action and removes the child action from the stack of actions to process in stage 3924. As an example, a child action can include sending an alert message to a corrections officer that communications have been lost with a specific monitoring device 102. As should be appreciated, other types of child actions can be processed in stage 3922. The monitoring system 108 proceeds in stage 3920 until all of the child actions have been processed from the stack. In the illustrated embodiment, the child actions are processed in a sequential manner, but it should be appreciated that child actions can be processed at the same time in other embodiments. Moreover, selected stages can be omitted and/or the order of selected stages can be changed in other embodiments.

As briefly described above with reference to FIG. 36 (stage 3624), the action processing engine 2408 also has the ability to re-evaluate open exception log entries. Exception log entries are created when a violation or some other problem has occurred. For instance, exception log entries can be created when a time violation occurs in stage 3106 of FIG. 31, an exterior region violation in stage 3222 of FIG. 32, or an interior region violation in stage 3320 of FIG. 33. By way of a non-limiting example, when the tracking device 102 fails to report in a timely fashion, the monitoring system 108 creates an exception log entry that has an open status. Once the problem is addressed (i.e., the corrections officer apprehends the monitored individual), the status of the log entry can be automatically or manually closed. Violations can become more problematic if not addressed in a timely manner. However, not all violations require the immediate attention of the corrections officer, and some violations correct themselves over time. For instance, the monitored individual might move out of an exterior region on their own volition or recharge a low battery in their tracking device 102. Nevertheless, even a minor violation, if left unanswered such that it remains open a long time, can become more serious. As an example, when the reported battery voltage of the tracking device 102 is low, it initially may not be a very serious problem, but if left unaddressed overtime, it can become a serious problem because communication with the tracking device 102 will be lost. Typically, corrections officers monitor more than one individual, and therefore, there is a need to prioritize violations so that the corrections officer can quickly identify serious problems. In one embodiment, the law enforcement computer 112 displays the outstanding violations in order by threat level in which the violations with a high threat level are displayed above those with a low threat level. It nevertheless should be appreciated that the violations can be displayed in other manners. Color coding, graphics and the like can be used to identify the more serious violations, for example. The action processing engine 2408 of the monitoring system 108 is able to automatically adjust the threat level raised by a violation, based on time the violation remains open and the type of violation.

Figure 40:
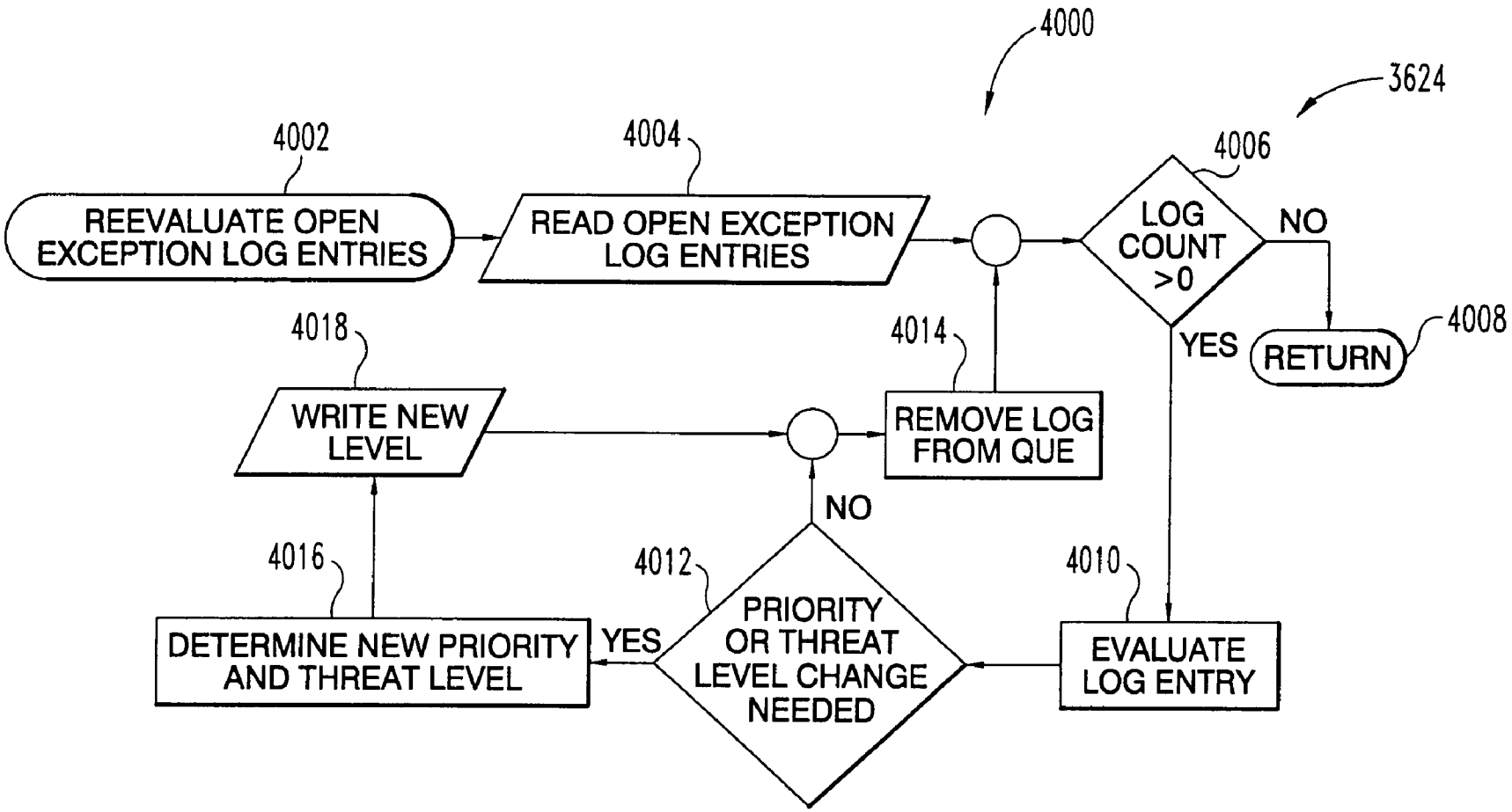
FIG. 40 is a flow diagram illustrating a technique for reevaluating the threat level of an open violation.

Flowchart 4000 in FIG. 40 illustrates a technique for re-evaluating open exception log entries according to one embodiment. After the routine is initiated in stage 4002, the monitoring system 108 reads open exception log entries from the database 2412. If no open log entries are present in stage 4006, the subroutine returns to the originally called routine in stage 4008. When open log entries are available, the processor 122 of the monitoring system 108 evaluates each open log entry in a sequential manner starting in stage 4010. During stage 4010, the priority or threat level of the violation as well as how long the violation has been open are some of the many factors used to evaluate the violation. In stage 4012, the monitoring system 108 determines whether or not the threat level needs to be changed for the specific exception log entry. For example, if it has been a while since a communication has been received from the personal tracking device 102, the priority or threat level may be increased; whereas when the battery of the tracking device 102 has been low for only a minute, no change in threat level may be required. If the priority or threat level does not need to be changed in stage 4012, the log entry is removed from the stack of open log entries to be processed in stage 4014, and the monitoring system 108 continues to evaluate subsequent open log entries in stage 4006, if more exist. It should be understood that, although the open log entry is removed from the stack of entries to be evaluated in stage 4014, the log entry remains in the logs 2414 as an open exception log entry. When the monitoring system 108 determines that the threat level needs to be changed in stage 4012, the monitoring system 108 determines the new priority and threat levels in stage 4016 and writes the new threat level for the entry into the logs 2414 in stage 4018. The new threat level can be determined through a number of factors, including the type of violation, the length of time the entry has been open, historical data for the monitored individual, participant data, the location of the monitored individual, and the like, for example. In one form, the threat level increased by threat level value multiplied by the time the entry has been opened. However, it is contemplated that the threat level can be changed in other manners and using other parameters. After the new threat level is written for the entry in stage 4018, the log entry then is removed from the stack of log entries needed to be processed in stage 4014, and the remaining log entries are processed in the manner as described above, starting at stage 4006.

Figure 41:
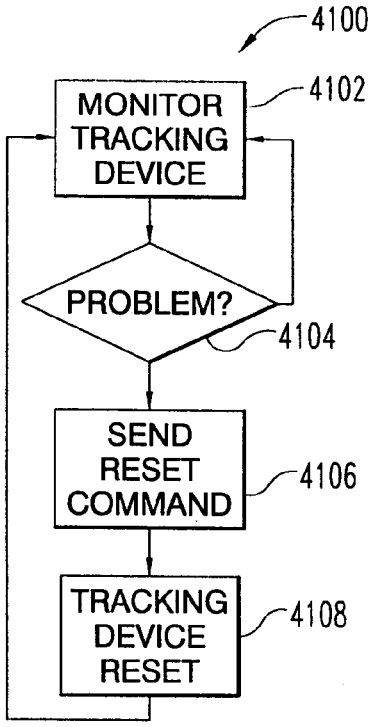
FIG. 41 is a flow diagram illustrating a technique for remotely resetting a tracking device.

As mentioned before with respect to flowchart 1100 in FIG. 11, due to the critical nature of tracking monitored individuals, such as criminals, it is desirable that the personal tracking device 102 has a low failure rate. To increase the operational up time of the tracking device 102, the monitoring system 108 is able to remotely reset the tracking device 102 so as to cure some types of problems on the tracking device, especially those associated with software. A technique for remotely resetting the tracking device 102 will now be described with reference to flowchart 4100 in FIG. 41. The technique illustrated by flow chart 4100 will described with reference to a tracking device 102 that includes the mobile telephone 502, receiver module 504 and PID 132 of the types described with reference to FIGS. 5–9, but it should be recognized that this technique can be used with other types of tracking devices 102. In stage 4102, the monitoring system 108 monitors one or more of the tracking devices 102 in the manner as described above, and in stage 4104, the monitoring system 108 determines if there is a problem with one of the tracking devices 102. For example, the monitoring system 108 might not have received the location or status information from the tracking device 102 within the designated time interval. In another example, the monitoring system 108 might receive an error code from the tracking device 102 that indicates an internal problem, such as a code that indicates an inability to obtain a GPS reading. When no problems exist on the tracking device 102, the monitoring system 4102 continues to monitor the tracking device 102 in stage 4102. On the other hand, when a problem is detected in stage 4104, the monitoring system 108 sends a reset command over the network 106 and the wireless telephone provider system 104 to the tracking device 102. In one embodiment, the mobile telephone 502 relays the reset command from the monitoring system 108 to the receiver module 504, which in turn sends a restart signal to the mobile telephone 502 that reboots the mobile telephone 502. The receiver module 504 in this embodiment includes an internal power source, such as a battery, so that the receiver module 504 can operate independently of the mobile telephone 502 so as to allow the receiver 504 to restart the mobile telephone. Upon receipt of the reset command, the receiver module 504 in one embodiment sets the voltage to ground for one millisecond on one of the pins of the accessory/data cable connector 508 in the mobile telephone 502 so as to reset the mobile telephone 502. It should be recognized that other types of mobile telephones 502 can be reset in other manners. For example, other types of mobile telephones 502 might require different pin combinations, voltages, signals and/or time periods in order for them to be reset. In order to prevent the monitored individual from locally resetting the tracking device 102, the tracking device 102 is configured to only be reset upon receipt of a designated encrypted message from the tracking device. After the mobile telephone 502 is reset, the monitoring software is automatically reinitialized on the mobile telephone 502 in the manner as described above with reference to FIG. 12. As mentioned before, the tracking device 102 can be initialized in other manners, however. Usually, resetting the mobile telephone 502 fixes most types of software problems, and the monitoring system 108 is able to continue to monitor the tracking device 102 in stage 4102. Upon being reset, the tracking device 102 in one embodiment is configured to send a status message that provides the current location. If, however, in stage 4102 the monitoring system 108 senses that the problem is not fixed, the monitoring system 108 can send another reset command to the tracking device 102 or perform some other corrective action, such as alerting the appropriate personnel. It is contemplated that in other embodiments the tracking device 102 can be configured to selectively reset one or more of its component, either sequentially or at the same time. For example, the monitoring system 108 can send a command to the mobile telephone 502 instructing the mobile telephone 502 to reset the receiver module 504 and/or the PID 132. In another example, the receiver module 504 can be configured to reset the mobile telephone 502, the PID 132 and/or itself, separately or at the same time. With this ability to remotely reset selected components or the entire tracking device 102, the monitoring system 108 is able automatically and remotely fix problems on the tracking device 102 without the need of outside assistance, thereby improving the overall operational efficiency of the tracking device 102.

It should be appreciated that in other embodiments that at least some of the techniques described above with reference to the tracking device 102 can be modified for use on the monitoring system 108. Likewise, it is contemplated that the techniques described above with reference to the monitoring system 108 can be modified for use on the tracking device 102. For example, the manner in which rules are processed on the monitoring system 108 can be modified for use on the tracking device 102, and vice-versa. Moreover, it should be understood that the above described techniques in other embodiments can be modified such that selected stages can be omitted, new stages can be added and/or the order of the stage can be changed.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. All publications, patents, and patent applications cited in this specification are herein incorporated by reference as if each individual publication, patent, or patent application were specifically and individually indicated to be incorporated by reference and set forth in its entirety herein.

What is claimed is:

1. A method, comprising:

monitoring a monitored individual with a tracking device, wherein the tracking device includes a wearable device worn by the monitored individual, wherein the tracking device is operable to determine location of the monitored individual;

sending status messages concerning the monitored individual to a monitoring system on an intermittent basis with the tracking device;

pausing said sending the status messages while the tracking device processes a communication between the monitored individual and at least one other person; and resuming said sending the status messages after the communication between the monitored individual and the other person ceases.

2. A method, comprising:

determining location of a monitored individual with a tracking device;

sensing that the monitored individual is generally motionless with the tracking device;

ceasing processing of the location of the monitored individual upon said sensing, wherein said ceasing processing includes transmitting the location of the monitored individual with a reading alert flag over a network from the tracking device to a monitoring system;

detecting motion of the monitored individual with the tracking device after said ceasing processing; and reinitiating processing of the location of the monitored individual upon said detecting.

3. The method of claim 2, wherein said ceasing processing includes stopping said determining the location of the monitored individual with the tracking device.

4. The method of claim 2, wherein said ceasing processing includes terminating transmission of the location of the monitored individual to a monitoring system.

5. The method of claim 2, wherein said ceasing processing includes skipping evaluation of selected rules in the tracking device.

6. The method of claim 2, further comprising:

wherein the tracking device includes a GPS receiver and a motion sensor;

wherein said determining includes determining the location of the monitored individual with the GPS receiver;

wherein said sensing includes sensing that the monitored individual is generally motionless with the motion sensor; and wherein said ceasing processing includes stopping said determining the location of the monitored individual to reduce drift in location readings.

7. The method of claim 6, further comprising:

detecting motion of the monitored individual with the motion detector after said ceasing processing; and reinitiating processing of the location of the monitored individual upon said detecting.

8. The method of claim 6, wherein the GPS receiver determines only a single GPS reading to conserve power during said determining the location of the monitored individual.

9. The method of claim 6, wherein the tracking device includes a wearable device worn by the monitored individual.

10. The method of claim 2, wherein the tracking device includes a wearable device worn by the monitored individual.

11. The method of claim 10, further comprising:

wherein the tracking device includes a mobile telephone in possession of the monitored individual; and transmitting a status message from the wearable device to the mobile telephone.

12. The method of claim 1, further comprising:

wherein the tracking device includes a mobile telephone;

receiving a telephone call with the mobile telephone, wherein communication between the monitored individual and the at least one other person includes the telephone call; and said pausing said sending the status messages occurs in response to said receiving the telephone call.

* * * * *